US005543275A

United States Patent [19]

Makuta

[11] Patent Number: 5,543,275

[45] Date of Patent: Aug. 6, 1996

[54] SILVER HALIDE COLOR PHOTOGRAPHIC MATERIAL

[75] Inventor: Toshiyuki Makuta, Kanagawa, Japan

[73] Assignee: Fuji Photo Film Co., Ltd., Kanagawa, Japan

[21] Appl. No.: 438,540

[22] Filed: May 10, 1995

[30] Foreign Application Priority Data

May 10, 1994 [JP] Japan ..... 6-119670

[51] Int. Cl.[6] ..... G03C 1/46

[52] U.S. Cl. ..... 430/503; 430/512; 430/543; 430/546; 430/551; 430/558; 430/931

[58] Field of Search ..... 430/503, 512, 430/543, 546, 551, 558, 931

[56] References Cited

U.S. PATENT DOCUMENTS

| | | | |
|---|---|---|---|
| 4,863,840 | 9/1989 | Komorita et al. | 430/558 |
| 4,865,963 | 9/1989 | Furutachi et al. | 430/512 |
| 5,200,307 | 4/1993 | Takahashi | 430/558 |
| 5,332,655 | 7/1994 | Shono | 430/512 |

FOREIGN PATENT DOCUMENTS

| | | |
|---|---|---|
| 0571959A2 | 12/1993 | European Pat. Off. . |
| 2-296241 | 12/1990 | Japan . |

*Primary Examiner*—Geraldine Letscher
*Attorney, Agent, or Firm*—Birch, Stewart, Kolasch & Birch, LLP

[57] ABSTRACT

A silver halide color photographic material having excellent color absorption characteristics and good yellow density is achieved by using a support having thereon at least one yellow coloring light-sensitive layer, at least one magenta coloring light-sensitive layer, and at least one cyan coloring light-sensitive layer, wherein the magenta coloring light-sensitive layer contains at least one dye-forming coupler represented by the following formula (M-I), at least one high boiling point organic solvent having a dielectric constant of 6.0 or less and a refractive index of 1.50 or less, and at least one benzotriazole ultraviolet absorber:

(M-I)

wherein $R_1$ represents a branched or aromatic group represented by the formulas (Q-1), (Q-2) or (Q-3); $R_2$ and $R_3$ each represents a substituent; n represents an integer of form 0 to 4, and when n is 2 or more, the plurality of $R_3$ may be the same or different; and X represents a hydrogen atom or a group capable of being eliminated upon coupling reaction with an oxidized product of a developing agent.

15 Claims, No Drawings

SILVER HALIDE COLOR PHOTOGRAPHIC MATERIAL

FIELD OF THE INVENTION

The present invention relates to a silver halide color photographic material and a method of formation of a color image and, more particularly, to a silver halide color photographic material which is excellent in color reproducibility, image stability, and coloring ability.

BACKGROUND OF THE INVENTION

A method of formation of a color image which is generally used in the field of a silver halide color photographic material is a method of forming an azomethine dye by reacting an oxidized aromatic primary amine based color developing agent with a coupler using an exposed silver halide as an oxidizing agent. A subtractive color process is used for reproducing a color image in such a method, and a color image is in general formed by changing the amounts of dyes formed of three colors of yellow, magenta and cyan.

1H-pyrazolo[1,5-b][1,2,4]triazole based magenta couplers are particularly superior as magenta couplers above all in not only an absorption characteristic of a dye but also a coloring ability and fastness.

The absorption characteristic of a color dye is expressed in detail by a spectral absorption waveform, and can be expressed by characteristic values such as a maximum absorption wavelength and an extinction coefficient. The presence or absence of a side absorption, the width of an absorption band and the sharpness of an absorption edge, as well as the above characteristic values, are important factors for the color reproduction of color photographs. White light comprises blue light (400 to 500 nm), green light (500 to 600 nm) and red light (600 to 800 nm), and reddish purple color which is a complementary color of green light appears when green light is absorbed by a magenta dye, but when there is an absorption characteristic failure of a magenta dye, a part of blue light and red light is absorbed, leading to turbidity of a hue. Such a dye cannot reproduce clear colors. A pyrazolotriazole type coupler does not show a side absorption in a blue light region, an absorption edge of a long wavelength side is sharp, and an extra absorption in a red light region is extremely small, compared with a pyrazolone type coupler.

However, a dye having such an absorption characteristic causes a new problem when an absorption wavelength is not appropriate. That is, too short an absorption wavelength cannot reproduce clear purple and black colors because there is generated a region between the absorption region of a magenta dye and that of a cyan dye which cannot sufficiently absorb light. On the contrary, too long an absorption wavelength cannot reproduce clear red and black colors because there is generated a region between the absorption region of a magenta dye and that of a yellow dye which cannot sufficiently absorb light. Accordingly, a technique of controlling a hue has a more important meaning in the case of a pyrazolotriazole type coupler than in the case of a pyrazolone type coupler.

The absorption wavelength of the dye formed differs according to the kind of substituent used, even in couplers having the same skeleton. Therefore, a hue can be controlled by a substituent. In general, the introduction of an electron attractive group causes the shift of a wavelength to a long wavelength and the introduction of an electron donative group causes the shift of a wavelength to a short wavelength, although the degree differs according to the position to which the substituent is introduced. However, such changes of substituents are sometimes accompanied by changes of other important performances of couplers such as a coupling activity and fastness to heat and light, therefore, the selection of the couplers is often limitative.

These performances do not necessarily change simultaneously with preferable performances. In practice, couplers that are excellent on an average in various performances must be selectively used under present conditions.

The absorption wavelength of a dye can be controlled to a certain degree according to the way of use, for example, the kind and amount of a high boiling point organic solvent for use in dispersion, and the use of other additives, even when the same couplers are used. The most important thing in controlling a hue by a high boiling point organic solvent is the polarity of a high boiling point organic solvent, such as a dielectric constant, hydrogen bonding and electron donative properties. A dielectric constant is often used as the parameter of the polarity among all. A high boiling point organic solvent having a high dielectric constant causes the shift of a dye absorption wavelength to a long wavelength and a high boiling point organic solvent having a low dielectric constant causes the shift of a dye absorption wavelength to a short wavelength. The molecular structure that makes the dielectric constant high is a structure which contains many aromatic rings or polar groups containing hetero atoms. Examples of such high boiling point organic solvents that are frequently used include tricresyl phosphate and dibutyl phthalate. On the other hand, the molecular structure that makes the dielectric constant low is a structure which contains many hydrophobic aliphatic chain moieties, for example, trioctyl phosphate and fatty acid alkyl esters. Controlling of a hue by means of such high boiling point organic solvents has been succeeded to some degree, although the coloring performance of a coupler or the stability of a dye are sometimes influenced.

In addition, it is known that the addition of the compound having a phenolic hydroxyl group or a sulfonamido group can shift the absorption wavelength of a dye to a long wavelength. However, an additive that can shift the absorption wavelength of a dye to a short wavelength has not yet been known.

The 1H-pyrazolo[1,5-b][1,2,4]triazole coupler having a tertiary substituent at the 6-position and an aryl group at the 2-position, which is disclosed in EP 571,959, is stable against the composition variation of a processing solution in development. The absorption wavelength of the dye formed from this coupler by color development has an inclination to be too long for a magenta color, and it is useful to disperse the coupler in a high boiling point organic solvent having a low dielectric constant to shift the hue of the dye formed to an appropriate wavelength range.

However, it has been revealed that the use of a high boiling point organic solvent having a low dielectric constant with the above 1H-pyrazolo[1,5-b][1,2,4]triazole coupler causes a new problem of lowering of a yellow color density. The lowering of a yellow color density caused therein cannot be improved so much by increasing a coating amount of a yellow coupler or a silver halide, and this has been a large impediment in designing a silver halide color photographic material.

SUMMARY OF THE INVENTION

Accordingly, the object of the present invention is to provide a silver halide color potographic material which is excellent in coloring ability, provides a colored dye fast to light, has a preferred magenta color hue, is excellent in color reproducibility, and provides a sufficient yellow color density, and to provide a method of formation of such a color image.

DETAILED DESCRIPTION OF THE INVENTION

The above objects of the present invention have been achieved by the silver halide color photographic material described below:

(1) A silver halide color photographic material comprising a support having thereon at least one yellow coloring light-sensitive layer, at least one magenta coloring light-sensitive layer, and at least one cyan coloring light-sensitive layer, wherein the magenta coloring light-sensitive layer contains at least one dye-forming coupler represented by the following formula (M-I), at least one high boiling point organic solvent having a dielectric constant of 6.0 or less and a refractive index of 1.50 or less, and at least one benzotriazole ultraviolet absorber:

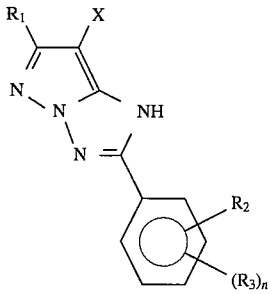

(M-I)

wherein $R_1$ represents a group represented by the following formula (Q-1), (Q-2) or (Q-3); $R_2$ and $R_3$ each represents a substituent; n represents an integer of from 0 to 4, and when n is 2 or more, the plurality of $R_3$ may be the same or different; and X represents a hydrogen atom or a group capable of being eliminated upon coupling reaction with an oxidized product of a developing agent.

$$—C(R_4)(R_5)—(R_6) \quad \text{(Q-1)}$$

wherein $R_4$ represents an alkyl group, a cycloalkyl group, an aryl group or a heterocyclic group; and $R_5$ and $R_6$ each represents a substituent; and at least two of any of $R_4$, $R_5$ and $R_6$ may be bonded each other to form a 5- to 7-membered monocyclic or condensed ring.

$$—CH(R_7)—R_8 \quad \text{(Q-2)}$$

wherein $R_7$ represents an alkyl group, a cycloalkyl group, an aryl group or a heterocyclic group; and $R_8$ represents a substituent; and $R_7$ and $R_8$ may be bonded each other to form a 5- to 7-membered ring.

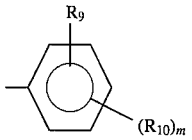

(Q-3)

wherein $R_9$ and $R_{10}$ each represents a substituent; and m represents an integer of from 0 to 4; and when m is 2 or more, the plurality of $R_{10}$ may be the same or different.

(2) The silver halide color photographic material as described in the above (1), wherein the dye forming coupler represented by formula (M-I) is represented by formula (M-II):

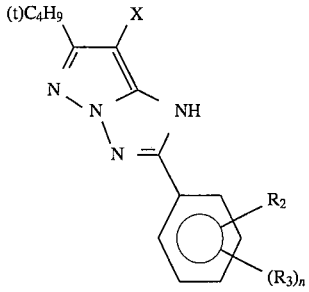

(M-II)

wherein $R_2$, $R_3$, n and X each has the same meaning as $R_2$, $R_3$, n and X in formula (M-I).

(3) The silver halide color photographic material as described in the above (1) or (2), wherein said magenta coloring light-sensitive layer contains at least one compound represented by the following formula (II) or (III):

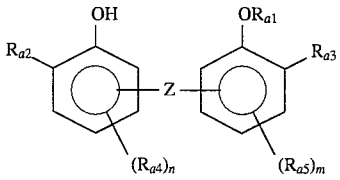

(II)

wherein $R_{a1}$ represents a hydrogen atom, an aliphatic group, an arylcarbonyl group, an aliphatic carbonyl group or a sulfonyl group; $R_{a2}$ and $R_{a3}$ may be the same or different and each represents a hydrogen atom, an aliphatic group, an aliphatic oxy group, an acylamino group, an aliphatic oxycarbonyl group or a carbamoyl group; $R_{a4}$ and $R_{a5}$ may be the same or different and each represents an aliphatic group or an acylamino group; Z represents a bond or a divalent linking group; n and m each represents 0, 1 or 2; and when n or m is 2, the plurality of $R_{a4}$ or $R_{a5}$ may be the same or different.

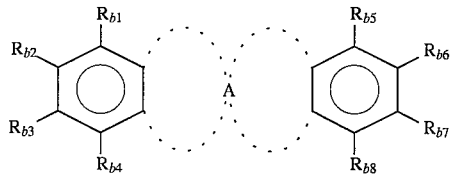

(III)

wherein $R_{b1}$, $R_{b2}$, $R_{b3}$, $R_{b4}$, $R_{b5}$, $R_{b6}$, $R_{b7}$ and $R_{b8}$ may be the same or different, and each represents a hydrogen atom, an aliphatic group, an acyl group, an acylamino group, an aliphatic oxycarbonyl group, an aryloxycarbonyl group, a halogen atom, a sulfonyl group, a carbamoyl group, a sulfamoyl group, or $—X_b—R_{b9}$; A represents a non-metal atomic group necessary to form a spiro ring or a bicyclo ring; $X_b$ represents —O—, —S— or $—N(R_{b10})—$; $R_{b9}$ and $R_{b10}$ may be the same or different and each represents an aliphatic group; of $R_{b1}$ to $R_{b8}$, those substituents at the ortho position may be bonded each other to form a 5- to 8-membered ring; $R_{b9}$ and $R_{b10}$ may be bonded each other to form a 5- to 7-membered ring; provided that at least one of $R_{b1}$ to $R_{b4}$, and at least one of $R_{b5}$ to $R_{b8}$ represent $—X_b—R_{b9}$, which may be the same or different.

The present invention can solve the problems in the prior art by the above described constitution of the invention.

The magenta coupler represented by formula (M-I) of the present invention has high color density and excellent in dye image stability but the maximum absorption wavelength is a little too long, however, the preferred maximum absorption wavelength of the magenta coupler can be obtained by the addition of the high boiling point organic solvent of the present invention.

However, the addition of the high boiling point organic solvent of the present invention lowers the yellow color density. When a benzotriazole based ultraviolet absorber is used in the same layer to cope with this problem, the yellow color density can be heightened.

Further, when the magenta coupler represented by formula (M-I) is represented by formula (M-II), the color density and the dye stability are more improved.

Still further, when a compound represented by formula (II) or (III) is added, the yellow color density and the magenta dye stability are further more improved.

The compound represented by formula (M-I) is described in detail below.

$R_2$ represents an alkyl group (preferably a straight chain or branched chain alkyl group having from 1 to 32 carbon atoms, e.g., methyl, ethyl, propyl, isopropyl, butyl, t-butyl, 1-octyl, tridecyl), a cycloalkyl group (preferably a cycloalkyl group having from 3 to 32 carbon atoms, e.g., cyclopropyl, cyclopentyl, cyclohexyl), an alkenyl group (preferably an alkenyl group having from 2 to 32 carbon atoms, e.g., vinyl, allyl, 3-buten-1-yl), an aryl group (preferably an aryl group having from 6 to 32 carbon atoms, e.g., phenyl, 1-naphthyl, 2-naphthyl), a heterocyclic group (preferably a 5- to 8-membered heterocyclic group having from 1 to 32 carbon atoms, e.g., 2-thienyl, 4-pyridyl, 2-furyl, 2-pyrimidinyl, 1-pyridyl, 2-benzothiazolyl, 1-imidazolyl, 1-pyrazolyl, benzotriazol-2-yl), a cyano group, a halogen atom (e.g., a fluorine atom, a chlorine atom, a bromine atom), a hydroxyl group, a nitro group, a carboxyl group, an alkoxy group (preferably an alkoxy group having from 1 to 32 carbon atoms, e.g., methoxy, ethoxy, 1-butoxy, 2-butoxy, isopropoxy, t-butoxy, dodecyloxy), a cycloalkoxy group (preferably a cycloalkoxy group having from 3 to 32 carbon atoms, e.g., cyclopentyloxy, cyclohexyloxy), an aryloxy group (preferably an aryloxy group having from 6 to 32 carbon atoms, e.g., phenoxy, 2-naphthoxy), a heterocyclic oxy group (preferably a heterocyclic oxy group having from 1 to 32 carbon atoms, e.g., 1-phenyltetrazol-5-oxy, 2-tetrahydropyranyloxy, 2-furyloxy), a silyloxy group (preferably a silyloxy group having from 1 to 32 carbon atoms, e.g., trimethylsilyloxy, t-butyldimethylsilyloxy, diphenylmethylsilyloxy), an acyloxy group (preferably an acyloxy group having from 2 to 32 carbon atoms, e.g., acetoxy, pivaloyloxy, benzoyloxy, dodecanoyloxy), an alkoxycarbonyloxy group (preferably an alkoxycarbonyloxy group having from 2 to 32 carbon atoms, e.g., ethoxycarbonyloxy, t-butoxycarbonyloxy), a cycloalkoxycarbonyloxy group (preferably a cycloalkoxycarbonyloxy group having from 4 to 32 carbon atoms, e.g., cyclohexyloxycarbonyloxy), an aryloxycarbonyloxy group (preferably an aryloxycarbonyloxy group having from 7 to 32 carbon atoms, e.g., phenoxycarbonyloxy), a carbamoyloxy group (preferably a carbamoyloxy group having from 1 to 32 carbon atoms, e.g., N,N-dimethylcarbamoyloxy, N-butylcarbamoyloxy), a sulfamoyloxy group (preferably a sulfamoyloxy group having from 1 to 32 carbon atoms, e.g., N,N-diethylsulfamoyloxy, N-propylsulfamoyloxy), an alkanesulfonyloxy group (preferably an alkanesulfonyloxy group having from 1 to 32 carbon atoms, e.g., methanesulfonyloxy, hexadecanesulfonyloxy), an arylsulfonyloxy group (preferably an arylsulfonyloxy group having from 6 to 32 carbon atoms, e.g., benzenesulfonyloxy), an acyl group (preferably an acyl group having from 1 to 32 carbon atoms, e.g., formyl, acetyl, pivaloyl, benzoyl, tetradecanoyl), an alkoxycarbonyl group (preferably an alkoxycarbonyl group having from 2 to 32 carbon atoms, e.g., methoxycarbonyl, ethoxycarbonyl, octadecyloxycarbonyl), a cycloalkoxycarbonyl group (preferably a cycloalkoxycarbonyl group having from 2 to 32 carbon atoms, e.g., cyclohexyloxycarbonyl), an aryloxycarbonyl group (preferably an aryloxycarbonyl group having from 7 to 32 carbon atoms, e.g., phenoxycarbonyl), a carbamoyl group (preferably a carbamoyl group having from 1 to 32 carbon atoms, e.g., carbamoyl, N,N-dibutylcarbamoyl, N-ethyl-N-octylcarbamoyl, N-propylcarbamoyl), an amino group (preferably an amino group having 32 or less carbon atoms, e.g., amino, methylamino, N,N-dioctylamino, tetradecylamino, octadecylamino), an anilino group (preferably an anilino group having from 6 to 32 carbon atoms, e.g., anilino, N-methylanilino), a heterocyclic amino group (preferably a heterocyclic amino group having from 1 to 32 carbon atoms, e.g., 4-pyridylamino), a carbonamido group (preferably a carbonamido group having from 2 to 32 carbon atoms, e.g., acetamido, benzamido, tetradecanamido, groups in the formula (M-III)), a ureido group (preferably a ureido group having from 1 to 32 carbon atoms, e.g., ureido, N,N-dimethylureido, N-phenylureido), an imido group (preferably an imido group having 10 or less carbon atoms, e.g., N-succinimido, N-phthalimido), an alkoxycarbonylamino group (preferably an alkoxycarbonylamino group having from 2 to 32 carbon atoms, e.g., methoxycarbonylamino, ethoxycarbonylamino, t-butoxycarbonylamino, octadecyloxycarbonylamino), an aryloxycarbonylamino group (preferably an aryloxycarbonylamino group having from 7 to 32 carbon atoms, e.g., phenoxycarbonylamino), a sulfonamido group (preferably a sulfonamido group having from 1 to 32 carbon atoms, e.g., methanesulfonamido, butanesulfonamido, benzenesulfonamido, hexadecanesulfonamido, groups in the formula (M-III)), a sulfamoylamino group (preferably a sulfamoylamino group having from 1 to 32 carbon atoms, e.g., N,N-dipropylsulfamoylamino, N-ethyl-N-dodecylsulfamoylamino), an azo group (preferably an azo group having from 1 to 32 carbon atoms, e.g., phenylazo), an alkylthio group (preferably an alkylthio group having from 1 to 32 carbon atoms, e.g., ethylthio, octylthio), an arylthio group (preferably an arylthio group having from 6 to 32 carbon atoms, e.g., phenylthio), a heterocyclic thio group (preferably a heterocyclic thio group having from 1 to 32 carbon atoms, e.g., 2-benzothiazolylthio, 2-pyridylthio, 1-phenyltetrazolylthio), an alkylsulfinyl group (preferably an alkylsulfinyl group having from 1 to 32 carbon atoms, e.g., dodecanesulfinyl), an arylsulfinyl group (preferably an arylsulfinyl group having from 6 to 32 carbon atoms, e.g., benzenesulfinyl), an alkanesulfonyl group (preferably an alkanesulfonyl group having from 1 to 32 carbon atoms, e.g., methanesulfonyl, octanesulfonyl), an arylsulfonyl group (preferably an arylsulfonyl group having from 6 to 32 carbon atoms, e.g., benzenesulfonyl, 1-naphthalenesulfonyl), a sulfamoyl group (preferably a sulfamoyl group having 32 or less carbon atoms, e.g., sulfamoyl, N,N-dipropylsulfamoyl, N-ethyl-N-dodecylsulfamoyl), a sulfo group, or a phosphonyl group (preferably a phosphonyl group having from 1 to 32 carbon atoms, e.g., phenoxyphosphonyl, octyloxyphosphonyl, phenylphosphonyl).

$R_3$ represents the same groups as represented by $R_2$.

In the group represented by formula (Q-1), $R_4$ represents an alkyl group, a cycloalkyl group, an aryl group, or a heterocyclic group; $R_5$ and $R_6$ each represents the same groups as represented by $R_2$; and at least optional two of $R_4$, $R_5$ and $R_6$ may be bonded each other to form a 5- to 7-membered hydrocarbon ring or a heterocyclic ring which preferably contain at least one of N, S and O (a monocyclic or condensed ring). The preferable examples of the groups for $R_4$ are the same as those for $R_2$.

In the group represented by formula (Q-2), $R_7$ represents the same groups as represented by $R_4$ in formula (Q-1); $R_8$ represents the same groups as represented by $R_2$; $R_7$ and $R_8$ may be bonded each other to form a 5- to 7-membered hydrocarbon ring or a heterocyclic ring which preferably contain at least one of N, S and O (a monocyclic or condensed ring).

In formula (Q-3), $R_9$ and $R_{10}$ represent the same groups as represented by $R_2$.

X represents a hydrogen atom or a group capable of being eliminated on reacting with an oxidized product of a developing agent. Examples of the groups capable of being eliminated include a halogen atom, an alkoxy group, an aryloxy group, an acyloxy group, a carbamoyloxy group, a sulfonyloxy group, a carbonamido group, a sulfonamido group, a carbamoylamino group, a heterocyclic group, an arylazo group, an alkylthio group, an arylthio group, and a heterocyclic thio group. The scope and specific examples of these groups are the same as those cited in the explanation of the groups represented by $R_2$. X may be, in addition to the above groups, bis type couplers obtained by bonding 4-equivalent couplers of 2 molecules via an aldehyde or a ketone, or may be photographically useful groups or precursors thereof, such as groups useful for a development accelerator, a development inhibitor, a desilvering accelerator, or a leuco dye.

The groups represented by $R_1$, $R_2$, $R_3$ and X may further be substituted, and examples of preferred substituents include a halogen atom, an alkyl group, a cycloalkyl group, an alkenyl group, an aryl group, a heterocyclic group, a cyano group, a hydroxyl group, a nitro group, an alkoxy group, an aryloxy group, a heterocyclic oxy group, a silyloxy group, an acyloxy group, an alkoxycarbonyloxy group, a cycloalkoxycarbonyloxy group, an aryloxycarbonyloxy group, a carbamoyloxy group, a sulfamoyloxy group, an alkanesulfonyloxy group, an arenesulfonyloxy group, a carboxyl group, an acyl group, an alkoxycarbonyl group, a cycloalkoxycarbonyl group, an aryloxycarbonyl group, a carbamoyl group, an amino group, an anilino group, a heterocyclic amino group, a carbonamide group, an alkoxycarbonylamino group, an aryloxycarbonylamino group, a ureido group, a sulfonamide group, a sulfamoylamino group, an imido group, an alkylthio group, an arylthio group, a heterocyclic thio group, a sulfinyl group, a sulfo group, an alkanesulfonyl group, an arylsulfonyl group, a sulfamoyl group, and a phosphonyl group.

The compound represented by formula (M-I) may form a dimer or a higher polymer via substituents $R_1$, $R_2$, $R_3$ and X.

The preferred scope of the compound represented by formula (M-I) is described below.

In formula (Q-1), $R_4$ preferably represents an alkyl group. $R_5$ and $R_6$ each preferably represents an alkyl group, a cycloalkyl group, an aryl group, a hydroxyl group, an alkoxy group, an aryloxy group, an amino group, an anilino group, a carbonamide group, a ureido group, a sulfonamide group, a sulfamoylamino group, an imido group, an alkylthio group or an arylthio group, more preferably an alkyl group, a cycloalkyl group or an aryl group, and most preferably an alkyl group.

In formula (Q-2), $R_7$ preferably represents an alkyl group, a cycloalkyl group or an aryl group, and more preferably a secondary or tertiary alkyl group or a cycloalkyl group. $R_8$ preferably represents an alkyl group, a cycloalkyl group or an aryl group, and more preferably an alkyl group or a cycloalkyl group.

In formula (Q-3), $R_9$ and $R_{10}$ each preferably represents a halogen atom, an alkyl group, a cycloalkyl group, an aryl group, an alkoxy group, an aryloxy group, an acyl group, an alkoxycarbonyl group, a cycloalkyloxycarbonyl group, an aryloxycarbonyl group, a carbamoyl group, an amino group, an anilino group, a carbonamido group, an alkoxycarbonylamino group, an aryloxycarbonylamino group, a ureido group, a sulfonamido group, a sulfamoyl group, an imido group, an alkylthio group, an arylthio group, a heterocyclic thio group, a sulfinyl group, an alkanesulfonyl group, an arylsulfonyl group, a sulfamoyl group or a phosphonyl group, more preferably a halogen atom, an alkyl group, a cycloalkyl group, an aryl group, an alkoxy group, an aryloxy group, an amino group, an anilino group, a carbonamido group, a ureido group, a sulfonamido group, a sulfamoylamino group, an alkylthio group or an arylthio group, and most preferably an alkyl group, a cycloalkyl group, an aryl group, an alkoxy group, an aryloxy group, an alkylthio group or an arylthio group. m preferably represents from 0 to 3, and more preferably 1 or 2. The position of substitution of $R_9$ is more preferably ortho position of a phenyl group.

$R_1$ is more preferably a group represented by formula (Q-1) or (Q-3), still more preferably a group represented by formula (Q-1), still yet more preferably all of $R_4$, $R_5$ and $R_6$ of the group represented by formula (Q-1) represent an alkyl group, and most preferably $R_1$ represents a t-butyl group. Preferred specific examples of the groups represented by $R_1$ are shown below, but the present invention is not limited thereto.

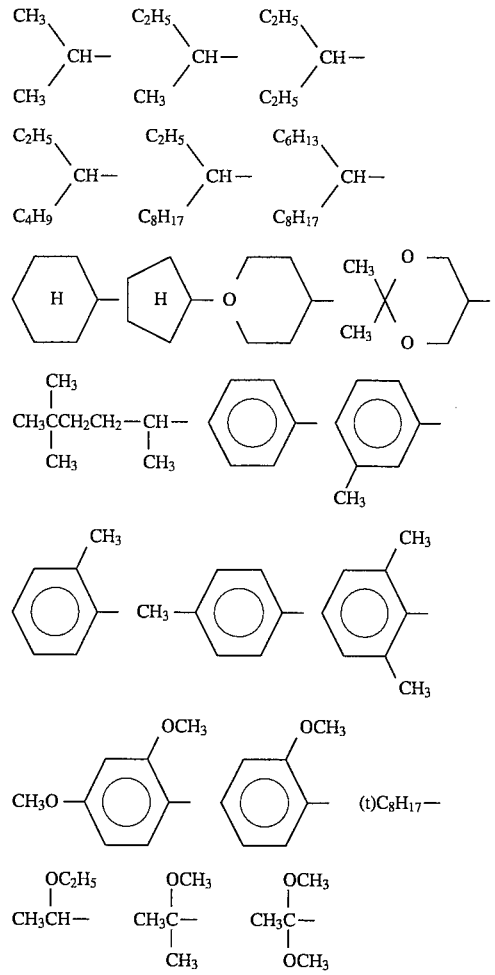

-continued

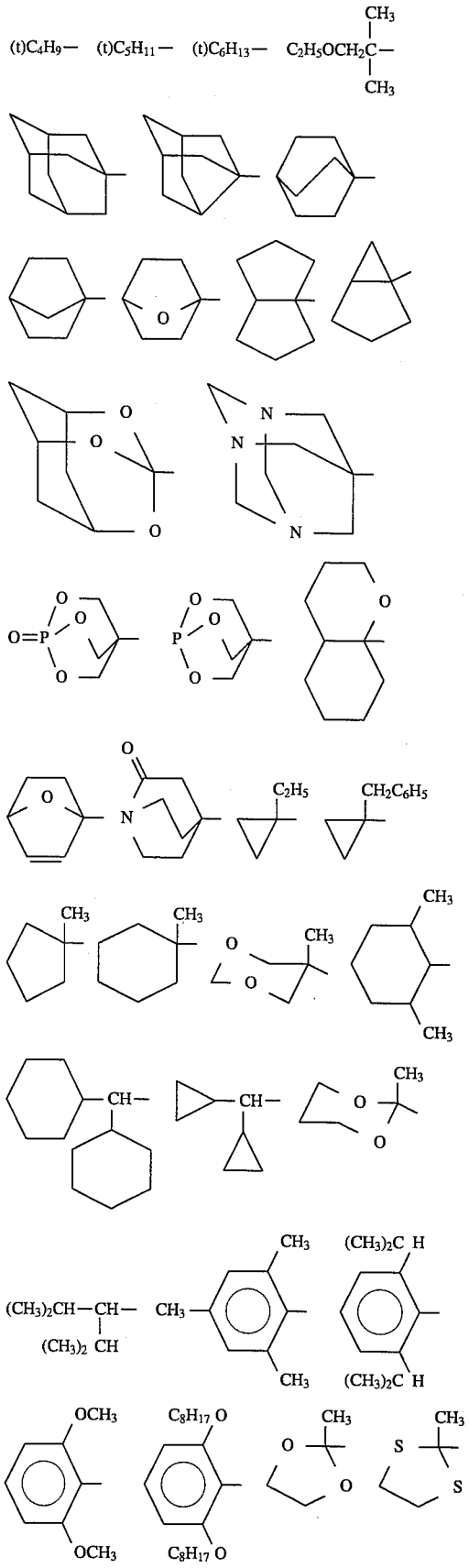

-continued

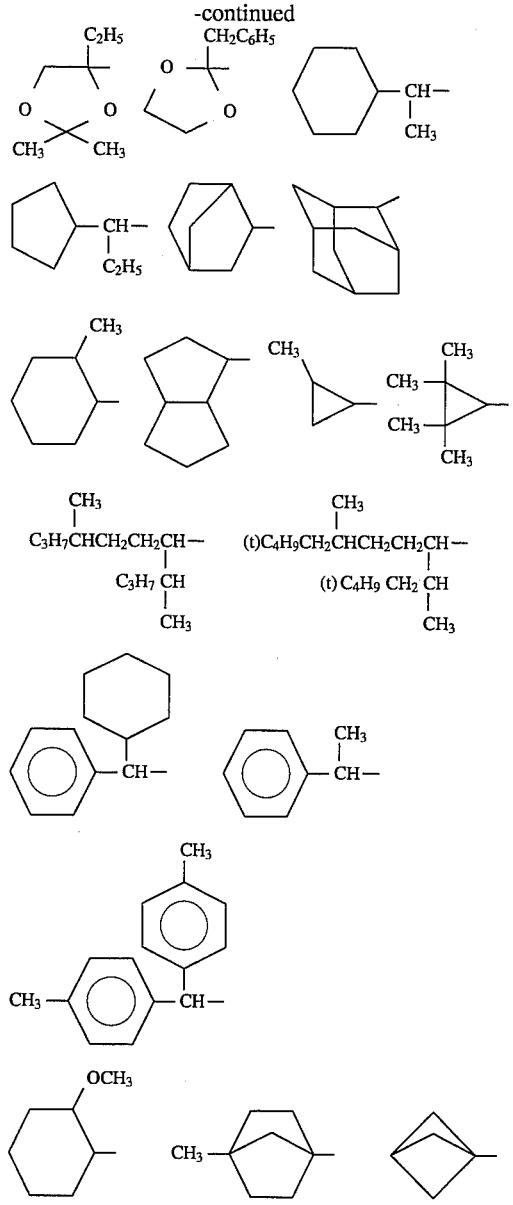

$R_2$ preferably represents an alkoxy group, an aryloxy group, an acyloxy group, an alkoxycarbonyloxy group, a cycloalkoxycarbonyloxy group, an aryloxycarbonyloxy group, a carbamoyloxy group, a sulfamoyloxy group, an alkanesulfonyloxy group, an arylsulfonyloxy group, an acyl group, an alkoxycarbonyl group, a cycloalkyloxycarbonyl group, an aryloxycarbonyl group, a carbamoyl group, an amino group, an anilino group, a carbonamido group, an alkoxycarbonylamino group, an aryloxycarbonylamino group, a ureido group, a sulfonamido group, a sulfamoylamino group, an imido group, an alkylthio group, an arylthio group, a heterocyclic thio group, an alkanesulfonyl group, an arenesulfonyl group, or a sulfamoyl group.

More preferably, $R_2$ represents an alkoxy group, an aryloxy group, an acyl group, an alkoxycarbonyl group, a cycloalkoxycarbonyl group, an aryloxycarbonyl group, a carbamoyl group, an amino group, an anilino group, a carbonamido group, an alkoxycarbonylamino group, an aryloxycarbonylamino group, a ureido group, a sulfonamido group, a sulfamoylamino group, an imido group, an alkylthio group, an arylthio group, a sulfamoyl group or a group represented by —N($R_{14}$)—A—$R_{13}$ in which A, $R_{13}$ and $R_{14}$ are defined later. The position of substitution of $R_2$ is preferably at the meta-position or para-position, and more preferably the para-position, to the carbon atom that is bonded to a pyrazolotriazole ring.

$R_3$ preferably represents a fluorine atom, a chlorine atom, a bromine atom, an alkyl group, a cycloalkyl group, an aryl group, a heterocyclic group, a cyano group, a hydroxyl group, a nitro group, an alkoxy group, an aryloxy group, a carboxyl group, an acyl group, an alkoxycarbonyl group, a cycloalkoxycarbonyl group, an aryloxycarbonyl group, a carbamoyl group, an amino group, an anilino group, a carbonamido group, an alkoxycarbonylamino group, an aryloxycarbonylamino group, a ureido group, a sulfonamido group, a sulfamoylamino group, an imido group, an alkylthio group, an arylthio group, a heterocyclic thio group, a sulfinyl group, a sulfo group, an alkanesulfonyl group, an arenesulfonyl group, a sulfamoyl group, or a phosphonyl group. n preferably represents from 0 to 3, and more preferably 0 or 1.

X preferably represents a hydrogen atom, a chlorine atom, a bromine atom, an aryloxy group, an alkylthio group, an arylthio group, a heterocyclic thio group, or a heterocyclic group, more preferably a chlorine atom or an aryloxy group, and most preferably a chlorine atom. The preferred specific examples of the groups represented by X are shown below, but the present invention is not limited thereto.

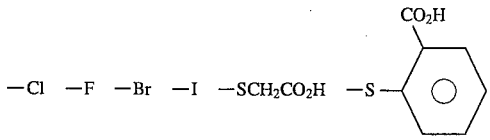

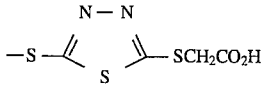

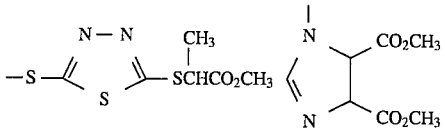

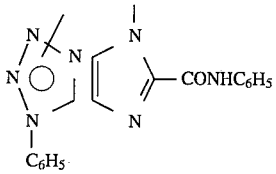

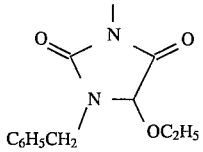

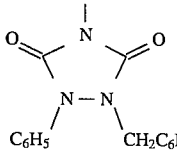

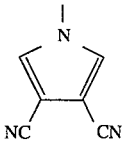

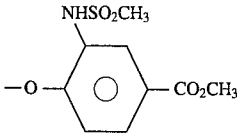

-continued

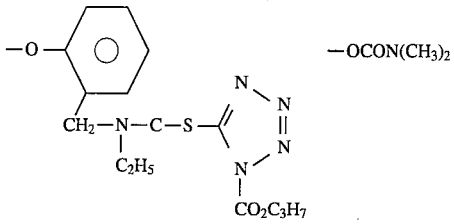

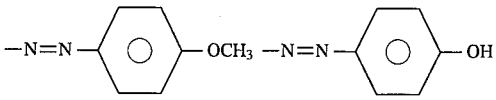

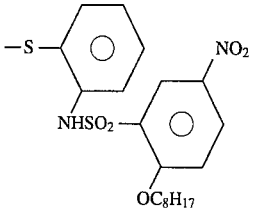

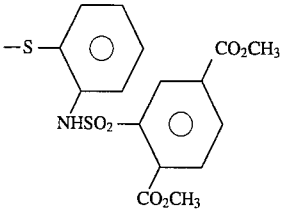

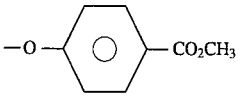

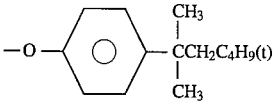

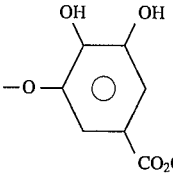

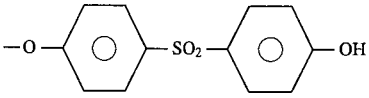

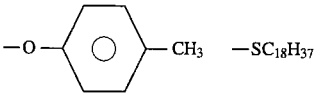

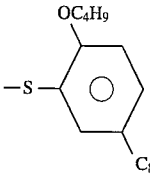

-continued

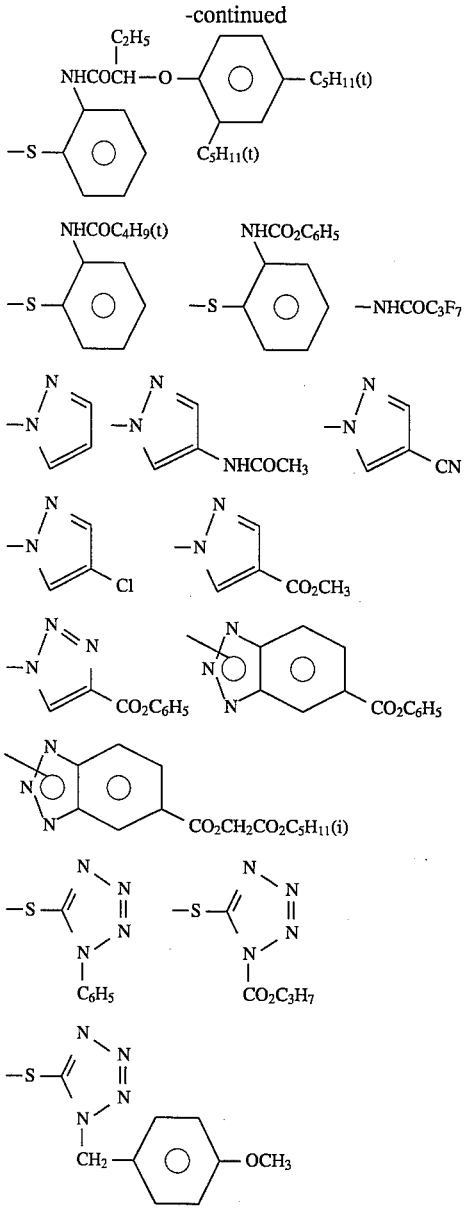

The compound represented by formula (M-I) is preferably represented by formula (M-II) and more preferably represented by formula (M-III) from the point of the effect of the present invention.

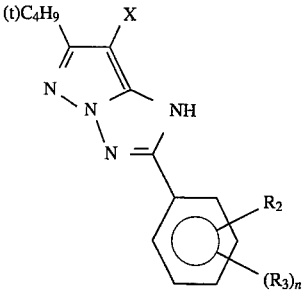

(M-II)

wherein $R_2$, $R_3$, n and X have the same meaning as $R_2$, $R_3$, n and X in formula (M-I).

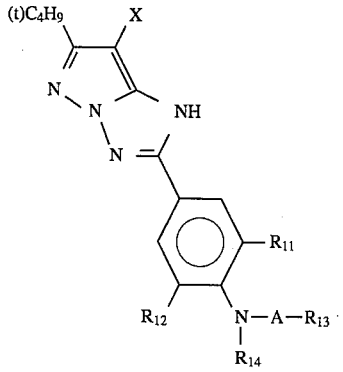

(M-III)

wherein $R_{11}$ and $R_{12}$ each represents a hydrogen atom or a substituent; A represents —CO— or —$SO_2$—; $R_{13}$ represents an alkyl group, an aryl group, an alkoxy group, an alkylamino group or an anilino group; $R_{14}$ represents a hydrogen atom, an alkyl group, an aryl group, an acyl group, an alkanesulfonyl group, or an arylsulfonyl group; and X represents a hydrogen atom or a group capable of being eliminated on coupling reaction with an oxidized product of a developing agent. $R_{13}$ and $R_{14}$ may be bonded each other to form a 5- to 7-membered ring having the same meaning as described in the definition for the formula (Q-1).

In formula (M-III), $R_{11}$ and $R_{12}$ preferably represent a hydrogen atom, a fluorine atom, a chlorine atom, a bromine atom, an alkyl group, a cycloalkyl group, an aryl group, a heterocyclic group, a cyano group, a hydroxyl group, a nitro group, an alkoxy group, an aryloxy group, a carboxyl group, an acyl group, an alkoxycarbonyl group, a cycloalkyloxycarbonyl group, an aryloxycarbonyl group, a carbamoyl group, an amino group, an anilino group, a carbonamide group, an alkoxycarbonylamino group, an aryloxycarbonylamino group, a ureido group, a sulfonamido group, a sulfamoylamino group, an imido group, an alkylthio group, an arylthio group, a heterocyclic thio group, a sulfinyl group, a sulfo group, an alkanesulfonyl group, an arylsulfonyl group, a sulfamoyl group or a phosphonyl group; $R_{13}$ preferably represents an alkyl group or an aryl group; $R_{14}$ preferably represents a hydrogen atom or an alkyl group; A more preferably represents —CO—; X preferably represents a hydrogen atom, a chlorine atom, a bromine atom, an aryloxy group, an alkylthio group, an arylthio group, a heterocyclic thio group, or a heterocyclic group, more preferably a chlorine atom or an aryloxy group, and most preferably a chlorine atom.

Specific examples of the pyrazolotriazole magenta couplers represented by formula (M-I) which can be used in the present invention are shown below, but the present invention is not limited thereto.

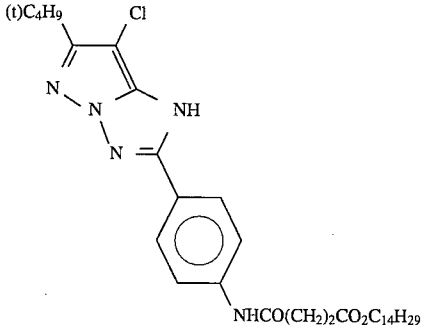
M-1
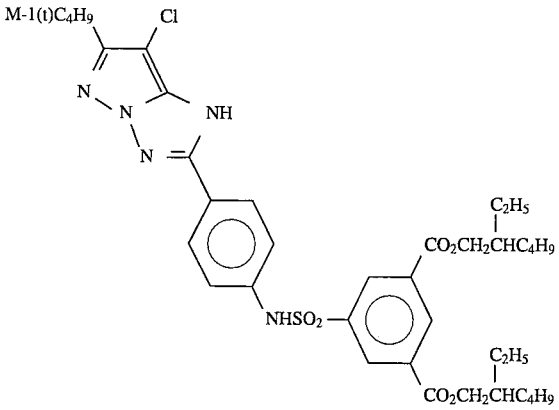
M-2
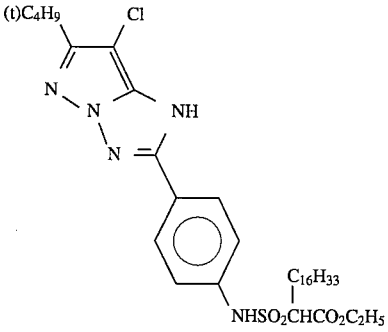
M-3
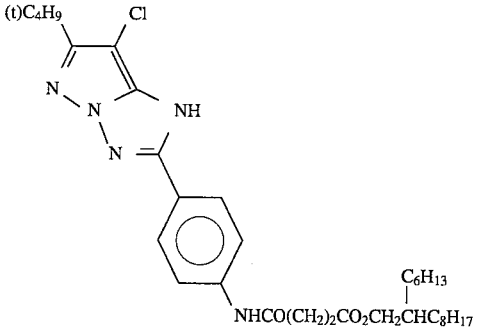
M-4
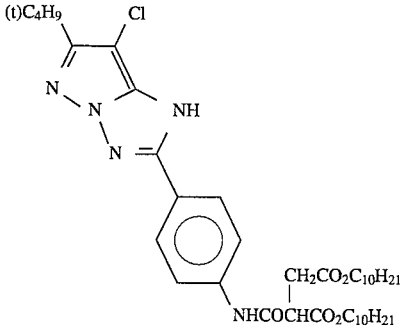
M-5
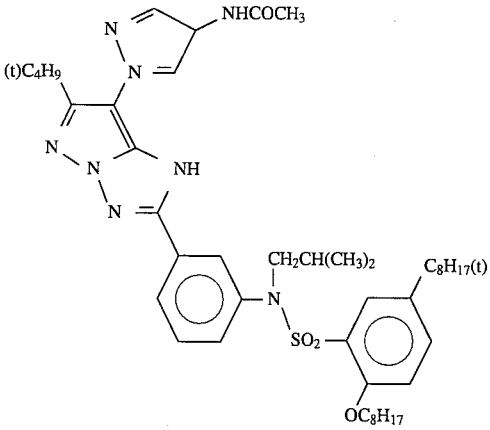
M-6
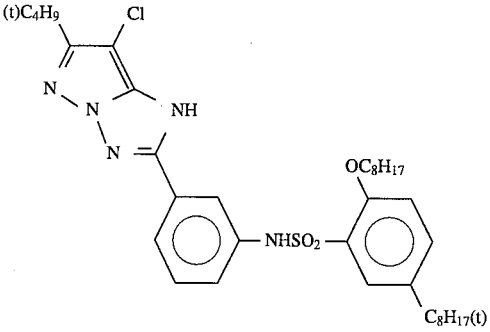
M-7
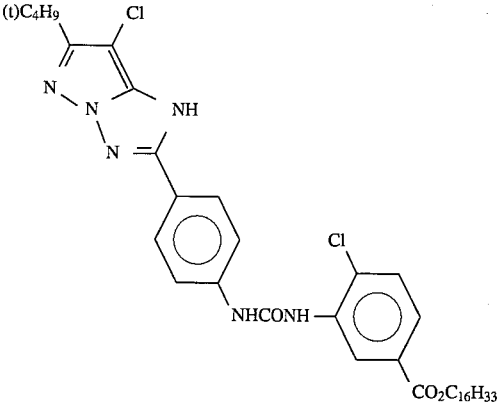
M-8

-continued
M-9
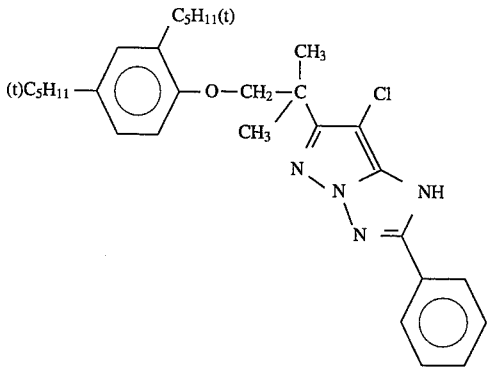
M-10
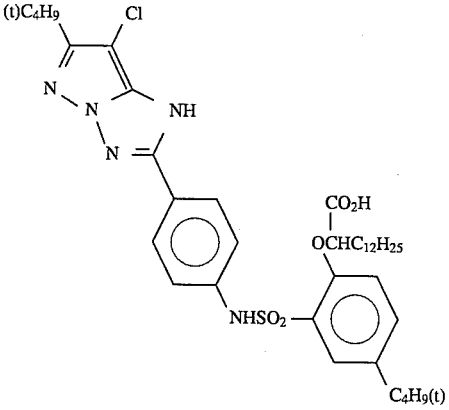
M-11
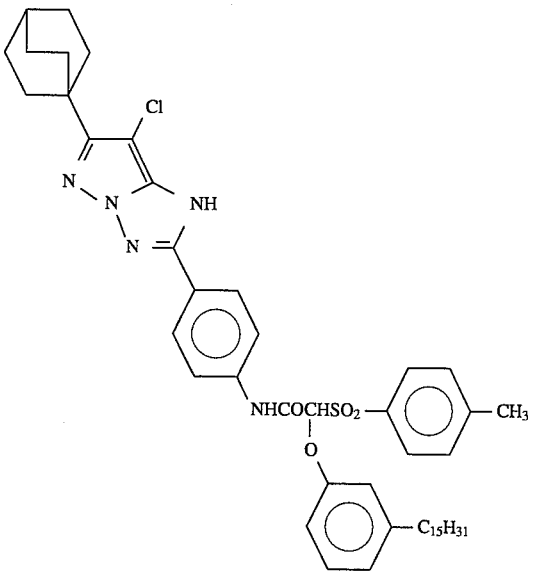
M-12
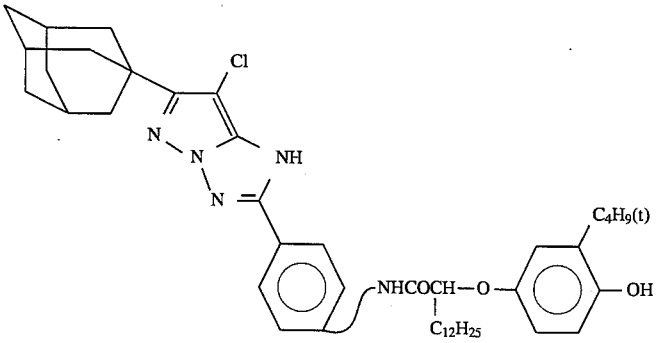

-continued
M-13
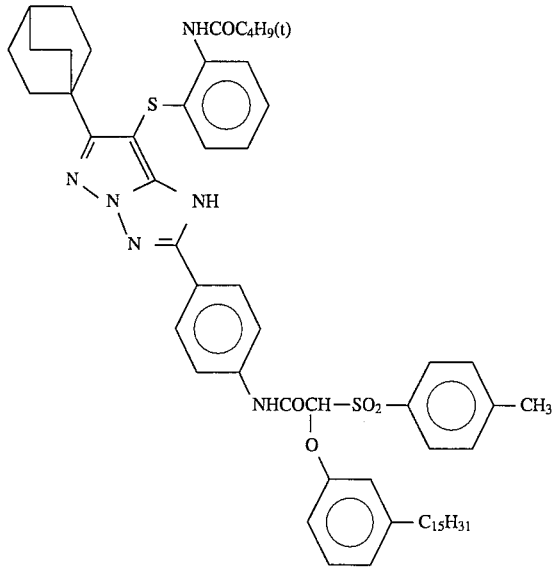
M-14
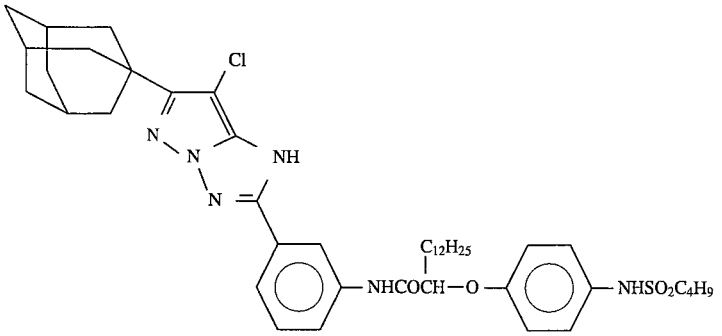
M-15
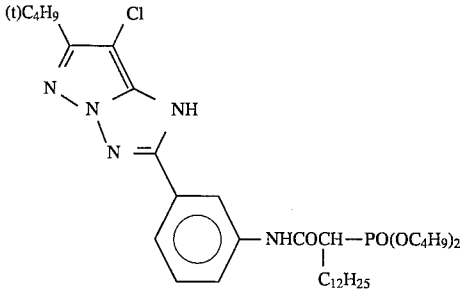
M-16
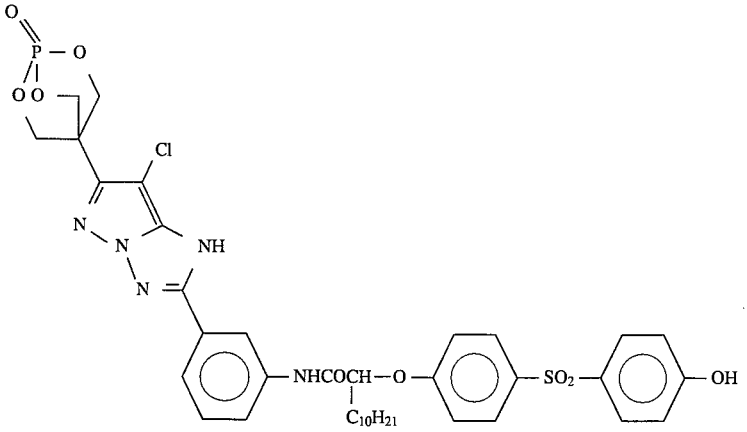

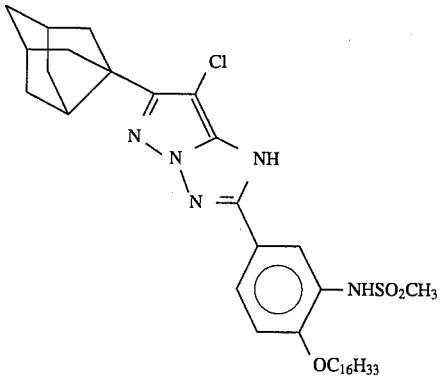
-continued
M-17(t)C4H9
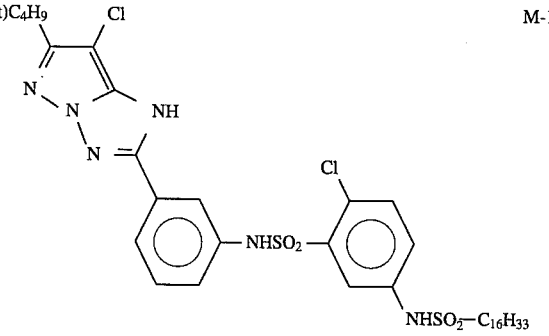
M-18
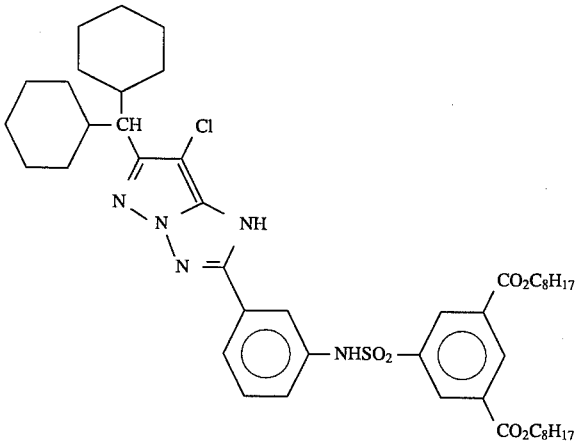
M-19
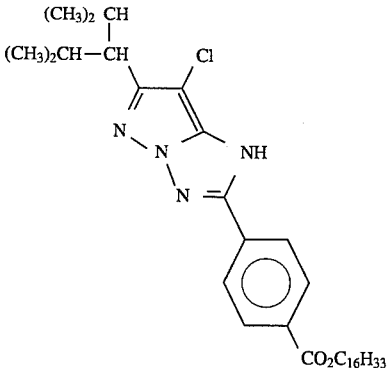
M-20
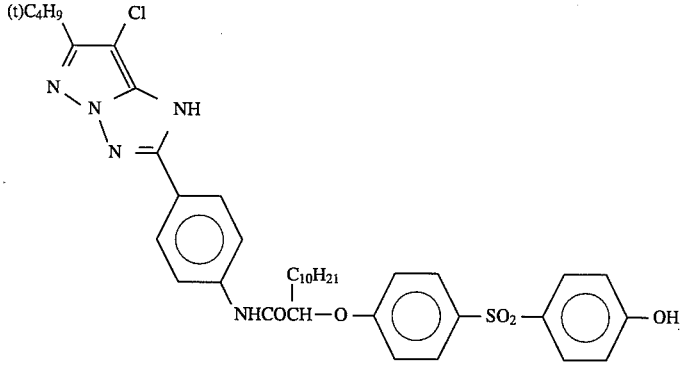
M-21

-continued
M-22
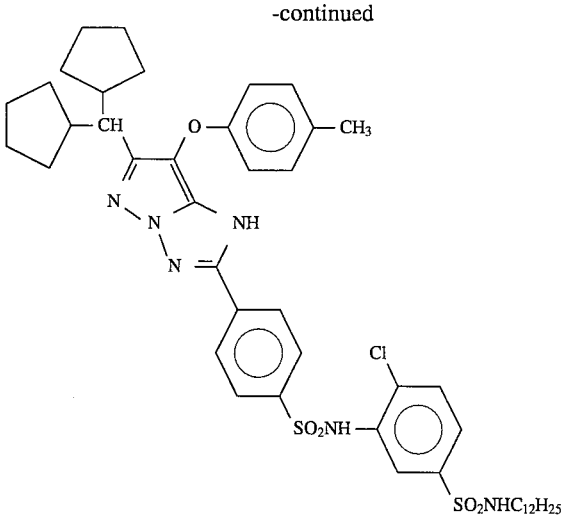
M-23
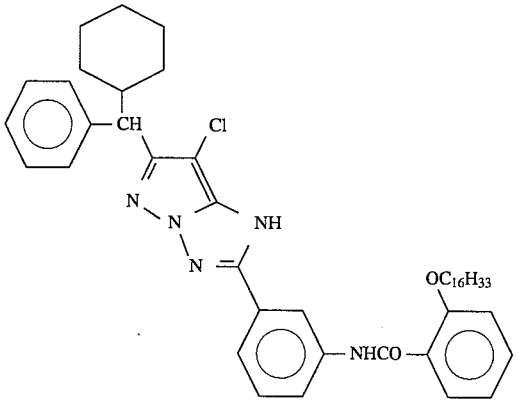
M-24
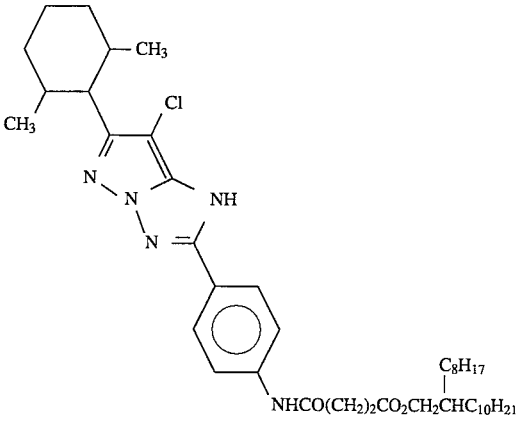
M-25
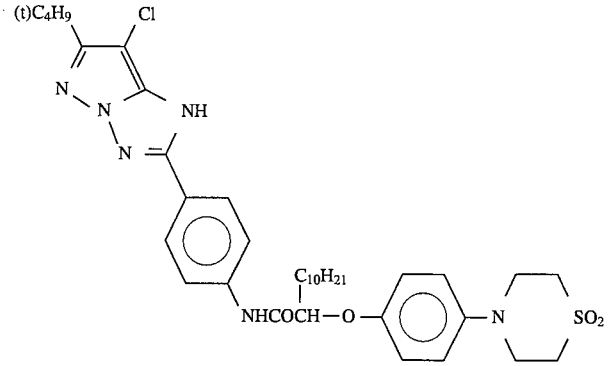

-continued
M-26
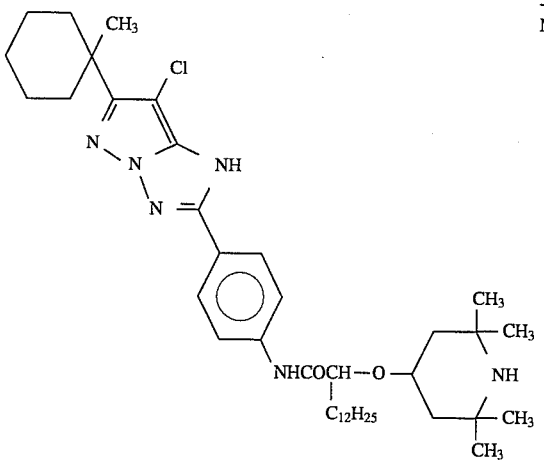
M-27
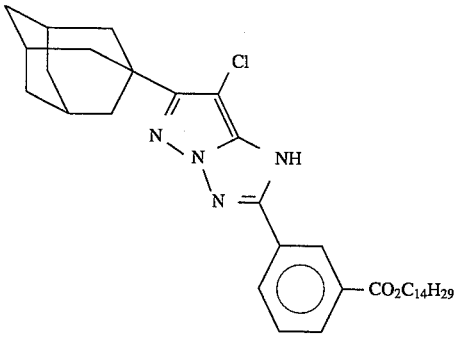
M-28
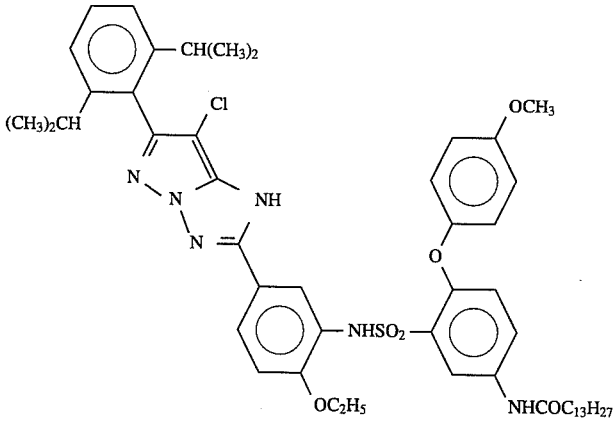
M-29
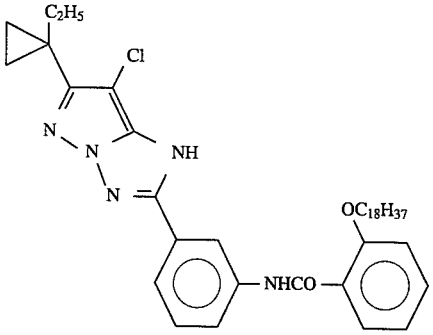

-continued
M-30
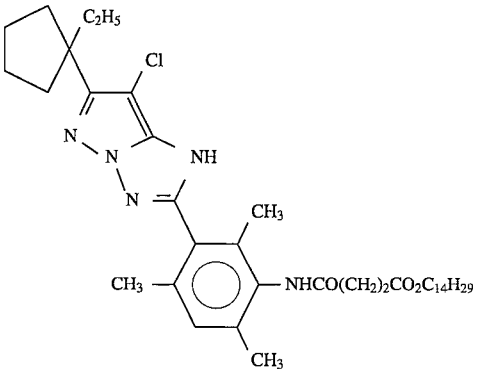
M-31
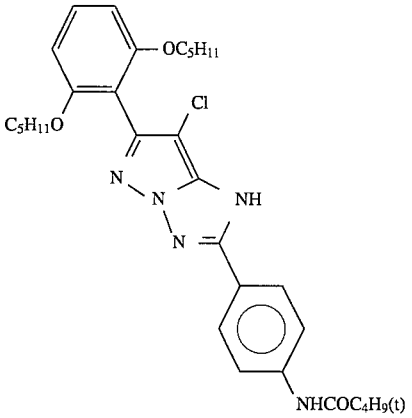
M-32
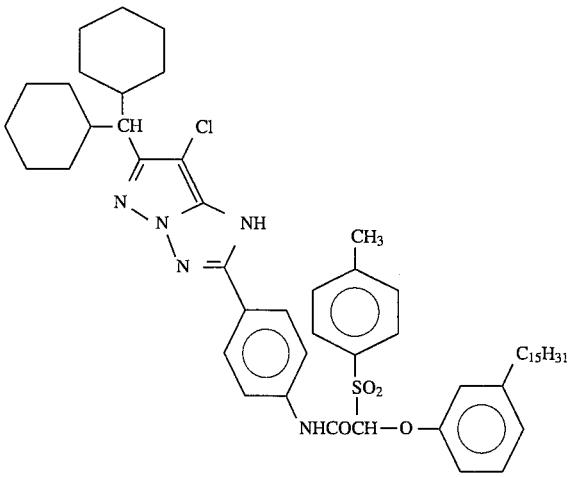
M-33
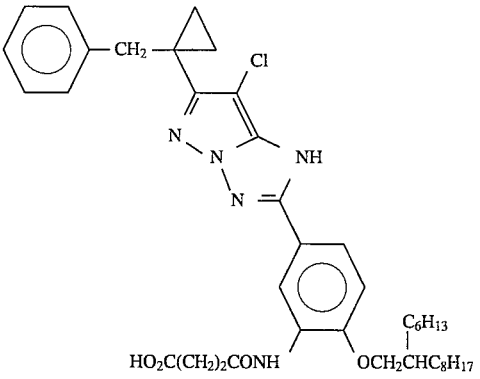

-continued
M-34
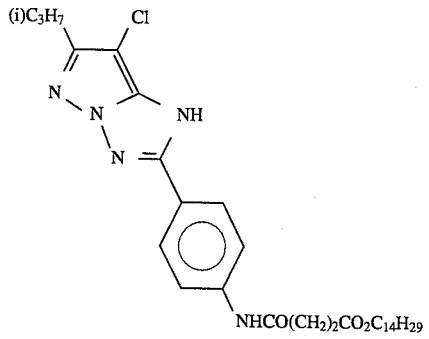
M-35
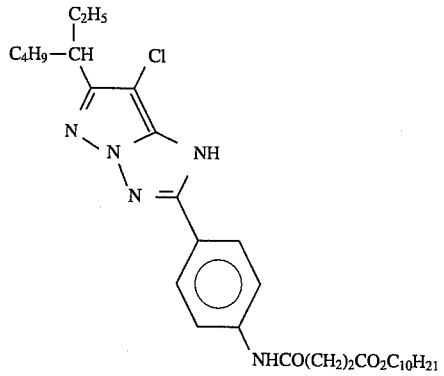
M-36
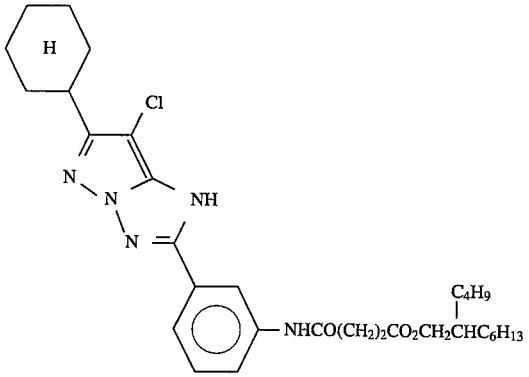
M-37
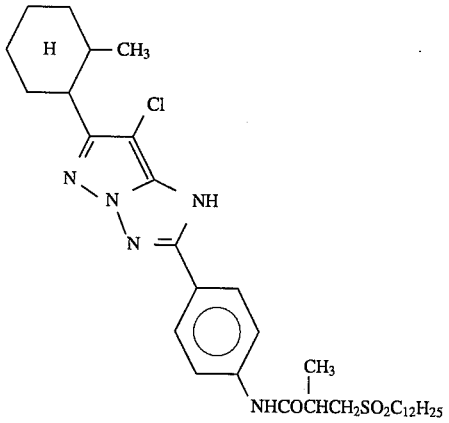
M-38
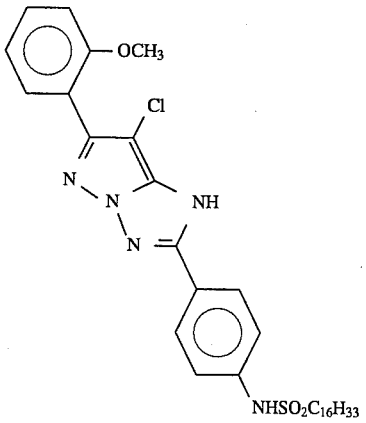

-continued
M-39
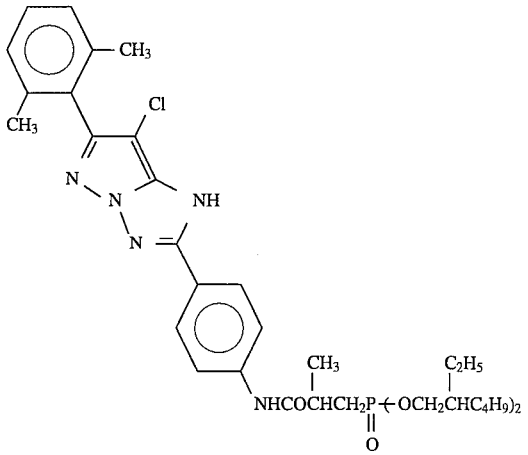
M-40
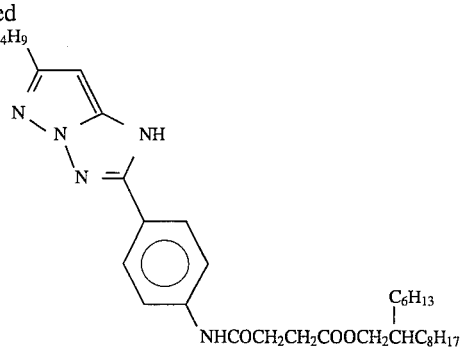
M-41
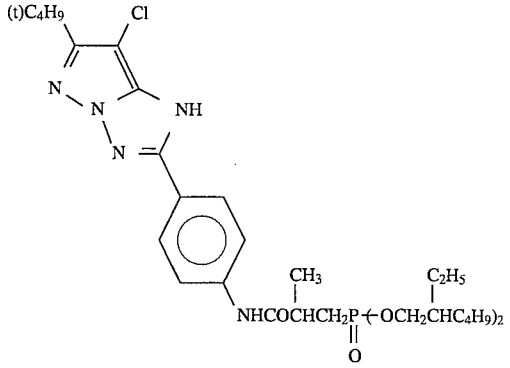
M-42
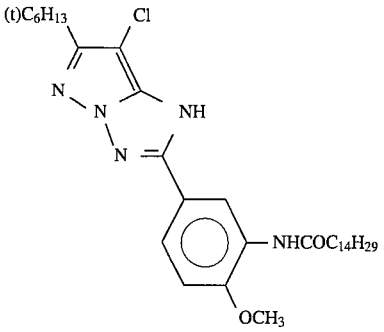
M-43
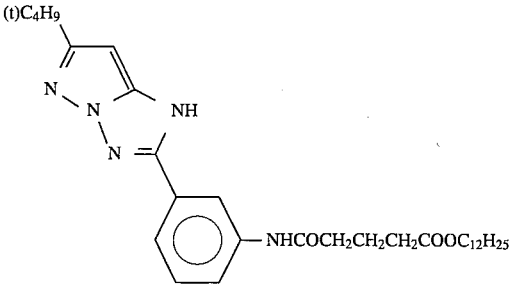
M-44
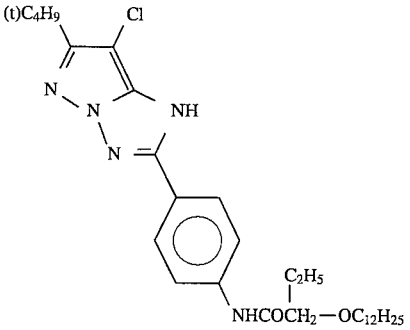
M-45
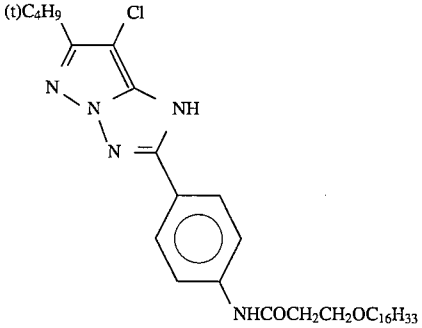
M-46
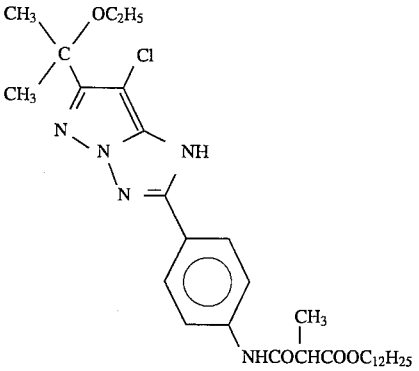

-continued

M-47

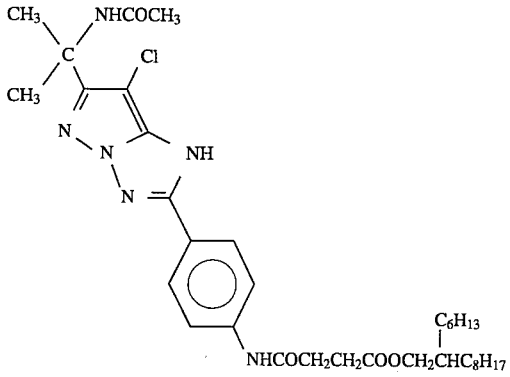

M-48

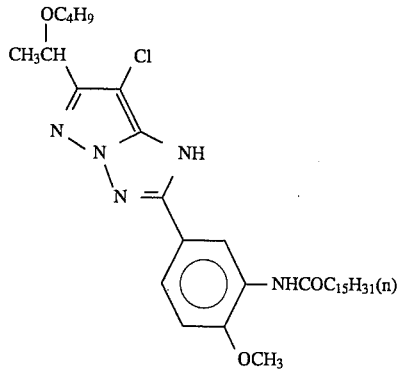

M-49

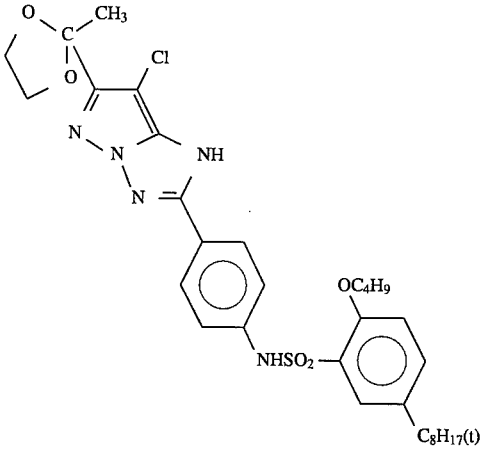

M-50

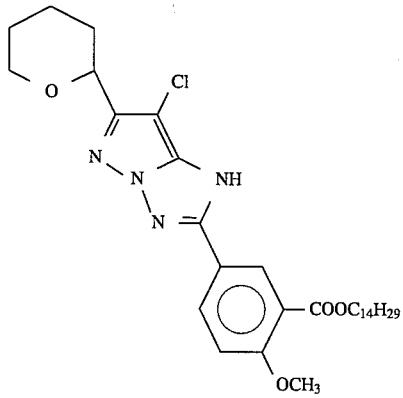

M-51

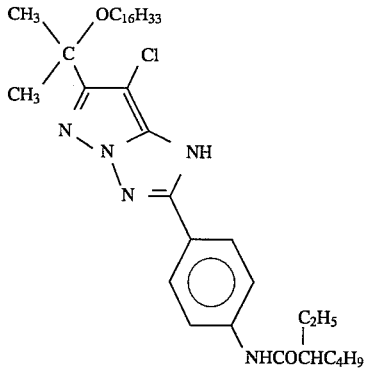

High boiling point organic solvents for use in the present invention are described in detail below.

Any high boiling point organic solvent having a dielectric constant of 6.0 or less and a refractive index of 1.50 or less can be used in the present invention, but preferably having a solubility in water of 1% or less. A dielectric constant of preferably 5.5 or less, more preferably 3.0 or more and 5.0 or less, is preferred from the point of shifting the absorption wavelength to a short wavelength range.

A high boiling point organic solvent having a refractive index of 1.48 or less is preferred from the point of shifting the absorption wavelength of a dye formed from a magenta coupler to a short wavelength side.

A refractive index of 1.40 or more is preferred for improving film turbidity.

Any high boiling point organic solvent which is liquid, pasty or solid at normal temperature may be used, but when it is in the form of a solid at normal temperature, it has a melting point of 150° C. or less, preferably 100° C. or less.

Two or more kinds of high boiling point organic solvents can be mixed and used in the present invention. In such a case, any high boiling point organic solvent may be used as long as the weighted mean dielectric constant and refractive index to the weight composition are in the prescribed range. Dielectric constant in the case when a high boiling point organic solvent is solid at normal temperature means a value measured with the solid being once melted and being maintained under a supercooling condition.

There is no limitation on the structures of the solvents provided that the above conditions are satisfied and specific examples of high boiling point organic solvents which are preferably used include phosphates, phosphonates, benzoates, phthalates, fatty acid esters, carbonates, amides, ethers, halogenated hydrocarbons, alcohols, and paraffins. Phosphates, phosphonates, phthalates, benzoates, and fatty acid esters are particularly preferred of them.

Specific examples of high boiling point organic solvents which are used in the present invention are shown below, but the present invention is not limited thereto.

| | High Boiling Point Organic Solvent | Dielectric Constant | Refractive Index |
|---|---|---|---|
| S-1 | $P(=O)(OC_6H_{13})_3$ | 5.86 | 1.433 |
| S-2 | $P(=O)(OCH_2CH(C_2H_5)C_4H_9)_3$ | 4.80 | 1.442 |
| S-3 | $P(=O)(OC_8H_{17})_3$ | 4.95 | 1.441 |
| S-4 | $P(=O)(OCH_2CH_2CH(CH_3)CH_2C(CH_3)_3)_3$ | 4.46 | 1.447 |
| S-5 | $P(=O)(OC_{12}H_{25})_3$ | 3.87 | 1.451 |
| S-6 | $P(=O)(OC_4H_9)(OCH_2CH(C_2H_5)C_4H_9)_2$ | 5.65 | 1.440 |
| S-7 | $C_8H_{17}P(=O)(OC_8H_{17})_2$ | 4.16 | 1.448 |
| S-8 | $C_6H_4(COOC_5H_{11})_2$ | 5.91 | 1.448 |
| S-9 | $C_6H_4(COOCH_2CH(C_2H_5)C_4H_9)(COOCH_2CH(C_2H_5)C_4H_9)$ | 5.18 | 1.485 |
| S-10 | $C_6H_4(COOC_9H_{19}(iso))_2$ | 4.62 | 1.481 |
| S-11 | $C_6H_5COOC_{12}H_{25}$ | 3.92 | 1.483 |
| S-12 | $(CH_2)_8(COOC_4H_9)_2$ | 4.47 | 1.439 |
| S-13 | $(CH_2)_8(COOCH_2CH(C_2H_5)C_4H_9)_2$ | 3.96 | 1.449 |

-continued
| | High Boiling Point Organic Solvent | Dielectric Constant | Refractive Index |
|---|---|---|---|
| S-14 | 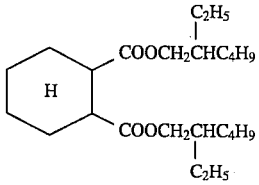 | 4.43 | 1.461 |
| S-15 | 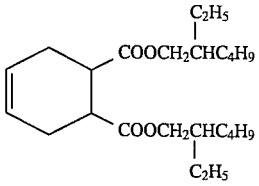 | 4.34 | 1.465 |
| S-16 | 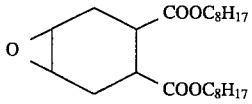 | 5.37 | 1.465 |
| S-17 | 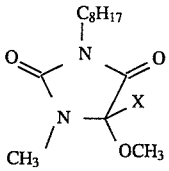 | 4.16 | 1.464 |
| S-18 | $CH_2-OCOCH(C_2H_5)C_4H_9$<br>$CH_2-OCOCH(C_2H_5)C_4H_9$<br>$CH_2-OCOCH(C_2H_5)C_4H_9$ | 4.28 | 1.444 |
| S-19 | 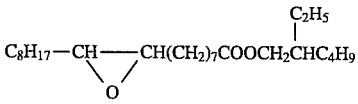 | 4.85 | 1.454 |
| S-20 | 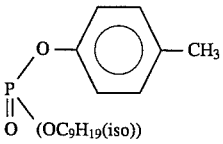 | 5.23 | 1.456 |
| S-21 | 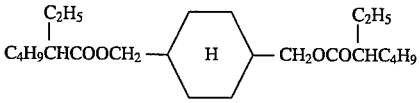 | 3.84 | 1.455 |
| S-22 | 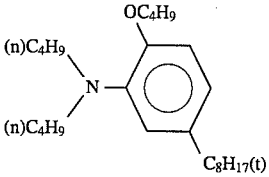 | 2.76 | 1.490 |
| S-23 | 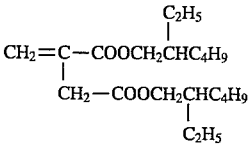 | 4.63 | 1.450 |
| S-24 | $C_8H_{17}O-C(=O)-OC_8H_{17}$ | 2.38 | 1.439 |

-continued

| | High Boiling Point Organic Solvent | Dielectric Constant | Refractive Index |
|---|---|---|---|
| S-25 | $P(=O)(OC_{12}H_{25})_3$ | 3.49 | 1.455 |
| S-26 | $CH_2COOC_4H_9$<br>\|<br>$CH-COOC_4H_9$<br>\|<br>$CH_2-COOC_4H_9$ | 5.19 | 1.433 |
| S-27 | $(CH_2)_4(COOCH_2CH(C_2H_5)C_4H_9)_2$ | 4.23 | 1.447 |
| S-28 | $C_{13}H_{27}COOCH_2CH(C_6H_{13})C_8H_{17}$ | 2.89 | 1.453 |
| S-29 | $CH_3CH(OH)COOC_{18}H_{37}$(iso) | 4.48 | 1.449 |

Benzotriazole based ultraviolet absorbers for use in the present invention are described in detail below. Any benzotriazole based ultraviolet absorbers can be used in the present invention but 2-(2'-hydroxyphenyl)benzotriazole based compounds represented by the following formula (IV) are preferred above all.

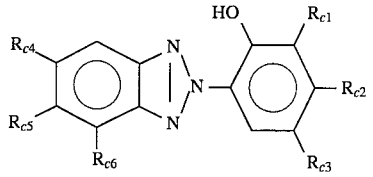

(IV)

wherein $R_{c1}$, $R_{c2}$, $R_{c3}$, $R_{c4}$, $R_{c5}$ and $R_{c6}$, which may be the same or different, each represents a hydrogen atom, a halogen atom, a nitro group, a hydroxyl group, an alkyl group, an alkoxy group, an aryl group, an aryloxy group, an acylamino group, a carbamoyl group, or a sulfo group; and $R_{c5}$ and $R_{c6}$ may be linked each other to form a 6-membered ring.

The atoms or substituents represented by $R_{c1}$, $R_{c2}$, $R_{c3}$, $R_{c4}$, $R_{c5}$ and $R_{c6}$ in the ultraviolet absorbers represented by the above formula (IV) are explained in detail, for example, in JP-A-58-221844, JP-A-59-46646, JP-A-59-109055 (the term "JP-A" as used herein means a "published unexamined Japanese patent application"), JP-B-36-10466, JP-B-42-26187, JP-B-48-5496, JP-B-48-41572 (the term "JP-B" as used herein means an "examined Japanese patent publication"), and U.S. Pat. Nos. 3,754,919 and 4,220,711.

The benzotriazole based ultraviolet absorbers for use in the present invention may be either a single compound or a mixed compound.

Specific examples of the ultraviolet absorbers which are preferably used in the present invention are shown below, but the ultraviolet absorbers which can be used in the present invention are not limited thereto.

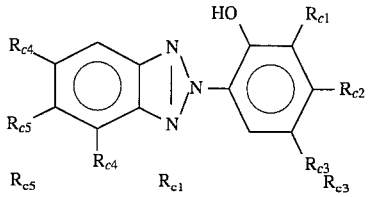

$R_{c2}$, $R_{c4}$, $R_{c6}$ = H

| UV No. | $R_{c5}$ | $R_{c1}$ | $R_{c3}$ |
|---|---|---|---|
| I-a | H | $CH_3$ | $C_4H_9$(s) |
| I-b | H | $C_4H_9$(t) | $C_2H_4COOC_8H_{17}$(n) |
| I-c | H | $C_4H_9$(t) | $C_2H_4COOCH_2CH(C_2H_5)C_4H_9$(n) |
| I-d | H | $C_4H_9$(t) | $C_2H_4COOC_2H_4OC_4H_9$(n) |
| I-e | H | $C_8H_{17}$(n) | $CH_3$ |
| I-f | H | $C_{10}H_{21}$(n) | $CH_3$ |
| I-g | H | $C_{12}H_{25}$(n) | $CH_3$ |
| I-h | H | $C_{16}H_{33}$(n) | $CH_3$ |
| I-i | H | $C_{20}H_{41}$(n) | $CH_3$ |
| I-j | H | $C_{25}H_{45}$(n) | $CH_3$ |
| I-k | H | $C_{24}H_{49}$(n) | $CH_3$ |
| I-l | $C_4H_9$(n) | $C_4H_9$(s) | $C_4H_9$(s) |

-continued

| | | | |
|---|---|---|---|
| I-m | $C_4H_9$(n) | $C_4H_9$(s) | $C_4H_9$(t) |
| I-n | $C_4H_9$(n) | $C_4H_9$(s) | $C_5H_{11}$(t) |
| I-o | $C_4H_9$(s) | $C_4H_9$(t) | $C_4H_9$(t) |
| I-p | $C_4H_9$(s) | $C_4H_9$(t) | $C_5H_{11}$(t) |
| I-q | $C_4H_9$(s) | $C_5H_{11}$(t) | $C_5H_{11}$(t) |
| I-r | $C_4H_9$(t) | $C_4H_9$(s) | $C_4H_9$(s) |
| I-s | $C_4H_9$(t) | $C_4H_9$(s) | $C_4H_9$(t) |
| I-t | $C_4H_9$(t) | $C_4H_9$(s) | $C_5H_{11}$(t) |
| I-u | $C_5H_{11}$(n) | $C_4H_9$(s) | $C_4H_9$(t) |
| I-v | $C_5H_{11}$(t) | $C_4H_9$(s) | $C_4H_9$(t) |
| I-w | Cl | $C_4H_9$(s) | $C_4H_9$(s) |
| I-x | Cl | $C_4H_9$(t) | $C_2H_4COOCH_2CH(C_2H_5)C_4H_9$(n) |
| I-y | $OCH_3$ | $C_4H_9$(s) | $C_4H_9$(s) |

$R_{c6}$ = H

| UV No. | $R_{c4}$ | $R_{c5}$ | $R_{c1}$ | $R_{c2}$ | $R_{c3}$ |
|---|---|---|---|---|---|
| III-1 | H | H | H | H | H |
| III-2 | H | H | H | H | $CH_3$ |
| III-3 | H | H | H | H | $C_4H_9$(t) |
| III-4 | H | H | H | H | $C_5H_{11}$(sec) |
| III-5 | H | H | H | H | $C_5H_{11}$(t) |
| III-6 | H | H | H | H | $C_6H_5$ |
| III-7 | H | H | H | H | $C_5H_{11}$ |
| III-8 | H | H | H | H | $C_8H_{17}$(n) |
| III-9 | H | H | H | H | $C_8H_{17}$(i) |
| III-10 | H | H | H | H | $C_8H_{17}$(t) |
| III-11 | H | H | H | H | $C_{12}H_{25}$(n) |
| III-12 | H | H | H | H | $C_{12}H_{25}$(n) |
| III-13 | H | H | H | H | $OCH_3$ |
| III-14 | H | H | H | H | $C_2H_4COOC_8H_{17}$ |
| III-15 | H | H | H | H | $CONHC_{12}H_{25}$(n) |
| III-16 | H | H | $CH_3$ | H | $C_4H_9$(t) |
| III-17 | H | H | $C_4H_9$(sec) | H | $C_4H_9$(sec) |
| III-18 | H | H | $C_4H_9$(sec) | H | $C_4H_9$(t) |
| III-19 | H | H | $C_4H_9$(t) | H | $C_4H_9$(sec) |
| III-20 | H | H | $C_4H_9$(t) | H | $C_4H_9$(t) |
| III-21 | H | H | $C_4H_9$(t) | H | $C_{12}H_{25}$(sec) |
| III-22 | H | H | $C_5H_{11}$(t) | H | $C_5H_{11}$(t) |
| III-23 | H | H | $C_5H_{11}$(t) | H | $C_6H_5$ |
| III-24 | H | H | $C_5H_{11}$(t) | H | $CH_2C_6H_5$ |
| III-25 | H | H | Cl | H | Cl |
| III-26 | H | H | $CH_2NHCOOC_5H_{11}$(n) | H | H |
| III-27 | H | Cl | H | H | $C_5H_{11}$(t) |
| III-28 | H | Cl | H | H | $C_6H_5$ |
| III-29 | H | Cl | H | H | $C_5H_{11}$ |
| III-30 | H | Cl | H | H | $C_2H_4COOC_8H_{17}$ |
| III-31 | H | Cl | H | H | Cl |
| III-32 | H | Cl | $C_4H_9$(sec) | H | $C_4H_9$(t) |
| III-33 | H | Cl | $C_4H_9$(t) | H | $CH_3$ |
| III-34 | H | Cl | $C_4H_9$(t) | H | $CH_2CH{=}CH_2$ |
| III-35 | H | Cl | $C_4H_9$(t) | H | $C_4H_9$(sec) |
| III-36 | H | Cl | $C_4H_9$(t) | H | $C_4H_9$(t) |
| III-37 | H | Cl | $C_4H_9$(t) | H | $C_5H_{11}$ |
| III-38 | H | Cl | $C_5H_{11}$(n) | H | $C_6H_5$ |
| III-39 | H | Cl | $CH_2N(C_4H_9(t))(CH_3)$ | H | H |
| III-40 | H | $SO_2C_2H_5$ | $CH_3$ | H | $CH_3$ |
| III-41 | H | $CH_3$ | H | H | $C_8H_{17}$(i) |
| III-42 | H | $CH_3$ | H | H | $OCH_3$ |
| III-43 | H | $CH_3$ | $C_4H_9$(sec) | H | $C_4H_9$(sec) |
| III-44 | H | $CH_3$ | $C_4H_9$(sec) | H | $C_4H_9$(t) |
| III-45 | H | $CH_3$ | $C_5H_{11}$(t) | H | $OC_2H_5$ |
| III-46 | H | $CH_3$ | Cl | H | $C_8H_{17}$(n) |
| III-47 | H | $C_2H_5$ | $C_3H_7$(i) | H | $C_3H_7$(i) |
| III-48 | H | $C_4H_9$(sec) | $C_4H_9$(t) | H | $C_2H_4COOC_8H_{17}$ |
| III-49 | H | $C_4H_9$(t) | $C_4H_9$(t) | H | $C_4H_9$(t) |
| III-50 | H | $C_5H_{11}$(t) | $C_5H_{11}$(t) | H | $C_5H_{11}$(t) |
| III-51 | H | $C_6H_5$ | $C_4H_9$(t) | H | $C_4H_9$(t) |
| III-52 | H | $C_6H_5$ | $C_5H_{11}$(n) | H | $C_5H_{11}$(t) |
| III-53 | H | $C_8H_{17}$(n) | H | H | $C_8H_{17}$(i) |
| III-54 | H | OH | $C_4H_9$(t) | H | $C_4H_9$(t) |
| III-55 | H | $OCH_2$ | H | H | $OC_8H_{17}$(sec) |
| III-56 | H | $OCH_2$ | $C_4H_9$(sec) | H | $C_4H_9$(t) |
| III-57 | H | $OCH_2$ | $C_5H_{11}$(t) | H | $C_5H_{11}$(t) |
| III-58 | H | $OCH_2$ | $C_5H_{11}$(t) | H | $C_2H_5$ |

-continued

| | | | | | |
|---|---|---|---|---|---|
| III-59 | H | $OCH_2$ | Cl | H | Cl |
| III-60 | H | $OC_2H_5$ | $C_4H_9$(sec) | H | $C_4H_9$(t) |
| III-61 | H | $OC_4H_9$(n) | Cl | H | $OCH_2$ |
| III-62 | H | $OC_2H_5$ | $C_5H_{11}$(t) | H | $C_5H_{11}$(t) |
| III-63 | H | $COOC_4H_9$(n) | $C_4H_9$(n) | H | $C_5H_{11}$(t) |
| III-64 | H | $NO_2$ | $C_8H_{17}$(n) | H | $OCH_3$ |
| III-65 | H | H | H | Cl | Cl |
| III-66 | H | H | H | $OC_8H_{17}$ | H |
| III-67 | H | $CH_3$ | H | $CH_3$ | $CH_3$ |
| III-68 | H | Cl | H | $C_{15}H_{31}$ | H |
| III-69 | $CH_3$ | $OC_4H_9$(n) | H | H | H |
| III-70 | $CH_3$ | $OC_9H_{16}$(n) | H | H | H |
| III-71 | $CH_3$ | $OC_{12}H_{25}$(n) | H | H | H |
| III-72 | Cl | Cl | H | H | H |
| III-73 | $OCH(CH_3)_3$ | $OCH(CH_3)_3$ | H | H | H |
| III-74 | $OCH(CH_3)_3$ | $OCH(CH_3)_3$ | H | H | $CH_3$ |
| III-75 | $OCH(CH_3)_3$ | $OC_2H_{5(CH3)3}$ | H | H | H |
| III-76 | $OC_4H_9$(n) | $OC_4H_9$(n) | H | H | H |
| III-77 | $OC_4H_9$(n) | $OC_4H_9$(n) | H | H | $OCH_3$ |

| UV No. | $R_{c4}$ | $R_{c1}$ | $R_{c3}$ |
|---|---|---|---|
| III-78 | H | H | $CH_3$ |
| III-79 | H | H | $C_8H_{17}$ |
| III-80 | H | $C_4H_9$(t) | $C_4H_9$(t) |
| III-81 | Cl | H | $C_2H_5$ |

$R_{c2}$ = H, $R_{c5}$ and $R_{c6}$ are linked each other to form a benzene ring.

The amount of the magenta coupler represented by formula (M-I) of the present invention for use in a silver halide color photographic material is preferably from 0.01 to 10 mmol/$m^2$, more preferably from 0.05 to 5 mmol/$m^2$, and most preferably from 0.1 to 2 mmol/$m^2$. Two or more couplers represented by formula (M-I) may be used in combination. The couplers represented by formula (M-I) may be used in combination with couplers other than the couplers represented by formula (M-I). In this case, the amount used of the couplers of the present invention is preferably 50 mol % or more. When the amount used of the magenta couplers of the present invention is less than 0.01 mmol/$m^2$, necessary color density is difficult to obtain, and when it exceeds 10 mmol/$m^2$ it is not desired from the economical point.

The amount used of the silver halide emulsion in the silver halide emulsion layer in which the coupler of the present invention is used is preferably from 0.5 to 50 times, more preferably from 1 to 20 times, and most preferably from 2 to 10 times, the coupler in terms mol of silver.

The amount used of the high boiling point organic solvent of the present invention is in general in the range of from 0.2 to 10.0, preferably in the range of from 0.5 to 8.0, and more preferably in the range of from 1.0 to 6.0, in weight ratio to the magenta coupler including the magenta coupler of formula (M-1) in the same layer, or in the molar ratio. When the amount used of the high boiling point organic solvent of the present invention is less than 0.2 in weight ratio to the magenta coupler, it is difficult to control the hue, and when it exceeds 10.0, pressure bleeding is liable to be generated on images.

The amount used of the ultraviolet absorber of the present invention is in the range of from 0.05 to 5.0 in weight ratio to the magenta coupler contained in the photosensitive material, more preferably in the range of from 0.1 to 3.0, still more preferably in the range of from 0.2 to 1.5. When the amount of the ultraviolet absorber of the present invention is less than 0.05 in weight ratio to the coupler, it is difficult to prevent the reduction of yellow density, and when it exceeds 5.0, the reduction of coloring of the magenta coupler is liable to occur.

The dye formed from the coupler of the present invention has absorption wavelength in green light region and its maximum absorption wavelength is preferably from 540 nm to 549 nm, and more preferably from 542 nm to 548 nm, from color reproduction.

Formula (II) is described in detail below.

In formula (II), $R_{a1}$ represents a hydrogen atom, an aliphatic group (preferably an alkyl group having from 1 to 40 carbon atoms and which may be substituted, e.g., methyl, i-propyl, cyclohexyl, benzyl, dodecyl, 2-methanesulfonylethyl), an aromatic carbonyl group (which has preferably from 6 to 42 carbon atoms and may be substituted with a substituent, e.g., benzoyl, toluoyl, 3-octyloxybenzoyl), an aliphatic carbonyl group (alkylcarbonyl or alkenylcarbonyl group) (which may be substituted with a substituent having preferably from 2 to 42 carbon atoms, e.g., acetyl, cyclohexanoyl, pivaloyl, myristoyl, acryloyl), or a sulfonyl group (which has preferably from 1 to 40 carbon atoms and may be substituted with a substituent, e.g., methanesulfonyl, butanesulfonyl, benzenesulfonyl).

$R_{a2}$ and $R_{a3}$ may be the same or different and each represents a hydrogen atom, an aliphatic group (preferably an alkyl group having from 1 to 40 carbon atoms and which may be substituted, e.g., methyl, ethyl, i-propyl, cyclohexyl, t-butyl), an aliphatic oxy group (preferably an alkoxy group having from 1 to 40 carbon atoms and which may be substituted, e.g., methoxy, butoxy, cyclohexyloxy, dodecyloxy), an acylamino group (which has preferably from 2 to 42 carbon atoms and may be substituted with a substituent, e.g., acetamino, myristoylamino, pivaloylamino), an aliphatic oxycarbonyl group (preferably an alkoxycarbonyl group having from 2 to 42 carbon atoms and which may be substituted, e.g., methoxycarbonyl, butoxycarbonyl, cyclohexyloxycarbonyl) or a carbamoyl group (which has preferably from 2 to 42 carbon atoms abd may be substituted with a substituent, e.g., dimethylcarbamoyl, N-methyl-N-phenylcarbamoyl); $R_{a4}$ and $R_{a5}$ may be the same or different and each represents an aliphatic group (preferably an alkyl group having from 1 to 40 carbon atoms and which may be substituted, e.g., methyl, ethyl, i-propyl, cyclohexyl, t-butyl), or an acylamino group (which has preferably from 2 to 42 carbon atoms and may be substituted with a substituent, e.g., acetamino, myristoylamino, pivaloylamino); Z represents a bond or a divalent linking group (e.g., alkylene, alkylidene, —S—, —$SO_2$—, —O—, preferably a substituted or unsubstituted alkylidene group having from 1 to 30 carbon atoms, e.g., methylene, ethylidene); and when n or m is 2, the plurality of $R_{a4}$ or $R_{a5}$ may be the same or different.

The compound represented by formula (II) is preferably represented by the following formula (A-1) from the point of the effect of the present invention.

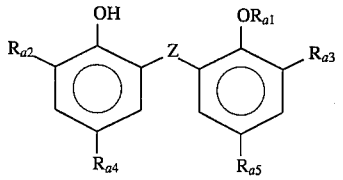

(A-1)

wherein $R_{a1}$, $R_{a2}$, $R_{a3}$, $R_{a4}$, $R_{a5}$ and Z have the same meaning as in formula (II).

$R_{a1}$ preferably represents a hydrogen atom or an aliphatic group and more preferably a hydrogen atom from the point of the effect of the present invention.

$R_{a2}$, $R_{a3}$, $R_{a4}$ and $R_{a5}$ preferably represents an alkyl group, more preferably an alkyl group having a hydrogen atom at the 1-position, and most preferably a methyl group, from the point of the effect of the present invention.

Z preferably represents an alkylidene group and more preferably —C($R_{a6}$)— from the point of the effect of the present invention. $R_{a6}$ represents a hydrogen atom or an alkyl group (preferably an alkyl group having from 1 to 30 carbon atoms and which may be substituted, e.g., methyl, ethyl, i-propyl, s-butyl, 2,4,4-trimethylpentyl, undecyl, 2,4-di-t-pentylphenoxymethyl, cyclohexyl, benzyl). $R_{a6}$ preferably represents an alkyl group and more preferably a branched chain alkyl group from the point of the effect of the present invention.

Specific examples of these compounds are shown below, but the compounds for use in the present invention are not limited thereto.

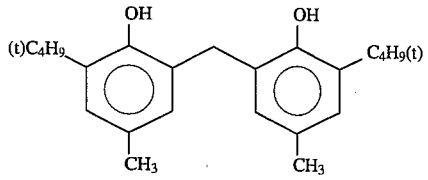

(A-1)

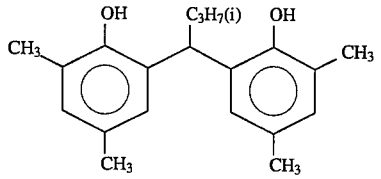

(A-2)

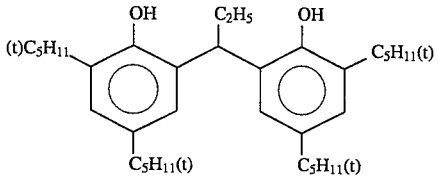

(A-3)

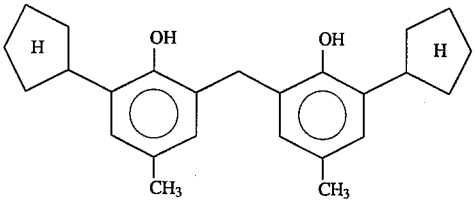

(A-4)

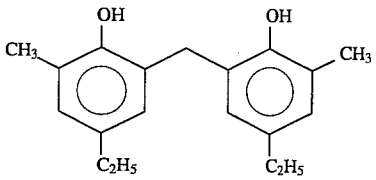

(A-5)

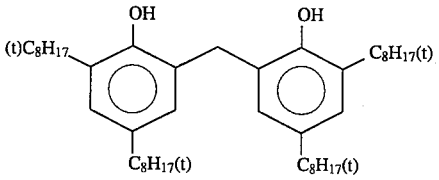

(A-6)

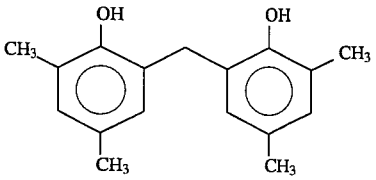

(A-7)

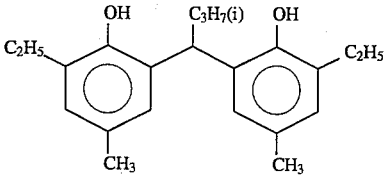

(A-8)

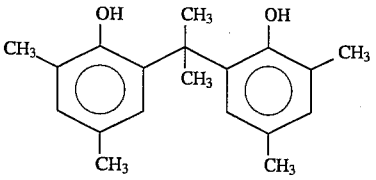

(A-9)

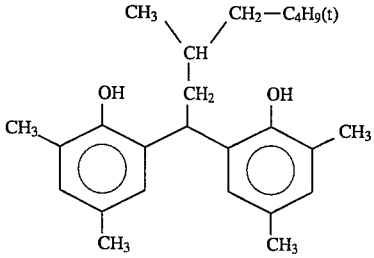

(A-10)

-continued
(A-11)
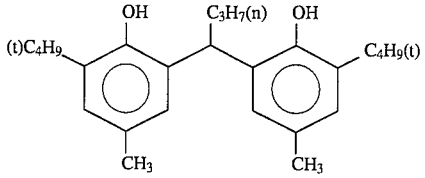
(A-12)
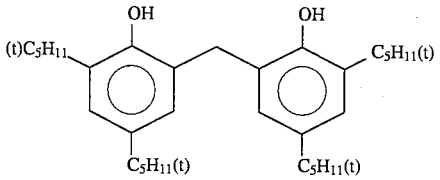
(A-13)
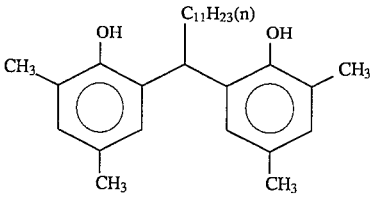
(A-14)
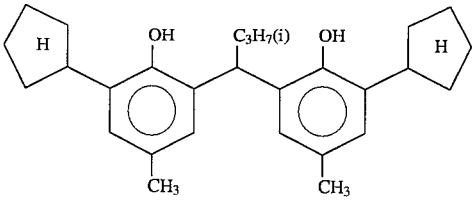
(A-15)
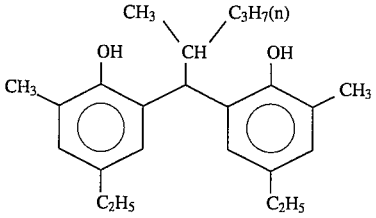
(A-16)
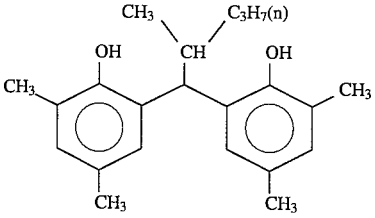
(A-17)
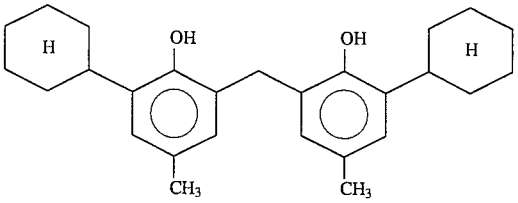
(A-18)
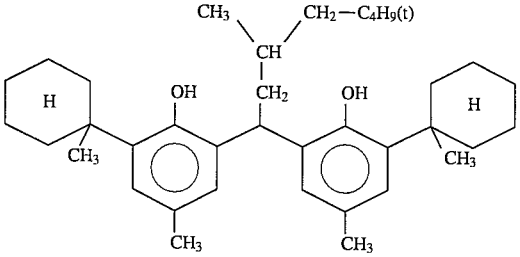
(A-19)
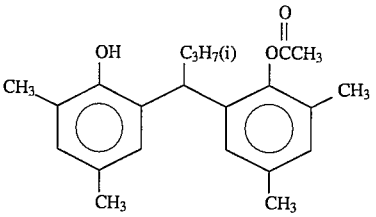
(A-20)
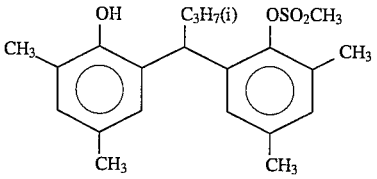
(A-21)
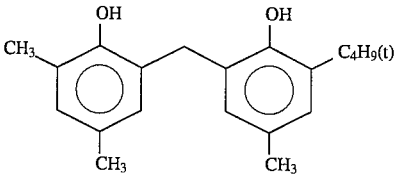
(A-22)
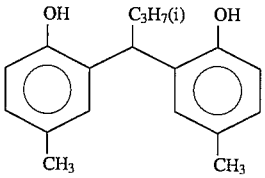
(A-23)
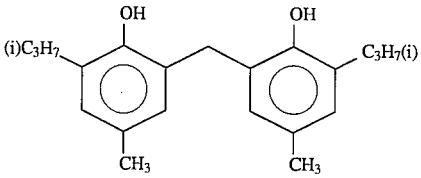
(A-24)
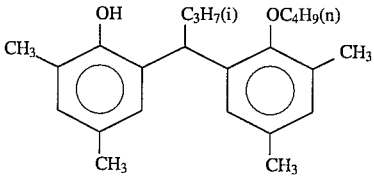
(A-25)
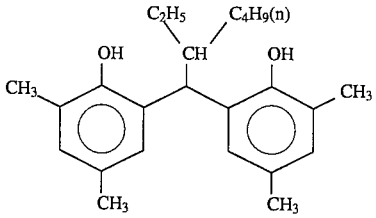
(A-26)
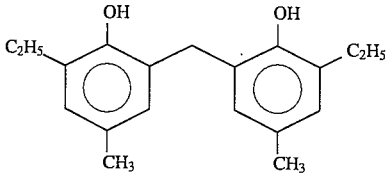

-continued
(A-27)
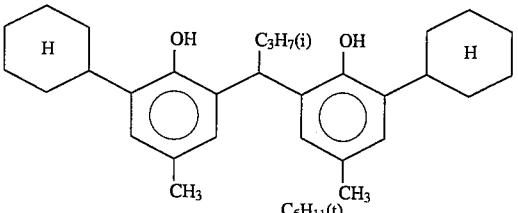
(A-28)
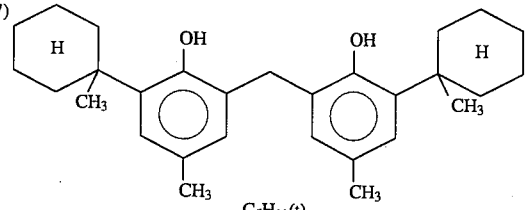
(A-29)
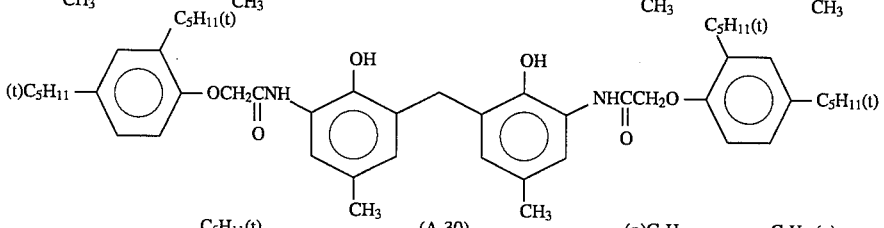
(A-30)
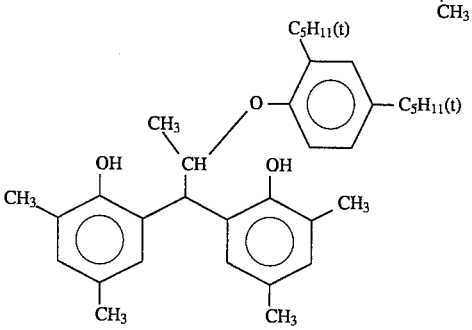
(A-31)
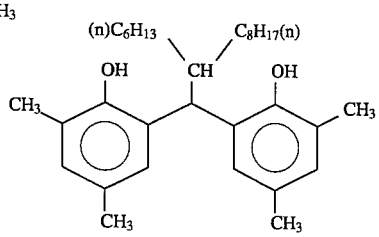
(A-32)
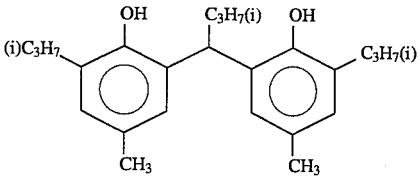
(A-33)
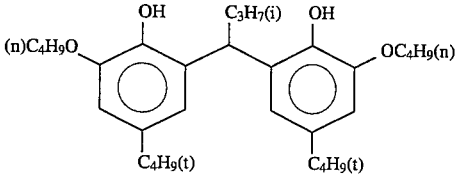
(A-34)
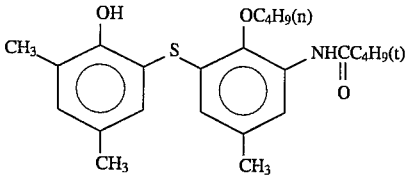
(A-35)
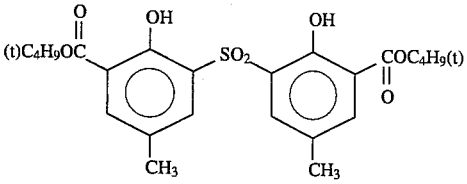
(A-36)
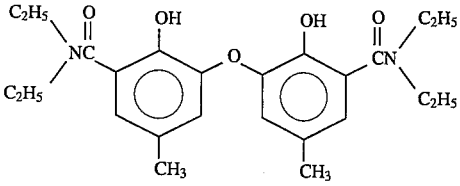
(A-37)
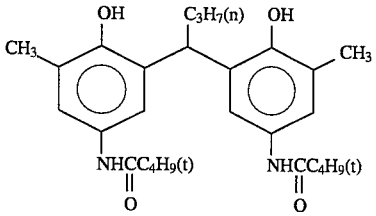
(A-38)
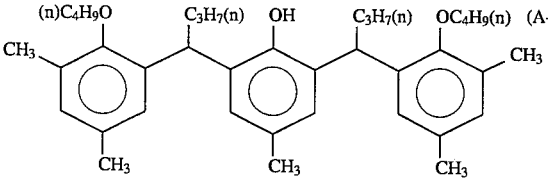
(A-39)
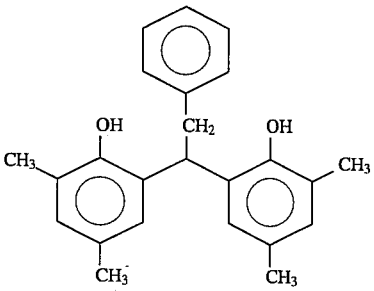

-continued (A-40)

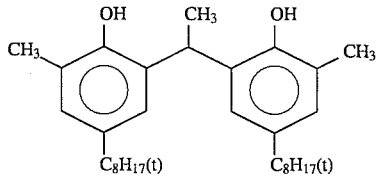

(A-41)

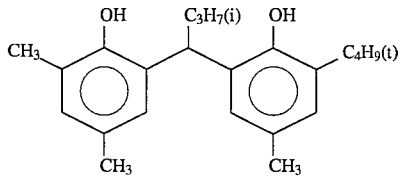

(A-42)

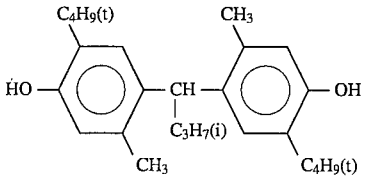

(A-43)

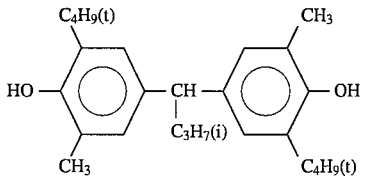

(A-44)

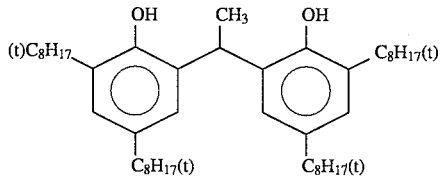

(A-45)

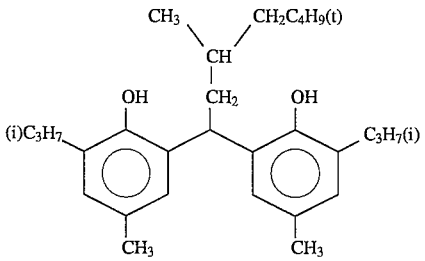

(A-46)

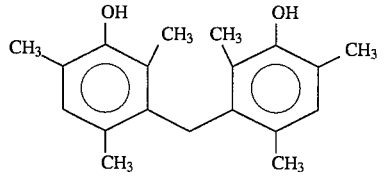

(A-47)

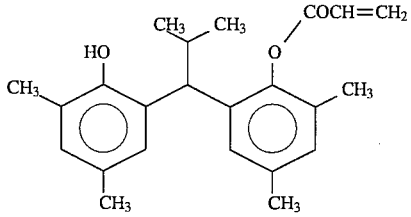

(A-48)

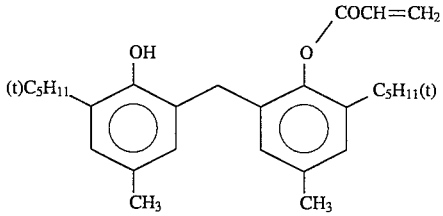

The compounds represented by formula (II) of the present invention can be synthesized according to the methods described in JP-A-62-262047 and JP-A-4-340960 or methods based on these methods.

The amount used of the compound represented by formula (II) varies according to the kind and amount of the magenta couplers which are used, but is appropriately in the range of from 0.5 to 300 mol %, preferably in the range of from 1 to 200 mol %, and particularly preferably in the range of from 5 to 100 mol %, per mol of the coupler used.

The compound represented by formula (III) is described in detail below.

$R_{b1}$, $R_{b2}$, $R_{b3}$, $R_{b4}$, $R_{b5}$, $R_{b6}$, $R_{b7}$ and $R_{b8}$ may be the same or different, and each represents a hydrogen atom, an aliphatic group (preferably an alkyl group having from 1 to 30 carbon atoms and which may be substituted, e.g., methyl, i-propyl, t-octyl, benzyl, cyclohexyl, dodecyl, s-butyl, 1,1-dimethyl-4-methoxycarbonylbutyl, 2-phenoxyethyl), an acyl group (preferably which has from 2 to 36 carbon atoms and which may be substituted, e.g., acetyl, pivaloyl, dodecanoyl, benzoyl, 3-hexadecyloxybenzoyl), an acylamino group (preferably which has from 2 to 36 carbon atoms and which may be substituted, e.g., acetamino, pivaloylamino, 2-ethylhexanoylamino, 2-(2,4-di-t-pentylphenoxy)octanoylamino, dodecanoylamino, 3-butoxybenzoylamino), an aliphatic oxycarbonyl group (preferably an alkoxycarbonyl group having from 2 to 36 carbon atoms and which may be substituted, e.g., methoxycarbonyl, dodecyloxycarbonyl, 2-hexyloxyethoxycarbonyl), an aryloxycarbonyl group (preferably which has from 7 to 42 carbon atoms and which may be substituted, e.g., 2,4-di-t-pentylphenoxycarbonyl, 4-methoxyphenoxycarbonyl), a halogen atom (e.g., fluorine, chlorine, bromine), a sulfonyl group (preferably which has from 1 to 30 carbon atoms and which may be substituted, e.g., methanesulfonyl, octanesulfonyl, 4-(4-t-octylphenoxy)butanesulfonyl, 4-dodecyloxybenzenesulfonyl), a carbamoyl group (preferably which has from 2 to 36 carbon atoms and which may be substituted, e.g., methylcarbamoyl, diethylcarbamoyl, N-methyl-N-phenylcarbamoyl), a sulfamoyl group (preferably which has from 1 to 30 carbon atoms and which may be substituted, e.g., methylsulfamoyl, dibutylsulfamoyl, phenylsulfamoyl), or $—X_b—R_{b9}$; A represents a non-metal atomic group necessary to form a spiro ring (preferably a 5- to 7-membered ring and which may be substituted, e.g., 1,1-spiroindan, 2,2-spirochroman) or a bicyclo ring (preferably a 5- to 7-membered ring and which may be substituted, e.g., benzofuro[3,2-b]benzofuran); $R_{b9}$ and $R_{b10}$ may be the same or different and each represents an aliphatic group (preferably an alkyl group having from 1 to 30 carbon atoms and which may be substituted, e.g., methyl, i-propyl, benzyl, cyclohexyl, dodecyl, s-butyl, 2-phenoxyethyl); of $R_{b1}$ to $R_{b8}$, those substituents at the ortho position each other may be bonded to form a 5- to 8-membered ring (which may be substituted, e.g., coumaran, chroman, indan, indene, quinoline); $R_{b9}$ and $R_{b10}$ may be bonded each other to form a 5- to 7-membered ring (which may be substituted, e.g., 4-morpholine, 1-piperidine, 1-pyrrolidine); provided that at least one of $R_{b1}$ to $R_{b4}$, and at least one of $R_{b5}$ to $R_{b8}$ represent $—X_b—R_{b9}$, which may be the same or different.

$R_{b9}$ and $R_{b10}$ preferably represent an alkyl group from the point of the effect of the present invention.

$R_{b1}$ to $R_{b8}$ preferably represent a hydrogen atom, an alkyl group, an acylamino group or $—X_b—R_{b9}$ from the point of the effect of the present invention.

The compound represented by formula (III) is preferably represented by the following formulae (B-I) to (B-V) from the point of the effect of the present invention.

(B-I)

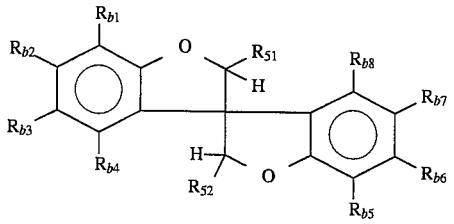

(B-II)

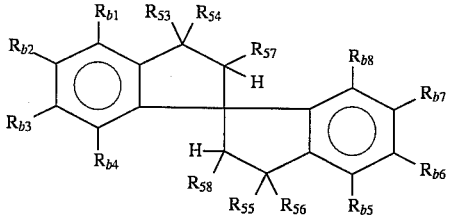

(B-III)

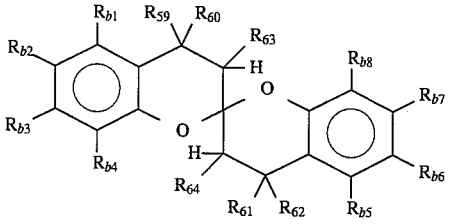

(B-IV)

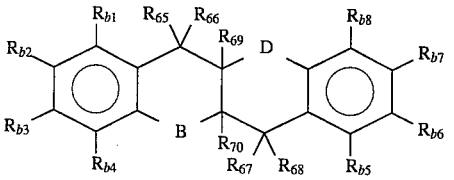

(B-V)

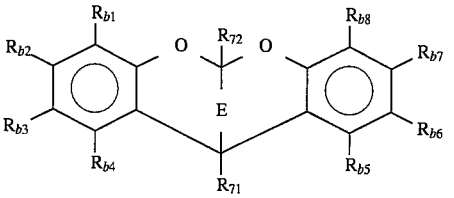

In formulae (B-I) to (B-V), $R_{b1}$ to $R_{b10}$ and $X_b$ have the same meaning as defined in formula (III).

$R_{51}$ to $R_{72}$ may be the same or different and each represents a hydrogen atom, an alkyl group (preferably which has from 1 to 20 carbon atoms and which may be substituted, e.g., methyl, ethyl, i-propyl dodecyl, benzyl, cyclohexyl), or an aryl group (preferably which has from 6 to 26 carbon atoms and which may be substituted, e.g., phenyl, 4-methylphenyl). B and D each represents single bonding, $—C(R_{80})(R_{81})—$ or —O—. E represents single bonding or $—C(R_{80})(R_{81})—$, wherein $R_{80}$ and $R_{81}$ may be the same or different and each represents a hydrogen atom, an alkyl group (preferably which has from 1 to 20 carbon atoms and which may be substituted, e.g., methyl, ethyl, i-propyl, dodecyl, benzyl), or an aryl group (preferably which has from 6 to 26 carbon atoms and which may be substituted, e.g., phenyl, 4-methylphenyl).

$R_{51}$ to $R_{72}$ preferably represent a hydrogen atom or an alkyl group from the point of the effect of the present invention.

Of the compounds represented by formula (B-I) of the present invention, $R_{b3}$ and $R_{b7}$ may be the same or different, but it is preferred that both represent $—X_b—R_{b9}$ from the point of the effect of the present invention.

Of the compounds represented by formula (B-II) of the present invention, $R_{b1}$, $R_{b4}$, $R_{b5}$ and $R_{b8}$ may be the same or different, but it is preferred that all of them represent $—X_b—R_{b9}$ from the point of the effect of the present invention.

Of the compounds represented by formula (B-II) of the present invention, $R_{b2}$, $R_{b3}$, $R_{b6}$ and $R_{b7}$ may be the same or different, but it is preferred that all of them represent $—X_b—R_{b9}$ from the point of the effect of the present invention.

Of the compounds represented by formula (B-III) of the present invention, $R_{b2}$ and $R_{b6}$ may be the same or different, but it is preferred that both represent $—X_b—R_{b9}$ from the point of the effect of the present invention.

Of the compounds represented by formula (B-IV), it is preferred that both of B and D represent —O—, and $R_{b2}$ and $R_{b6}$ represent $—X_b—R_{b9}$, although $R_{b2}$ and $R_{b6}$ may be the same or different, from the point of the effect of the present invention.

Of the compounds represented by formula (B-IV), it is preferred that both of B and D represent single bonding, and $R_{b2}$, $R_{b3}$, $R_{b6}$ and $R_{b7}$, although they may be the same or different, all represent $—X_b—R_{b9}$, from the point of the effect of the present invention.

Of the compounds represented by formula (B-V), it is preferred that both of $R_{b3}$ and $R_{b6}$ represent $—X_b—R_{b9}$, although they may be the same or different, from the point of the effect of the present invention.

Of the compounds represented by formulae (B-I) to (B-V), those represented by formulae (B-II), (B-IV) and (B-V) are preferred, those represented by formulae (B-II) and (B-IV) are more preferred, and those represented by formula (B-II) are most preferred, from the point of the effect of the present invention.

Specific examples of the compounds represented by formula (III) are shown below, but the present invention is not limited thereto.

(B-1)
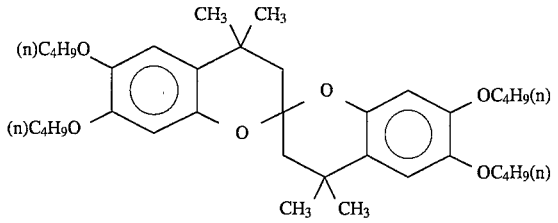
(B-2)
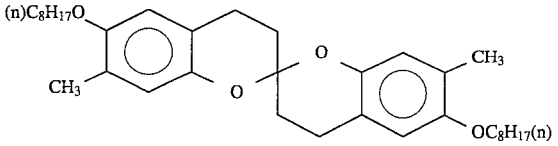
(B-3)
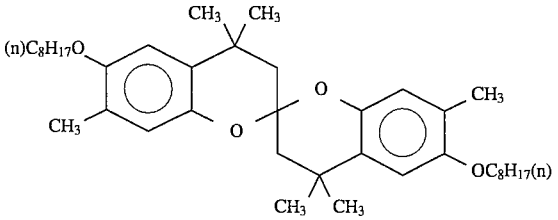
(B-4)
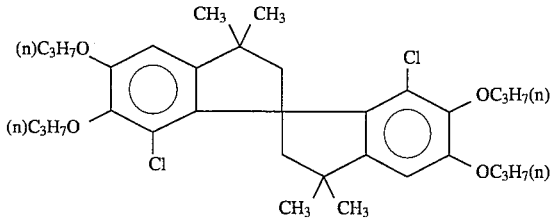
(B-5)
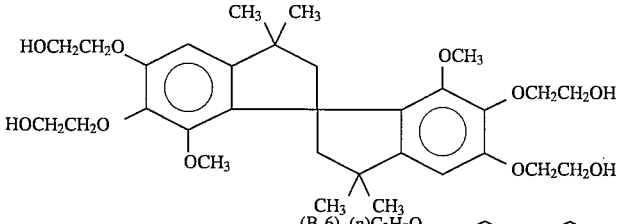
(B-6)
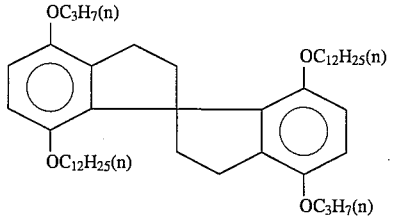
(B-7)
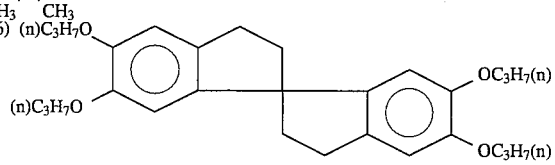
(B-8)
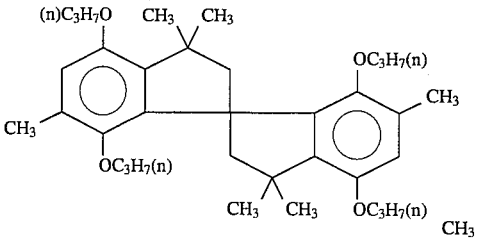
(B-9)
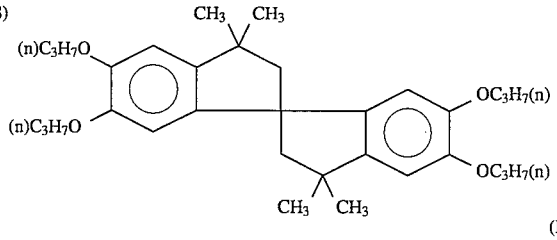
(B-10)
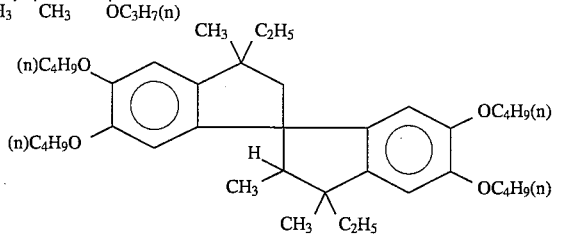

-continued
(B-11)
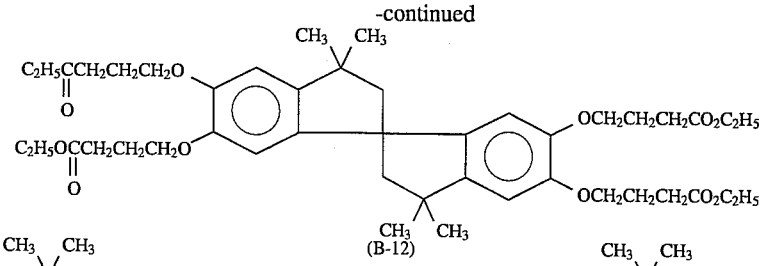
(B-12)
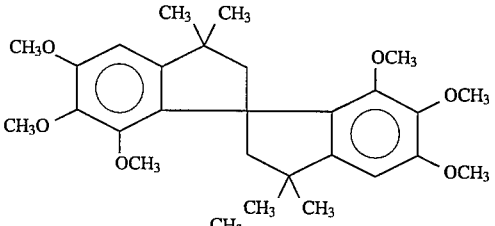
(B-13)
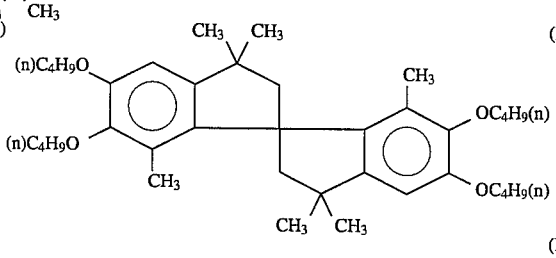
(B-14)
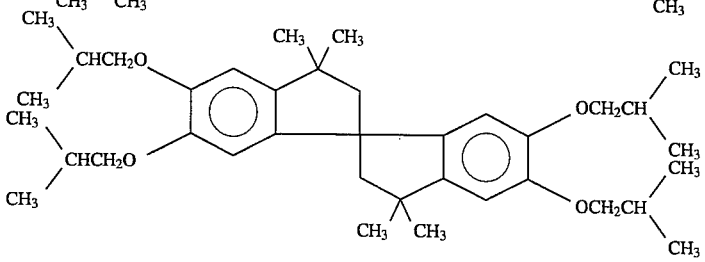
(B-15)
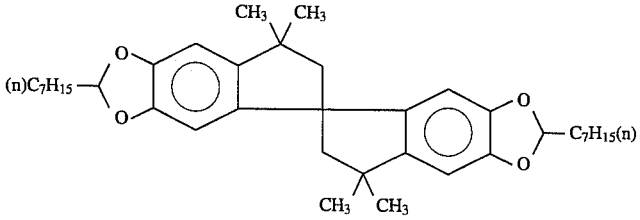
(B-16)
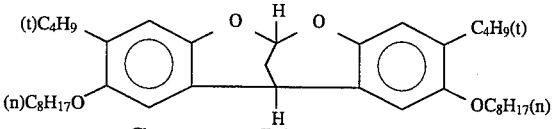
(B-17)
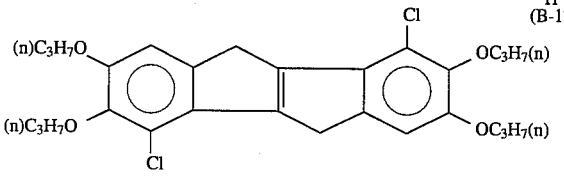
(B-18)
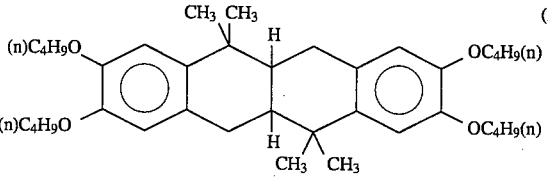
(B-19)
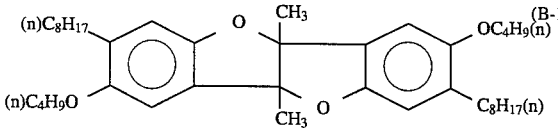
(B-20)
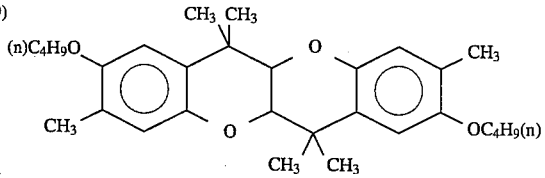
(B-21)
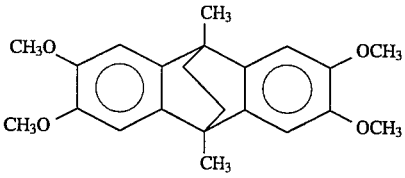
(B-22)
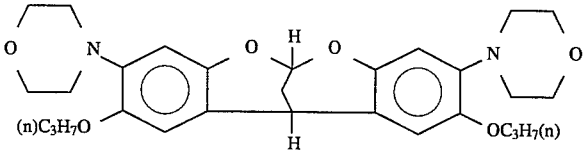

-continued (B-23)

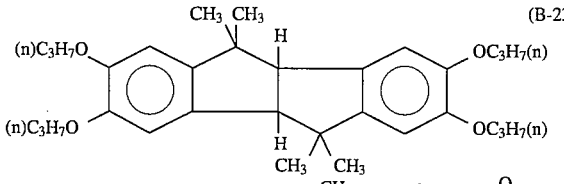

(B-24)

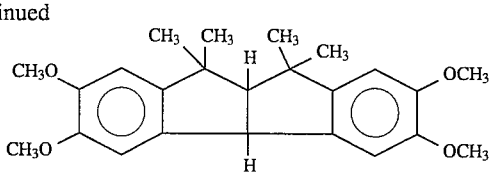

(B-25)

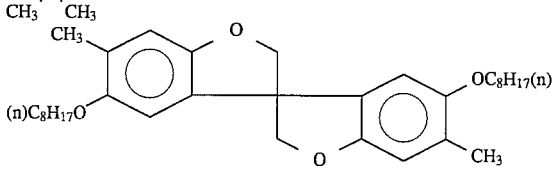

(B-26)

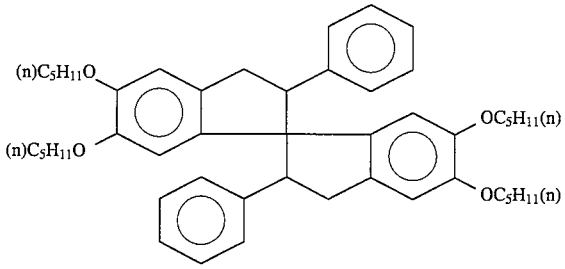

These compounds can be synthesized according to the methods described in JP-A-56-159644, JP-A-62-244045, JP-A-62-244246, JP-A-62-273531, JP-A-63-95439, EP 239, 972, and JP-A-4-330440 or methods based on these methods.

The amount used of the compound represented by formula (III) varies according to the kind and amount of the magenta couplers which are used, but is generally in the range of from 0.5 to 300 mol %, preferably in the range of from 1 to 200 mol %, and most preferably in the range of from 1 to 100 mol %, per mol of the coupler used.

The proportion of the amount used of the compound represented by formula (III) to the compound represented by formula (II) is preferably about 0.5 to 2 times (mol ratio), and the proportion of the amount used of the compound represented by formula (II) to the compound represented by formula (III) is also the same.

The most preferred method of addition of the above described couplers into a hydrophilic colloidal layer in the present invention is that comprising dissolving the couplers in a high boiling point organic solvent and a low boiling point auxiliary solvent for use in the present invention, then dispersing the resulting solution in an aqueous gelatin solution containing a surfactant. Methods such as distillation, noodle washing, or ultrafiltration are preferably used for removing the low boiling point organic solvent from the obtained dispersion.

Preferred examples of the above described low boiling point auxiliary solvents which are used in dissolving the couplers include esters, alcohols such as methanol and ethanol, ketones such as acetone.

The color photographic material of the present invention comprises a support having coated thereon at least one yellow coloring silver halide emulsion layer, at least one magenta coloring silver halide emulsion layer, and at least one cyan coloring silver halide emulsion layer. In a color photographic paper for general use, color reproduction can be effected according to the subtractive color process by incorporating into silver halide emulsion layers color couplers capable of forming dyes having a complementary color relationship to light to which the corresponding silver halide emulsion is sensitized. In a typical color photographic paper, silver halide emulsion grains are spectrally sensitized in the above described order of the coloring layers by blue-sensitive, green-sensitive, and red-sensitive spectral sensitizing dyes and coated on a support in the above described order.

Further, a different correspondence of a light-sensitive layer to a hue of developed color from those described above may be employed, and at least one infrared-sensitive silver halide emulsion layer can be provided.

Any supports can be used in the present invention as long as photographic emulsion layers can be coated thereon, such as glass, paper, and plastic films, but a reflective support is most preferred.

A reflective support for use in the present invention is a support having high reflectivity for clearly viewing color images formed in the silver halide emulsion layer, for example, a support coated with a hydrophobic resin having dispersed therein a light reflective material such as titanium oxide, zinc oxide, calcium carbonate, calcium sulfate, and a support comprised a hydrophobic resin per se having dispersed therein a light reflective material. Examples of such supports include polyethylene coated papers, polyethylene terephthalate coated papers, polypropylene based synthetic papers, transparent supports provided with a reflective layer or using in combination with a reflective material, e.g., a glass plate, polyester films such as polyethylene terephthalate, cellulose triacetate or cellulose nitrate, polyamide films, polycarbonate films, polystyrene films and vinyl chloride resin.

The reflective support for use in the present invention is a paper support both surfaces of which are coated with water resisting resin layers, and it is preferred that at least one of the water resisting resin layers contain fine grains of a white pigment. The white pigment fine grains are preferably contained in a concentration of 12% by weight or more, and more preferably 14% by weight or more. As light reflective white pigment grains, the white pigment is preferred to be thoroughly kneaded in the presence of a surfactant, and it is also preferred that the surfaces of the pigment grains are preferably treated with a di-, tri- or tetrahydric alcohol.

The fine grains of the white pigment are preferred to be dispersed uniformly in the reflective layer not to be agglomerated. The size of the distribution can be obtained by measuring the proportion of the area occupied by the fine grains projected in each unit area (%) (Ri). The variation coefficient of the proportions of the occupied areas (%) can be determined as a ratio of the standard deviation (s) of Ri to the mean value of Ri (R), that is, s/R. The variation coefficient of the proportions of the occupied areas (%) of the fine grains of the pigment in the present invention is preferably 0.15 or less, more preferably 0.12 or less, and particularly preferably 0.08 or less.

A support having a surface of diffuse reflectivity of the second-class is preferably used in the present invention. Diffuse reflectivity of the second-class means the diffuse reflectivity obtained by giving the surface having a mirror concave and convex to divide the mirror to fine mirrors facing different directions, and dispersing the directions of the fine mirrors divided. The concave and convex of the surface of diffuse reflectivity of the second-class have three dimensional average roughness to the center plane of from 0.1 to 2 μm, preferably from 0.1 to 1.2 μm. The frequency of the concave and convex of the surface, with respect to the concave and convex having a roughness of 0.1 μm or more, is preferably from 0.1 to 2,000 cycle/mm, and more preferably from 50 to 600 cycle/mm. Such a support is described in detail in JP-A-2-239244.

The silver halide grains which are preferably used in the present invention include silver chlorobromide, silver chloroiodobromide, or silver chloride grains having a silver chloride content of 95 mol % or more. In particular, in order to expedite the development processing time, grains composed of silver chlorobromide or silver chloride substantially free of silver iodide are preferably used in the present invention. The "substantially free of silver iodide" as used herein means that the silver iodide content is 1 mol % or less, preferably 0.2 mol % or less. On the other hand, for the purposes of raising a high illumination sensitivity, enhancing a spectral sensitization sensitivity, or increasing aging stability of the light-sensitive material, high silver chloride grains having a silver iodide content of from 0.01 to 3 mol % may be used on the emulsion surface in some cases as described in JP-A-3-84545. The halide composition of the emulsion may be different or the same among particles but when an emulsion comprising grains having the same halide composition is used, it is easy to homogenize the properties of grains. Also, with respect to the halide composition distribution inside of the silver halide emulsion grain, the grain may have a so-called uniform-type structure where any portion of the silver halide grain has the same composition, the grain may have a so-called laminate-type structure where the halide composition is different between the core inside the silver halide grain and the shell (single layer or a plurality of layers) surrounding the core, or the grain may have such a structure that non-layered portions different in the halide composition are provided inside the grain or on the grain surface (when provided on the grain surface, the portions are conjugated at edges, corners or on planes), and these are appropriately selected depending on the use. For achieving a high sensitivity, either of the latter two cases is advantageously used rather than the grain of uniform-type structure and also preferred in view of pressure stability. When the silver halide grain has either of the above-described structures, the boundary between portions different in the halide composition may be clear, may be ambiguous because of mixed crystals formed due to difference in the composition, or may have sequential structural change provided positively.

The high silver chloride emulsion used in the present invention preferably has such a structure that a silver bromide localized phase of layer or non-layer form is present in the inside and/or on the surface of silver halide grain as described above. In the halide composition of the above-described localized phase, the silver bromide content is preferably at least 10 mol %, more preferably exceeds 20 mol %. The silver bromide content of the silver bromide localized phase can be analyzed according to the X-ray diffraction method (as described, for example, in *Shin-jikken Kagaku Koza* 6, *Kozo-Kaiseki,* compiled by Nippon Kagaku Kai, Maruzen). Such a localized phase can be present at edges, corners or on planes inside the grain or on the surface of the grain and one preferred example is the case where the localized phase is epitaxially grown at a corner of grain.

It is also effective to further increase the silver chloride content of silver halide emulsions so as to reduce the replenishing amount of development processing solution. In this case, an emulsion composed of nearly pure silver chloride as having a silver chloride content of 98 to 100 mol % is preferably used.

The silver halide grain contained in the silver halide emulsion used in the present invention has an average grain size (a number average in the diameter as a grain size of a circle equivalent to the projected area of a grain) of preferably from 0.1 to 2 μm.

The coefficient of fluctuation in the grain size distribution (obtained by dividing the standard deviation of the grain size distribution by the average grain size) is 20% or less, preferably 15% or less, more preferably 10% or less, namely, monodisperse. For the purpose of obtaining a wide latitude, it is also preferred to blend monodisperse emulsions as described above in the same layer or coat the monodisperse emulsions in a superposed fashion.

The silver halide grain contained in the photographic emulsion may have a regular crystal form such as cube, tetradecahedron or octahedron, an irregular crystal form such as spherical or tabular, or a composite form of these. Also, a mixture of grains having various crystal forms may be used. In the present invention, grains having the above-described regular crystal form preferably accounts for 50% or more, more preferably 70% or more, still more preferably 90% or more. An emulsion where the projected area of tabular grains having an average aspect ratio (circle-converted diameter/thickness) of 5 or more, preferably 8 or more, exceeds 50% of that of the total grains can also be preferably used.

The silver chloride/silver chlorobromide emulsion used in the present invention can be prepared according to the methods described in P. Glafkides, *Chimie et Phisique Photographique,* Paul Montel (1967), G. F. Duffin, *Photographic Emulsion Chemistry,* Focal Press (1966) or V. L. Zelikman et al, *Making and Coating Photographic Emulsion,* Focal Press (1964). More specifically, any of acid process, neutral process and ammonia process may be used and the reaction between a soluble silver salt and a soluble halogen salt may be conducted by a single jet method, a double jet method or a combination of these. Also, the grain can be formed in an atmosphere of excess silver ions (so-called reverse mixing method). A so-called controlled double jet method, which is one system of the double jet method, of keeping constant the pAg of the liquid phase where silver halide is formed can also be used. According to this method, the silver halide emulsion obtained can be composed of grains having regular crystal forms and a nearly uniform grain size.

The localized phase or substrate of the silver halide grain of the present invention preferably contains different kinds of metal ions or their complex ions. Preferred metals are selected from metal ions or metal complexes belonging to Group VIII and Group IIb of the Periodic Table, a lead ion and a thallium ion. In the localized phase, ions of iridium, rhodium or iron, complex ions thereof or a combination of these are mainly used and in the substrate, metal ions selected from osmium, iridium, rhodium, platinum, ruthenium, palladium, cobalt, nickel and iron, complex ions thereof or a combination of these are mainly used. The kind and concentration of the metal ion may be changed between the localized phase and the substrate. Plural kinds of these metals may also be used.

In particular, iron and iridium compounds are preferred to be present in the silver bromide localized phase.

These metal ion donating compounds are included in the localized phase and/or other part of the grains (substrate) of the silver halide grains of the present invention, at the time of the formation of silver halide grains, by means of addition to a dispersion medium such as an aqueous solution of gelatin, an aqueous solution of halide, an aqueous solution of silver salt or other aqueous solution, or by addition in the form of silver halide grains which have previously contained the metal ion and dissolving these grains.

The addition of the metal ions for use in the present invention to grains of an emulsion can be carried out before formation of grains, during formation of grains, or immediately after formation of grains. The time of the addition can be varied depending on the position of grains where the metal ion is to be included.

The silver halide emulsions that are used in the present invention are generally chemically and spectrally sensitized.

Chemical sensitization can be performed by chemical sensitization utilizing a chalcogen sensitizer (specifically, sulfur sensitization represented by the addition of an unstable sulfur compound, selenium sensitization utilizing a selenium compound, and tellurium sensitization utilizing a tellurium compound), noble metal sensitization represented by gold sensitization, and reduction sensitization, alone or in combination thereof. Compounds that are preferably used for chemical sensitization include those disclosed in JP-A-62-215272, from page 18, right lower column to page 22, right upper column.

The effect of the constitution of the photographic material of the present invention is conspicuous when a high silver chloride emulsion that has been gold sensitized is used. The emulsion to be used in the present invention is a so-called surface latent image type emulsion in which the latent image is mainly formed on the surface of the grain.

Various compounds or precursors thereof can be included in the silver halide emulsion for use in the present invention to prevent fogging from occurring or stabilize photographic performances during manufacture, storage or photographic processing of the photographic material. Specific examples of compounds useful for the above purposes are disclosed in JP-A-62-215272, pages 39 to 72, and they can be preferably used. In addition, 5-arylamino-1,2,3,4-thiatriazole compounds (the aryl residual group has at least one electron attractive group) disclosed in EP 0,447,647 are also preferably used.

Spectral sensitization is carried out for the purpose of imparting spectral sensitivity in a desired light wavelength region to the emulsion in each layer of the photographic material of the present invention.

Spectral sensitizing dyes which are used in the photographic material of the present invention for spectral sensitization of blue, green and red light region include those disclosed in F. M. Harmer, *Heterocyclic Compounds—Cyanine Dyes and Related Compounds,* John Wiley & Sons, New York, London (1964). Specific examples of compounds and spectral sensitization processes that are preferably used in the present invention include those disclosed in JP-A-62-215272, from page 22, right upper column to page 38. In addition, the spectral sensitizing dyes disclosed in JP-A-3-123340 are very preferred as red-sensitive spectral sensitizing dyes for silver halide emulsion grains having a high silver chloride content from the point of stability adsorption strength, and the temperature dependency of exposure, and so on.

For the purpose of effective spectral sensitization in infrared region, the sensitizing dyes disclosed in JP-A-3-15049, from page 12, left upper column to page 21, left lower column, JP-A-3-20730, from page 4, left lower column to page 15, left lower column, EP 0,420,011, from page 4, line 21 to page 6, line 54, EP 0,420,012, page 4, line 12 to page 10, line 33, EP 0,443,466, and U.S. Pat. No. 4,975,362, are preferably used in the photographic materials of the present invention.

For the inclusion of these spectral sensitizing dyes in a silver halide emulsion, they may be directly dispersed in the emulsion, or they may be dissolved in a single or mixed solvent of water, methanol, ethanol, propanol, methyl cellosolve, 2,2,3,3-tetrafluoropropanol, etc., and then added to the emulsion. Further, they may be added to an emulsion as an aqueous solution coexisting with acid or base as described in JP-B-44-23389, JP-B-44-27555 and JP-B-57-22089, as an aqueous solution or colloidal dispersion coexisting with a surfactant as disclosed in U.S. Pat. Nos. 3,822,135 and 4,006,025. Moreover, they may be dissolved in a solvent substantially immiscible with water such as phenoxyethanol, etc., then dispersed in water or a hydrophilic colloid, and added to the emulsion. Alternatively, they may be directly dispersed in a hydrophilic colloid and the dispersed substance is added to the emulsion as disclosed in JP-A-53-102733 and JP-A-58-105141. The time of the addition to the emulsion may be at any stage of the preparation of the emulsion known as useful hitherto, that is, before grain formation of silver halide emulsion, during grain formation, immediately after grain formation and before washing step, before chemical sensitization, during chemical sensitization, immediately after chemical sensitization until solidifying the emulsion by cooling, or at the time of preparation of a coating solution, and the time can be selected arbitrarily. In general, it is conducted during the time after the completion of chemical sensitization and before coating, however, a method in which spectral sensitizing dyes are added at the same time as the addition of chemical sensitizers and spectral sensitization is carried out simultaneously with chemical sensitization can be employable as disclosed in U.S. Pat. Nos. 3,628,969 and 4,225,666, further, as disclosed in JP-A-58-113928, spectral sensitization can be conducted prior to chemical sensitization, or spectral sensitizing dyes can be added and spectral sensitization can be started before completion of the precipitation formation of the silver halide grains. Still further, spectral sensitizing dyes can be divided and added separately, that is, a part of them is added prior to chemical sensitization and the remaining is added after chemical sensitization as disclosed in U.S. Pat. No. 4,225,666, therefore, any time during silver halide grain formation is feasible, as well as the methods disclosed in U.S. Pat. No. 4,183,756. The addition of the sensitizing dyes before washing step of the emulsion, or before chemical sensitization is particularly preferred, above all.

The amounts of addition of these spectral sensitizing dyes can be varied over a wide range depending on purposes, but are preferably within the range of from $0.5\times10^{-6}$ mol to $1.0\times10^{-2}$ mol, and more preferably $1.0\times10^{-6}$ mol to $5.0\times10^{-3}$ mol, per mol of silver halide.

When a spectral sensitizing dye having spectral sensitization sensitivity in the red region to the infrared region is used in the present invention, it is preferred to use the compounds disclosed in JP-A-2-157749, from page 13, right lower column to page 22, right lower column, in combination. The preservability of a photographic material, the stability during processing, and the effect of supersensitization can be extraordinarily heightened with the use of these compounds. The use of the compounds represented by formula (VI), (V) and (VI) in combination is particularly preferred. These compounds are used generally in the range of from $0.5\times10^{-5}$ mol to $5.0\times10^{-2}$ mol, preferably from $5.0\times10^{-5}$ mol to $5.0\times10^{-3}$ mol, per mol of silver halide, and the effective using amount exists within the range of from 0.1 to 10,000 moles, preferably 0.5 to 5,000 moles, per mol of sensitizing dye.

The photographic material of the present invention can preferably be used, in addition to the printing system using a general negative printer, in digital scanning exposure using monochromatic high density light, such as a gas laser, a light emitting diode, a semiconductor laser, a second harmonic generation light source (SHG) comprising a combination of nonlinear optical crystal with a semiconductor laser or a solid state laser using a semiconductor laser as an excitation light source. It is preferred to use a semiconductor laser, or a second harmonic generation light source (SHG) comprising a combination of nonlinear optical crystal with a semiconductor laser or a solid state laser for obtaining a compact and inexpensive system. It is preferred to use a semiconductor laser to design a particularly compact and inexpensive apparatus having a longer duration of life and high stability, and it is preferred that at least one of exposure light sources should be a semiconductor laser.

When such a scanning exposure light source is used, the spectral sensitivity maximum of the photographic material of the present invention can be set arbitrarily according to the wavelength of the scanning exposure light source that is used. As oscillation wavelength of a laser can be made half using an SHG light source comprising a combination of nonlinear optical crystal with a semiconductor laser or a solid state laser using a semiconductor laser as an excitation light source, blue light and green light can be obtained. Accordingly, it is possible to have the spectral sensitivity maximum of a photographic material in normal three regions of blue, green and red. When a semiconductor laser is used as a light source for making an apparatus inexpensive, high stable and compact, it is preferred that at least two layers have spectral sensitivity maximum in the region of 670 nm or more. This is because emission wavelength region of III-V group system semiconductor laser, which is presently available, inexpensive and stable, is only in the red region and the infrared region. However, oscillation of II-VI group system semiconductor laser in the green and blue regions is confirmed in experimental level, and it is sufficiently expected that such a semiconductor laser shall be available inexpensively and stably according to the development of the manufacturing technology of the semiconductor laser. In such a case, the necessity that at least two layers should have spectral sensitivity maximum in the region of 670 nm or more becomes small.

The time of exposure of silver halide in a photographic material in such a scanning exposure is the time necessary for exposure of a micro area. The minimum unit for controlling the quantity of light from each digital data is in general used as this micro area and which is called a picture element (pixel). Therefore, exposure time per picture element is varied according to the size of the picture element. The size of the picture element depends on the density of the picture element and the practical range of the density of the picture element is from 50 to 2,000 dpi. The exposure time is defined as the time necessary to expose the size of the picture element with the density of the picture element being 400 dip, and preferred exposure time is $10^{-4}$ sec or less and more preferably $10^{-6}$ sec or less.

The addition of the dyes capable of decoloration by treatment (oxonol dyes and cyanine dyes, of all), disclosed in EP 0,337,490A2, pages 27 to 76, to the hydrophilic colloidal layers of the photographic material of the present invention is preferred for the purpose of prevention of irradiation and halation or improvement of the stability of a safelight.

Some of these water-soluble dyes deteriorate color separation and the stability of a safelight when the using amount is increased. Examples of dyes which can be used without deteriorating color separation include the water-soluble dyes disclosed in Japanese Patent Application Nos. 3-310143, 3-310189 and 3-31013.

In the present invention, a colored layer may be provided which is used in place of a water-soluble dye or in combination with a water-soluble dye and decolored on processing. The colored layer capable of being decolored on processing may be put into direct contact with the emulsion layer or may be provided through an interlayer containing gelatin or a processing color mixing inhibitor such as hydroquinone. The colored layer is preferably provided as an underlayer (on the support side) of an emulsion layer to be colored to the same elementary color as the color of the colored layer. Colored layers corresponding to all elementary colors may be individually provided or a part of such colored layers may be freely selected and provided. Also, a colored layer colored so as to correspond to a plurality of elementary color regions may be provided. With respect to the optical reflection density of the colored layer, the optical density at a wavelength having the highest optical density in the wavelength regions used for exposure (a visible light region of from 400 to 700 nm in the case of a normal printer exposure and a wavelength of the scan exposure source used in the case of scan exposure) is preferably from 0.2 to 3.0, more preferably from 0.5 to 2.5, still more preferably from 0.8 to 2.0.

The colored layer can be formed according conventionally known methods. For example, a method where a dye as described in JP-A-2-282244, from page 3, right upper column to page. 8, or a dye as described in JP-A-3-7931, from page 3, right upper column to page 11, left lower column is incorporated into a hydrophilic colloid layer in the sate of a solid fine particle dispersion, a method where an anionic dye is mordanted to a cation polymer, a method where a dye is adsorbed to fine particles such as silver halide to fix it in the layer, or a method using colloidal sliver as described in JP-A-1-239533 may be used. An example of the method for dispersing fine particles of a dye in the solid state include a method described in JP-A-2-308244 which comprises incorporating a fine particle dye Substantially water-insoluble at a pH of 6 or less but substantially water-soluble at a pH of 8 or more. The method for mordanting an anionic dye to a cation polymer is described, for example, in JP-A-2-84637, pp. 18–26. The preparation method of colloidal silver as a light absorbent is described in U.S. Pat. Nos. 2,688,601 and 3,459,563. Among these methods, preferred are a method comprising incorporating a fine particle dye and a method using colloidal silver.

Gelatin is advantageous as the binder or protective colloid which can be used in the light-sensitive material according to the present invention, but other hydrophilic colloids may be used solely or in combination with gelatin. Preferred gelatin is a low-calcium gelatin having a calcium content of 800 ppm or less, more preferably 200 ppm or less. The present invention is preferably constructed such that the total calcium content in photographic constituent layers becomes 10 mg/m$^2$ or less. Further, an antiseptic as described in JP-A-63-271247 is preferably added for preventing the hydrophilic colloidal layers from proliferation of various molds or bacteria which cause deterioration of an image.

At the time when the light-sensitive material of the present invention is subjected to printer exposure, a band stop filter described in U.S. Pat. No. 4,880,726 is preferably used. By using this filter, color mixing is eliminated and color reproduction is outstandingly improved.

The exposed photographic material can be processed by ordinary color development processing, but the color photographic material of the present invention is preferably bleach-fixing processed after color development for the purpose of rapid processing. In particular, when the above described high silver chloride emulsion is used, the pH of the bleach-fixing solution is preferably 6.5 or less and more preferably 6 or less for the sake of acceleration of desilvering.

Preferred examples of silver halide emulsions and other substances (additives or the like) for use in the present invention, photographic constitutional layers (arrangement of the layers or the like), and processing methods for processing the photographic materials and additives for processing are disclosed in the patent publications described below, and those disclosed in European Patent Publication 0,355,660A2 (corresponding to JP-A-2-139544) are preferably used.

| Photographic Constitutional Element | JP-A-62-215272 | JP-A-2-33144 | EP 0,355,660A2 |
|---|---|---|---|
| Silver Halide Emulsion | p. 10, right upper column, l 6 to p. 12, left lower column, l. 5,<br>p. 12, right lower column, 4 line up from the bottom to p. 13, left upper column, l. 17 | p. 28, right upper column, l. 16 to p. 29, right lower column, l. 11<br>p. 30, ll. 2 to 5 | p. 45, l 53 to p. 47, l. 3<br>p. 47, ll. 20 to 22 |
| Silver Halide Solvent | p. 12, left lower column, ll. 6 to 14<br>p. 13, left upper column, 3 line up from the bottom to p. 18, left lower column, last line | — | — |
| Chemical Sensitizer | p. 12, left lower column, 3 line up from the bottom to right lower column, 5 line up from the bottom<br>p. 18, right lower column, l. 1 to p. 22, right upper column, 9 line up from the bottom | p. 29, right lower column, l. 12 to last line | p. 47, ll. 4 to 9 |
| Spectral Sensitizer (spectral sensitizing method) | p. 22, right upper column, 8 line up from the bottom to p. 38, last line | p. 30, left upper column, ll. 1 to 13 | p. 47, ll 10 to 15 |
| Emulsion Stabilizer | p. 39, left upper column, l. 1 to p. 72, right upper column, last line | p. 30, left upper column, l. 14 to right upper column, l. 1 | p. 47, ll. 10 to 15 |
| Development Accelerator | p. 72, left lower column, l. 1 to p. 91, right upper column, l. 3 | — | — |
| Color Coupler (cyan, magenta, yellow) | p. 91, right upper column, l. 4 to p. 121, left upper column, l. 6 | p. 3, right upper column, l. 14 to p. 18, left upper column, last line<br>p. 30, right upper column, l. 6 to p. 35, right lower column, l. 11 | p. 4, ll. 15 to 27<br>p. 5, l. 30 to p. 28, last line<br>p. 45, ll. 29 to 31<br>p. 47, l. 23 to p. 63 l. 50 |
| Coloration Increasing Agent | p. 121, left upper column, l. 7 to p. 125, right upper column, l. 1 | — | — |
| UV Absorbing Agent | p. 125, right upper column, l. 2 to p. 127, left lower column, last line | p. 37, right lower column, l. 14 to p. 38, left upper column, l. 11 | p. 65, pp. 22 to 31 |
| Discoloration Inhibitor (image stabilizing agent) | p. 127, right lower column, l. 1 to p. 137, left lower column, l. 8 | p. 36, right upper column, l. 12 to p. 37, left upper column, l. 19 | p. 4, l. 30 to p. 5, l. 23<br>p. 29, l. 1 to p. 45, l. 25<br>p. 45, ll. 33 to 40<br>p. 65, ll. 2 to 21 |

-continued

| Photographic Constitutional Element | JP-A-62-215272 | JP-A-2-33144 | EP 0,355,660A2 |
|---|---|---|---|
| High Boiling Point and/or Low Boiling Point Organic Solvent | p. 137, left lower column, l. 9 to p. 144, right upper column, last line | p. 35, right lower column, l. 14 to p. 36, left upper column, 4 line up from the bottom | p. 64, ll. 1 to 51 |
| Dispersing Method of Photographic Additives | p. 144, left lower column, l. 1 to p. 146, right upper column, l. 7 | p. 27, right lower column, l. 10 to p. 28, left upper column, last line<br>p. 35, right lower column, l. 12 to p. 36, right upper column, l. 7 | p. 63, l. 51 to p. 64, l. 56 |
| Hardening Agent | p. 146, right upper column, l. 8 to p. 155, left lower column, l. 4 | — | — |
| Developing Agent Precursor | p. 155, left lower column, l. 5 to p. 155, right lower column, l. 2 | — | — |
| DIR Compound | p. 155, right lower column, ll. 3 to 9 | — | — |
| Support | p. 155, right lower column, l. 19 to p. 156, left upper column, l. 14 | p. 38, right upper column, l. 18, to p. 39, left upper column, l. 3 | p. 66, l. 29 to p. 67, l. 13 |
| Composition of Light-Sensitive Layer | p. 156, left upper column, l. 15 to p. 156, right lower column, l. 14 | p. 28, right upper column, ll. 1 to 15 | p. 45, ll. 41 to 52 |
| Dye | p. 156, right lower column, l. 15 to p. 184, right lower column, last line | p. 38, left upper column, l. 12 to right upper column, l. 7 | p. 66, ll. 18 to 22 |
| Color Mixture Inhibitor | p. 185, left upper column, l. 1 to p. 188, right lower column, l. 3 | p. 36, right upper column, ll. 8 to 11 | p. 64, l. 57 to p. 65, l. 1 |
| Gradation Controlling Agent | p. 188, right lower column, ll. 4 to 8 | — | — |
| Stain Inhibitor | p. 188, right lower column, l. 9 to p. 193, right lower column, l. 10 | p. 37, left upper column, last line to right lower column, l. 13 | p. 65, l. 32 to p. 66, l. 17 |
| Surfactant | p. 201, left lower column, l. 1 to p. 210, right upper column, last line | p. 18, right upper column, l. 1 to p. 24, right lower column, last line<br>p. 27, left lower column, 10 line up from the bottom to right lower column, l. 9 | — |
| Fluorine-Containing Compound (as anti-static agent, coating aid, lubricant, adhesion preventive agent) | p. 210, left lower column, l. 1 to p. 222, left lower column, l. 5 | p. 25, left upper column, l. 1 to p. 27, right lower column, l. 9 | — |
| Binder (hydrophilic colloid) | p. 222, left lower column, l. 6 to p. 225, left upper column, last line | p. 38, right upper column, ll. 8 to 18 | p. 66, ll. 23 to 28 |
| Tackifier | p. 225, right upper column, l. 1 to p. 227, right upper column, l. 2 | — | — |
| Antistatic Agent | p. 227, right upper column, l. 3 to p. 230, left upper column, l. 1 | — | — |
| Polymer Latex | p. 230, left upper column, l. 2 to p. 239, last line | — | — |
| Matting Agent | p. 240, left upper column, l. 1 to p. 240, right upper column, last line | — | — |
| Photographic Processing Method (processing step and additives) | p. 3, right upper column, l. 7 to p. 10, right upper column, l. 5 | p. 39, left upper column, l. 4 to p. 42, left upper column, last line | p. 67, l. 14 to p. 69, l. 28 |

Note) References in column JP-A-62-215272 include contents amended by The Amendment dated March 16, 1987, which appears at the end of the Patent Publication.
Of couplers described above, so-called short wave type yellow couplers disclosed in JP-A-63-231451, JP-A-63-123047, JP-A-63-241547, JP-A-1-173499, JP-A-1-213648 and JP-A-1-250944 are preferably used as yellow couplers.

It is preferred that cyan, magenta or yellow couplers are impregnated with a loadable latex polymer (e.g., disclosed in U.S. Pat. No. 4,203,716) in the presence (or absence) of the high boiling point organic solvents disclosed in the above table, or the couplers are dissolved in a polymer insoluble in water but soluble in an organic solvent and then dispersed in a hydrophilic colloidal aqueous solution in an emulsified state.

Examples of polymers insoluble in water but soluble in an organic solvent which can preferably be used in the present invention include homopolymers or copolymers disclosed in U.S. Pat. No. 4,857,449, from columns 7 to 15, and WO 88/00723, from pages 12 to 30. Methacrylate based or acrylamide based polymers are preferred, in particular, acrylamide based polymers are preferred as to dye stability.

It is preferred to use dye preservability improving compounds disclosed in EP 0,277,589A2 in combination with the couplers in the photographic material of the present invention. In particular, the use in combination with pyrazoloazole couplers, pyrrolotriazole couplers, and acylacetamide type yellow couplers is preferred.

That is, the use of the compound disclosed in the above EP Patent which produces a chemically inactive and substantially colorless compound upon chemically bonding with the aromatic amine based developing agent remaining after color development processing and/or the compound disclosed in the above EP Patent which produces a chemically inactive and substantially colorless compound upon chemically bonding with the oxidized product of the aromatic amine based color developing agent remaining after color development processing, alone or in combination, is preferred for preventing the generation of stain due to the formation of a color dye caused by the coupling reaction of the coupler with the color developing agent or the oxidized product thereof remaining in the film, or preventing other side reactions, during preservation after processing.

Examples of preferred cyan couplers for use in the present invention include, in addition to the phenol type couplers and naphthol type couplers disclosed in the known literature in the above table, diphenylimidazole based cyan couplers disclosed in JP-A-2-33144, 3-hydroxypyridine based cyan couplers disclosed in EP 0,333,185A2, cyclic active methylene based cyan couplers disclosed in JP-A-64-32260, pyrrolopyrazole type cyan couplers disclosed in EP 0,456,226A1, pyrroloimidazole type cyan couplers dislosed in EP 0,484,909, and pyrrolotriazole type cyan couplers disclosed in EP 0,488,248 and EP 0,491,197A1. The use of pyrrolotriazole type cyan couplers is particularly preferred.

Examples of magenta couplers which can be used in combination with the couplers of the present invention include 5-pyrazolone based magenta couplers disclosed in the known publications in the above table. 5-Pyrazolone based magenta couplers, in which arylthio is released, disclosed in WO 92/18901, WO 92/18902 and WO 92/18903 are preferred as a 5-pyrazolone based magenta coupler in that image preservability is stable and fluctuation of the picture quality by processing is small.

Known pyrazoloazole type couplers can be used in the present invention, in addition to the compounds exemplified as the specific examples of the pyrazoloazole based magenta couplers of the present invention, above all, the pyrazolotriazole couplers to which a secondary or tertiary alkyl group is directly bonded at the 2-, 3- or 6-position of the pyrazolotriazole ring disclosed in JP-A-61-65245, the pyrazoloazole couplers which contain a sulfonamide group in the molecule disclosed in JP-A-61-65246, the pyrazoloazole couplers which have an alkoxyphenylsulfonamide ballast group disclosed in JP-A-61-14254, and the pyrazoloazole couplers which have an alkoxy group or an aryloxy group at the 6-position disclosed in EP 226,849A and EP 294,785A, are preferably used from the point of hue, image stability and colorability.

Known acylacetanilide type couplers are preferably used as yellow couplers, and above all, pivaloylacetanilide type couplers which have a halogen atom or an alkoxy group at the ortho-position of the anilide ring, the acylacetanilide type couplers the acyl group of which is substituted with a cycloalkanecarbonyl group at the 1-position disclosed in EP 0,447,969A, JP-A-5-107701 and JP-A-5-113642, and the malondianilide type coupler disclosed in EP 0,482,552A and EP 0,524,540A, are preferably used.

With respect to the processing method of the color photographic material of the present invention, in addition to the methods disclosed in the above table, processing materials and processing methods disclosed in JP-A-2-207250, from page 26, right lower column, line 1 to page 34, right upper column, line 9, and JP-A-4-97355, from page 5, left upper column, line 17 to page 18, right lower column, line 20 are preferred.

EXAMPLE

The present invention is described in detail with reference to the examples, however, it should not be construed as being limited thereto.

EXAMPLE 1

A surface of a paper support laminated on both sides with polyethylene was corona discharged. The support was provided with a gelatin subbing layer containing sodium dodecylbenzenesulfonate, and further, various photographic constitutional layers described below were coated to prepare a multilayer color photographic paper (Sample 100). The coating solutions were prepared in the following manner.

Preparation of Coating Solution for Third Layer 120.0 g of a magenta coupler (ExM) and 10.0 g of a color image stabilizer (Cpd-6) were dissolved in 10.0 g of a color image stabilizer (Cpd-7), 80.0 g of a color image stabilizer (Cpd-8), 500 g of a solvent (Solv-3), and 360 ml of ethyl acetate, and this solution was dispersed in an emulsified condition into 2,000 g of a 16% aqueous gelatin solution containing 60 ml of 10% sodium dodecylbenzenesulfonate and 10 g of citric acid to obtain an emulsified dispersion A. On the other hand, two kinds of silver chlorobromide emulsions B were prepared (cubic form, a mixture in a ratio of 1:3 (silver mol ratio) of a large grain size emulsion B having an average grain size of 0.55 μm, and a small grain size emulsion B having an average grain size of 0.39 μm; variation coefficients of the grain size distribution are 0.10 and 0.08, respectively, both of them contained 0.8 mol % of silver bromide localized at a part of the grain surface, and the remaining substrate being comprising silver chloride). The green-sensitive Sensitizing Dyes D, E, and F shown below were added in an amount of $3.0\times10^{-4}$ mol, $4.0\times10^{-3}$ mol, $2.0\times10^{-4}$ mol, respectively, per mol of silver, to the large grain size emulsion B, and 3 $6\times10^{-4}$ mol, $7.0\times10^{-5}$ mol, $2.8\times10^{-4}$ mol, respectively, per mol of silver, to the small grain size emulsion B. Chemical ripening was conducted by addition of a sulfur sensitizer and a gold sensitizer. The foregoing emulsified dispersion A was mixed with this silver chlorobromide emulsion B and dissolved to obtain a coating solution for the third layer having the composition described below.

The coating solutions for from the first to seventh layers other than the third layer were prepared in the same manner as the coating solution for the third layer. 1-Oxy-3,5-dichloro-s-triazine sodium salt was used as a gelatin hardening agent in each layer.

Further, Cpd-12, Cpd-13, Cpd-14 and Cpd-15 were added to each layer so that the total coating amount becomes 15.0 mg/m$^2$, 60.0 mg/m$^2$, 50.0 mg/m$^2$, and 10.0 mg/m$^2$, respectively.

The spectral sensitizing dyes described below were used in the silver chlorobromide emulsion of each light-sensitive emulsion layer.

Blue-Sensitive Emulsion Layer

Sensitizing Dye A

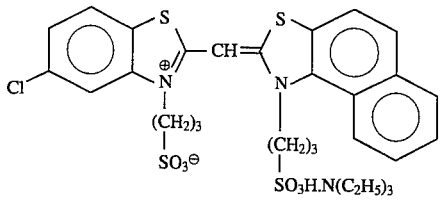

Sensitizing Dye B

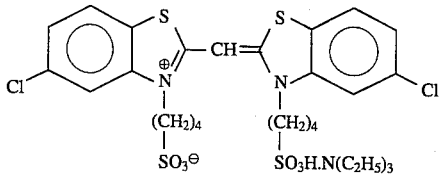

Sensitizing Dye C

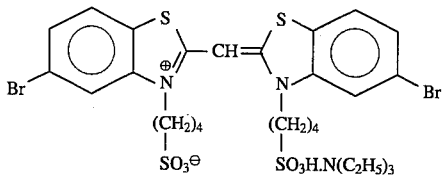

(in an amount of $1.4\times10^{-4}$ mol/mol Ag to the large grain size emulsion, and in an amount of $1.7\times10^{-4}$ mol/mol Ag to the small grain size emulsion)

Green-Sensitive Emulsion Layer

Sensitizing Dye D

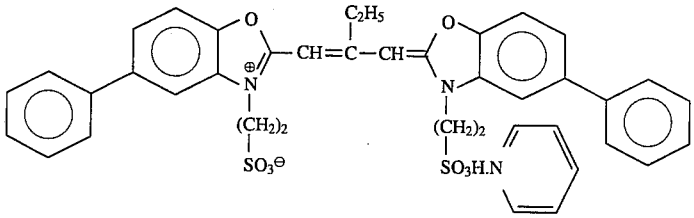

(in an amount of $3.0\times10^{-4}$ mol/mol Ag to the large grain size emulsion, and in an amount of $3.6\times10^{-4}$ mol/mol Ag to the small grain size emulsion)

Sensitizing Dye E

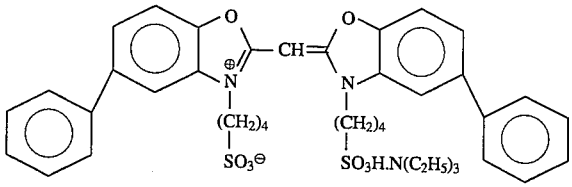

(in an amount of $4.0\times10^{-5}$ mol/mol Ag to the large grain size emulsion, and in an amount of $7.0\times10^{-5}$ mol/mol Ag to the small grain size emulsion)

Sensitizing Dye F

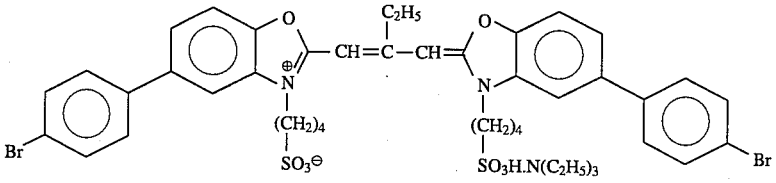

(in an amount of $2.0\times10^{-4}$ mol/mol Ag to the large grain size emulsion, and in an amount of $2.8\times10^{-4}$ mol/mol Ag to the small grain size emulsion)

Red-Sensitive Emulsion Layer

Sensitizing Dye G

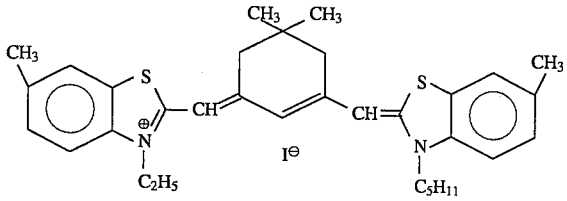

(in an amount of $5.0\times10^{-5}$ mol/mol Ag to the large grain size emulsion, and in an amount of $8.0\times10^{-5}$ mol/mol Ag to the small grain size emulsion)

Sensitizing Dye H

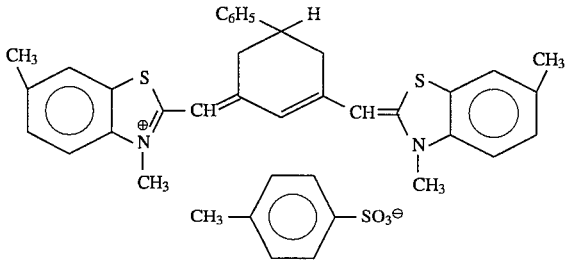

(in an amount of $5.0\times10^{-5}$ mol/mol Ag to the large grain size emulsion, and in an amount of $8.0\times10^{-5}$ mol/mol Ag to the small grain size emulsion)

The following compound was further added to the red-sensitive emulsion layer in an amount of $2.6\times10^{-3}$ mol per mol of silver halide.

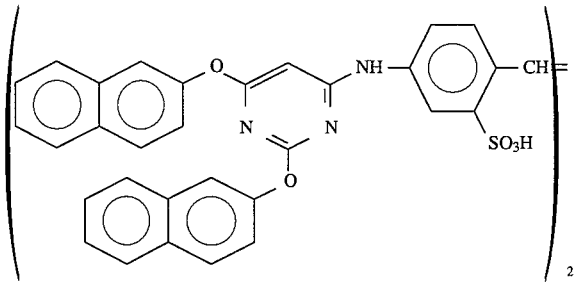

Further, 1-(5-methylureidophenyl)-5-mercaptotetrazole was added to the blue-sensitive emulsion layer, the green-sensitive emulsion layer and the red-sensitive emulsion layer in an amount of $3.3\times10^{-4}$ mol, $1.0\times10^{-3}$ mol and $5.9\times10^{-4}$ mol, respectively, per mol of silver halide.

Further, 1-(5-methylureidophenyl)-5-mercaptotetrazole was added to the second layer, the fourth layer, the sixth layer, and the seventh layer so that the coating amount becomes 0 2 mg/m$^2$, 0.2 mg/m$^2$, 0.6 mg/m$^2$, and 0.1 mg/m$^2$, respectively.

In addition, 4-hydroxy-6-methyl-1,3,3a,7-tetraazaindene was added to the blue-sensitive emulsion layer and the green-sensitive emulsion layer in an amount of $1\times10^{-4}$ mol and $2\times10^{-4}$ mol, respectively, per mol of silver halide.

Moreover, the following dyes were added to the emulsion layer for preventing irradiation (the numerals in parentheses represent the coating amount).

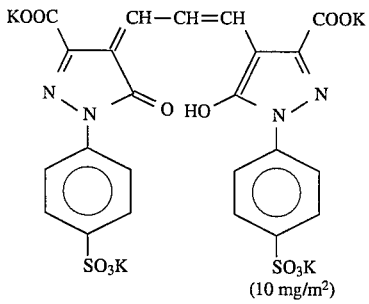

(10 mg/m$^2$)

and

-continued

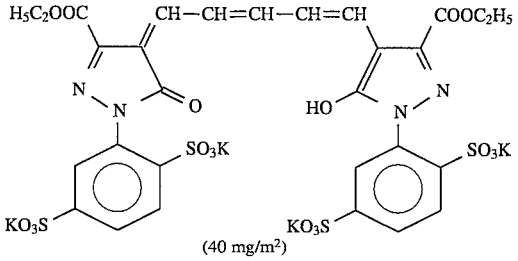

(40 mg/m$^2$)

Layer Composition

The composition of each layer is described below. The numeral represents the coating amount g/m$^2$. The numeral for the silver halide emulsion represents the coating amount in terms of silver.

Support

Polyethylene-laminated paper (a white pigment ($TiO_2$) and a blue dye (ultramarine) were added to the polyethylene of the first layer side).

| | |
|---|---|
| First Layer (blue-sensitive emulsion layer) | |
| Silver Chlorobromide Emulsion A described above | 0.24 |
| Gelatin | 1.33 |
| Yellow Coupler (ExY) | 0.61 |
| Color Image Stabilizer (Cpd-1) | 0.08 |
| Color Image Stabilizer (Cpd-2) | 0.04 |
| Color Image Stabilizer (Cpd-3) | 0.08 |
| Solvent (Solv-1) | 0.22 |
| Second Layer (color mixture inhibiting layer) | |
| Gelatin | 1.09 |
| Color Mixture Inhibitor (Cpd-4) | 0.11 |
| Solvent (Solv-1) | 0.07 |
| Solvent (Solv-2) | 0.25 |
| Solvent (Solv-3) | 0.19 |
| Solvent (Solv-7) | 0.09 |
| Third Layer (green-sensitive emulsion layer) | |
| Silver Chlorobromide Emulsion (cubic form, a mixture in a ratio of 1:3 (Ag mol ratio) of a large grains size emulsion B having an average grain size of 0.55 μm, and a small grain size emulsion B having an average grain size of 0.39 μm; variation coefficients of the grain size distribution are 0.10 and 0.08, respectively, both of them contained 0.8 mol % of AgBr localized at a part of the grainb surface of substrate of silver chloride) | 0.11 |
| Gelatin | 1.19 |
| Magenta Coupler (ExM) | 0.12 |
| Color Image Syabilizer (Cpd-6) | 0.01 |
| Color Image Stabilizer (Cpd-7) | 0.08 |
| Color Image Stabilizer (Cpd-8) | 0.01 |
| Solvent (Solv-3) | 0.50 |
| Fourth layer (color mixture inhibiting layer) | |
| Gelatin | 0.77 |
| Color Mixture Inhibitor (Cpd-4) | 0.08 |
| Solvent (Solv-1) | 0.05 |
| Solvent (Solv-2) | 0.18 |
| Solvent (Solv-3) | 0.14 |
| Solvent (Solv-7) | 0.06 |
| Fifth layer (red-sensitive emulsion layer) | |
| Silver Chlorobromide Emulsion (cubic form, a mixture in a ratio of 1:4 (Ag mol ratio) of a large grain size emulsion C having an average grain size of 0.50 μm, and a small grain size emulsion C having an average grain size of 0.41 μm; variation coefficients of the grain size distribution are 0.09 and 0.11, respectively, both of them contained 0.8 mol % of AgBr | 0.18 |

| | |
|---|---|
| localized at a part of the grain surface of substrate of silver chloride) | |
| Gelatin | 0.80 |
| Cyan Coupler (ExC) | 0.28 |
| UV Absorbing Agent (UV-3) | 0.19 |
| Color Image Stabilizer (Cpd-1) | 0.24 |
| Color Image Stabilizer (Cpd-6) | 0.01 |
| Color Image Stabilizer (Cpd-7) | 0.01 |
| Color Image Stabilizer (Cpd-8) | 0.04 |
| Color Image Stabilizer (Cpd-10) | 0.01 |
| Solvent (Solv-1) | 0.01 |
| Solvent (Solv-6) | 0.21 |
| Sixth layer (UV absorbing layer) | |
| Gelatin | 0.64 |
| UV Absorbing Agent (UV-2) | 0.39 |
| Color Image Stabilizer (Cpd-7) | 0.05 |
| Solvent (Solv-8) | 0.05 |
| Seventh Layer (protective layer) | |
| Gelatin | 1.01 |
| Acryl-Modified Copolymer of Polyvinyl Alcohol (modification degree: 17%) | 0.04 |
| Liquid Paraffin | 0.02 |
| Surfactant (Cpd-11) | 0.01 |

(ExY-1) Yellow Coupler

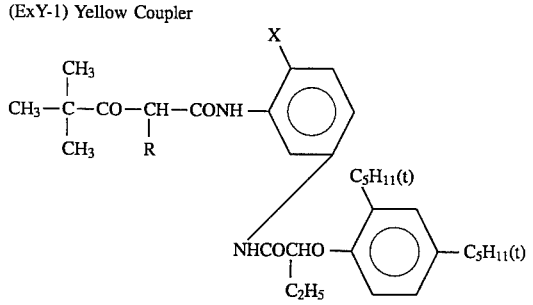

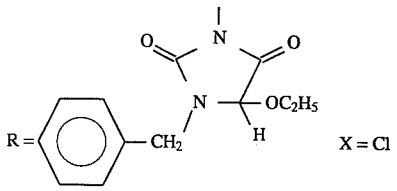

(ExM-1) Magenta Coupler

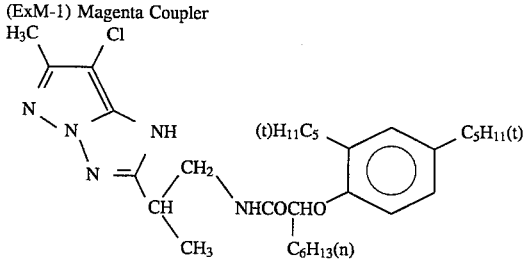

(ExC-1) Cyan Coupler
25:75 mixture (by mol ratio) of

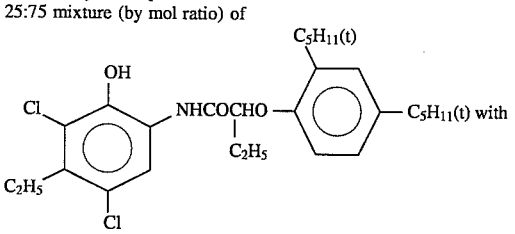

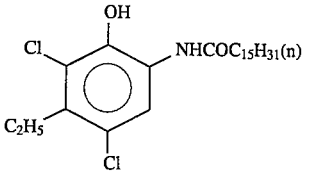

(Cpd-1) Color Image Stabilizer

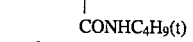

number average molecular weight: 60,000

(Cpd-2) Color Image Stabilizer

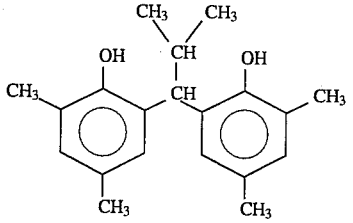

(Cpd-3) Color Image Stabilizer

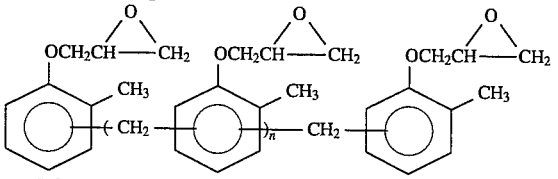

n = 7–8 (average value)

(Cpd-4) Color Mixture Inhibitor
1:1:1 mixture (by weight ratio) of (1):(2):(3)

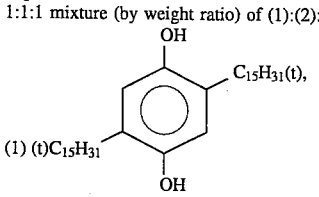

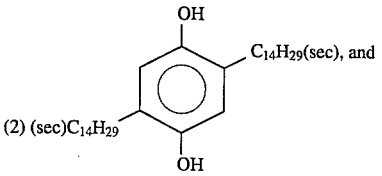

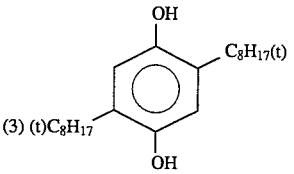

(Cpd-5) Color Image Stabilizer

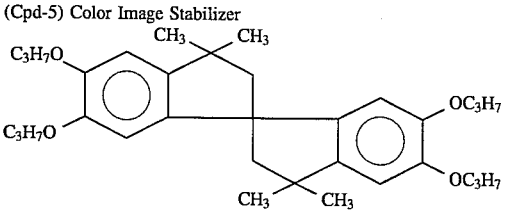

(Cpd-6) Color Image Stabilizer

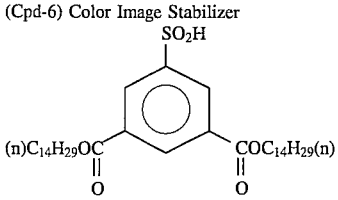

(Cpd-7) Color Image Stabilizer

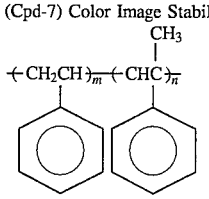

number average molecular weight: 600 m/n = 9/1

(Cpd-8) Color Image Stabilizer

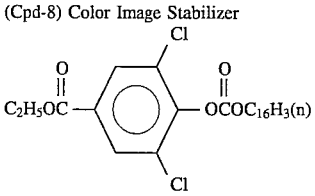

(Cpd-9) Color Image Stabilizer

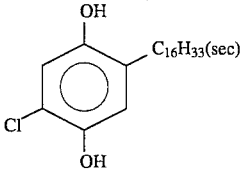

(Cpd-10) Color Image Stabilizer

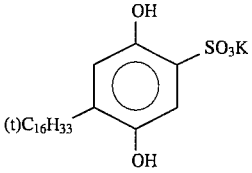

(Cpd-11) Surfactant
7:3 mixture (by weight ratio) of

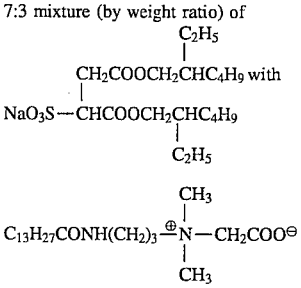

(Cpd-12) Preservative

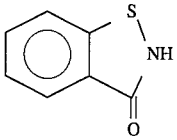

(Cpd-13) Preservative

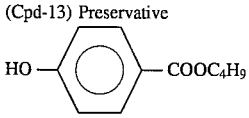

(Cpd-14) Preservative
1:1:1:1 mixture (by weight ratio) of a:b:c:d

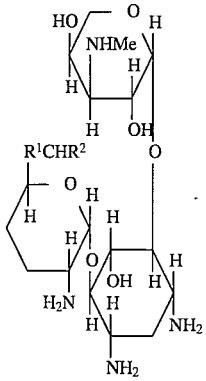

| | $R^1$ | $R^2$ |
|---|---|---|
| a | −Me | −NHMe |
| b | −Me | $-NH_2$ |
| c | −H | $-NH_2$ |
| d | −H | −NHMe |

(Cpd-15) Preservative

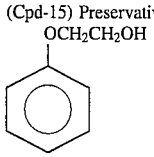

(UV-2) UV Absorbing Agent
1:2:2:3:1 mixture (by weight ratio) of (1):(2):(3):(4):(5)

(1)

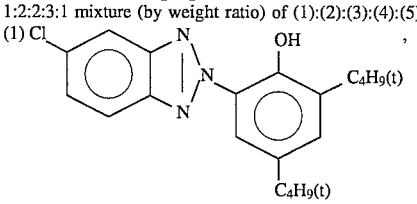

(2)

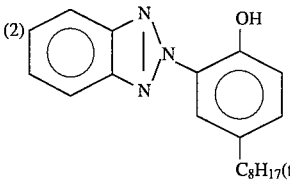

(3)

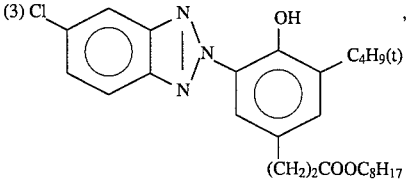

(4)

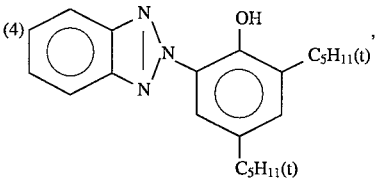

(5)

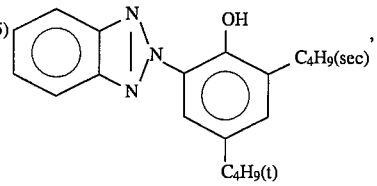

(UV-3) UV Absorbing Agent
1:3:2:1 mixture (by weight ratio) of (1):(2):(3):(4)

(1)

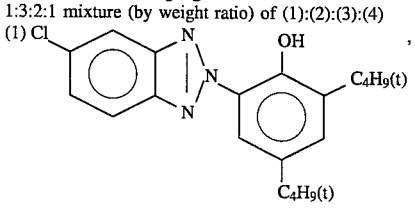

(2)

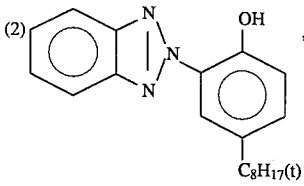

(3)

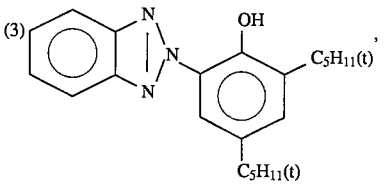

(4)

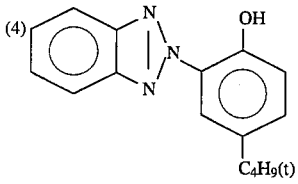

(Solv-1) Solvent

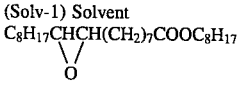

(Solv-2) Solvent

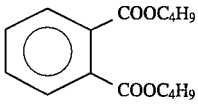

(Solv-3) Solvent

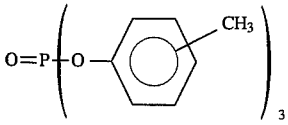

(Solv-6) Solvent

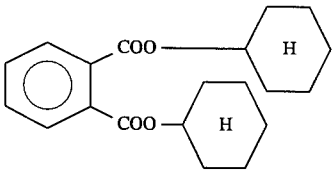

(Solv-7) Solvent

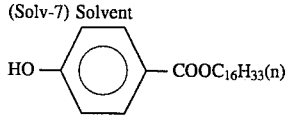

(Solv-8) Solvent

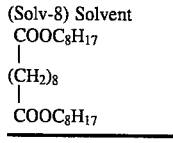

The composition of each processing solution used is described below.

| | Tank Solution | Replenisher |
|---|---|---|
| Color Developing Solution | | |
| Water | 800 ml | 800 ml |
| Ethylenediaminetetraacetic Acid | 3.0 g | 3.0 g |
| Disodium 4,5-dihydroxybenzene-1,3-disulfonate | 0.5 g | 0.5 g |
| Triethanolamine | 12.0 g | 12.0 g |
| Potassium Chloride | 6.5 g | — |
| Potassium Bromide | 0.03 g | — |
| Potassium Carbonate | 27.0 g | 27.0 g |
| Brightening Agent (WHITEX 4 Sumitomo Chemical Co., Ltd.) | 1.0 g | 3.0 g |
| Sodium Sulfite | 0.1 g | 0.1 g |
| Disodium-N,N-bis(sulfonato-ethyl)hydroxylamine | 5.0 g | 10.0 g |
| Sodium Triisopropyl-naphthalene(β)sulfonate | 0.1 g | 0.1 g |
| N-Ethyl-N-(β-methanesulfon-amidoethyl)-3-methyl-4-amino-aniline · 3/2 Sulfate · Monohydrate | 5.0 g | 11.5 g |
| Water to make | 1,000 ml | 1,000 ml |
| pH (25° C., adjusted with potassium hydroxide and sulfuric acid) | 10.00 | 11.00 |
| Bleach-Fixing Solution | | |
| Water | 600 ml | 150 ml |
| Ammonium Thiosulfate (700 g/liter) | 93 ml | 230 ml |
| Ammonium Sulfite | 40 g | 100 g |
| Ammonium Ethylenediamine-tetraacetato Ferrate | 55 g | 135 g |
| Ethylenediaminetetraacetic Acid | 5 g | 12.5 g |
| Nitric Acid (67%) | 30 g | 65 g |
| Water to make | 1,000 ml | 1,000 ml |
| pH (25° C., adjusted with acetic acid and aqueous ammonia) | 5.8 | 5.6 |
| Rinsing Solution (the tank solution and the replenisher are the same) | | |
| Sodium Chlorinated Isocyanurate | 0.02 g | |
| Deionized Water (electric conductivity: 5 μs/cm or less) | 1,000 ml | |
| pH | 6.5 | |

Samples 100 to 143 were subjected to a gradation exposure through a green filter and a blue filter and processed with the above processing solution. The optical density of the processed sample was measured by green light and blue light. The maximum color density obtained to each light was read as $D_G$ and $D_B$. The results are shown in Table A.

Then, each sample was exposed to green light so that the magenta color density becomes about 1.5, and reflection spectrum of the processed sample was measured. The maximum absorption wavelength ($\lambda_{max}$) was read from the spectrum. The results are shown in Table A.

Further, the above samples which had been exposed so that magenta density become 1.5 and processed was irradiated with xenon fade meter (80,000 lux) for 2 weeks, as a criterion of light fastness, the magenta density after irradiation (D) to initial density ($D_0$)=1.5 is indicated in percentage (%). The results obtained are shown in Table A.

TABLE A

| Sample No. | Coupler | Oil | Dielectric Constant of Oil | Refractive Index of Oil | UV Absorber | Cmpd. (II) | Cmpd. (III) | $D_G$ | $D_B$ | $\lambda_{max}$ | $D/D_0$ | Remarks |
|---|---|---|---|---|---|---|---|---|---|---|---|---|
| 100 | ExM | Solv-3 | 7.33 | 1.555 | — | — | — | 2.22 | 2.34 | 545 | 72 | Comparison |
| 101 | " | Solv-6 | 6.45 | 1.514 | — | — | — | 2.20 | 2.30 | 543 | 74 | " |
| 102 | " | Solv-2 | 6.45 | 1.493 | — | — | — | 2.21 | 2.28 | 543 | 73 | " |
| 103 | " | S-1 | 5.86 | 1.433 | — | — | — | 2.23 | 2.10 | 542 | 73 | " |
| 104 | " | S-9 | 5.18 | 1.485 | — | — | — | 2.23 | 2.15 | 541 | 73 | " |
| 105 | " | S-19 | 4.85 | 1.454 | — | — | — | 2.20 | 2.12 | 539 | 74 | " |
| 106 | " | S-12 | 4.47 | 1.429 | — | — | — | 2.22 | 2.11 | 539 | 74 | " |
| 107 | " | S-13 | 3.96 | 1.449 | — | — | — | 2.21 | 2.12 | 538 | 73 | " |
| 108 | " | Solv-3 | 7.33 | 1.555 | III-10 | — | — | 2.23 | 2.34 | 454 | 75 | " |
| 109 | " | Solv-6 | 6.45 | 1.514 | " | — | — | 2.20 | 2.34 | 543 | 75 | " |
| 110 | " | Solv-2 | 6.45 | 1.493 | " | — | — | 2.21 | 2.32 | 543 | 75 | " |
| 111 | " | S-1 | 5.86 | 1.433 | " | — | — | 2.24 | 2.25 | 541 | 74 | " |
| 112 | " | S-9 | 5.18 | 1.485 | " | — | — | 2.23 | 2.28 | 541 | 73 | " |
| 113 | " | S-19 | 4.85 | 1.454 | " | — | — | 2.24 | 2.26 | 539 | 74 | " |
| 114 | ExM | S-12 | 4.47 | 1.439 | III-10 | — | — | 2.24 | 2.25 | 539 | 75 | Comparison |
| 115 | " | S-13 | 3.96 | 1.449 | " | — | — | 2.24 | 2.25 | 538 | 74 | " |
| 116 | M-1 | Solv-3 | 7.33 | 1.555 | — | — | — | 2.34 | 2.34 | 552 | 89 | " |
| 117 | " | Solv-6 | 6.45 | 1.514 | — | — | — | 2.32 | 2.30 | 550 | 90 | " |
| 118 | " | Solv-2 | 6.45 | 1.493 | — | — | — | 2.32 | 2.28 | 550 | 89 | " |
| 119 | " | S-1 | 5.86 | 1.433 | — | — | — | 2.35 | 2.10 | 548 | 90 | " |
| 120 | " | S-9 | 5.18 | 1.485 | — | — | — | 2.34 | 2.15 | 548 | 89 | " |
| 121 | " | S-19 | 4.85 | 1.454 | — | — | — | 2.34 | 2.12 | 546 | 89 | " |
| 122 | " | S-12 | 4.47 | 1.439 | — | — | — | 2.35 | 2.11 | 546 | 89 | " |
| 123 | " | S-13 | 3.96 | 1.449 | — | — | — | 2.34 | 2.12 | 545 | 89 | " |
| 124 | " | Solv-3 | 7.33 | 1.555 | III-10 | — | — | 2.34 | 2.34 | 552 | 91 | " |
| 125 | " | Solv-6 | 6.45 | 1.514 | " | — | — | 2.32 | 2.34 | 550 | 91 | " |
| 126 | " | Solv-2 | 6.45 | 1.493 | " | — | — | 2.32 | 2.32 | 550 | 91 | " |
| 127 | " | S-1 | 5.86 | 1.433 | III-10 | — | — | 2.35 | 2.25 | 548 | 90 | Invention |
| 128 | " | S-9 | 5.18 | 1.485 | " | — | — | 2.35 | 2.28 | 548 | 91 | " |
| 129 | " | S-19 | 4.85 | 1.454 | " | — | — | 2.34 | 2.26 | 546 | 90 | " |
| 130 | " | S-12 | 4.47 | 1.439 | " | — | — | 2.35 | 2.25 | 546 | 90 | " |
| 131 | " | S-13 | 3.96 | 1.449 | " | — | — | 2.34 | 2.25 | 545 | 90 | " |
| 132 | M-4 | S-12 | 4.47 | 1.439 | " | — | — | 2.35 | 2.25 | 546 | 90 | |
| 133 | M-12 | S-12 | 4.47 | 1.439 | " | — | — | 2.31 | 2.24 | 546 | 88 | " |
| 134 | M-34 | S-12 | 4.47 | 1.439 | " | — | — | 2.28 | 2.24 | 545 | 86 | " |
| 135 | M-41 | S-13 | 5.86 | 1.433 | " | — | — | 2.33 | 2.15 | 546 | 90 | Comparison |
| 136 | " | S-13 | 5.86 | 1.433 | DAP* | — | — | 2.32 | 2.24 | 553 | 86 | " |
| 137 | " | S-13 | 5.86 | 1.433 | III-22 | — | — | 2.33 | 2.25 | 546 | 91 | Invention |
| 138 | " | S-13 | 5.86 | 1.433 | III-36 | — | — | 2.34 | 2.24 | 546 | 90 | " |
| 139 | M-41 | S-13 | 5.86 | 1.433 | III-3 | — | — | 2.32 | 2.25 | 546 | 90 | Invention |
| 140 | " | S-13 | 5.86 | 1.433 | III-20 | — | — | 2.34 | 2.24 | 546 | 91 | " |
| 141 | " | S-13 | 5.86 | 1.433 | III-22 | A-2 | — | 2.34 | 2.25 | 546 | 93 | " |
| 142 | " | S-1 | 5.86 | 1.433 | III-22 | — | B-9 | 2.34 | 2.27 | 546 | 96 | " |
| 143 | " | S-1 | 5.86 | 1.433 | III-22 | A-2 | B-9 | 2.34 | 2.28 | 546 | 98 | " |

*DAP: 2,4-di-t-amylphenol

From the comparison of Sample 100 and Sample 116, it can be seen that the pyrazolotriazole couplers of the present invention have higher color density and larger value of the color remaining factor after irradiation than the pyrazolotriazole couplers out of the scope of the present invention, and excellent in dye stability against light. When high boiling point organic solvents such as Solv-3, Solv-6 and Solv-2 which are out of the present invention are used as a dispersion medium as in Samples 116 to 118, $\lambda_{max}$ shows from 550 nm to 552 nm, which is too long as a preferred maximum absorption wavelength of magenta. On the contrary, when high boiling point organic solvents such as S-1, S-9, S-19, S-12 and S-13 of the present invention are used as in Samples 119 to 123, $\lambda_{max}$ shows 546 nm, which is a preferred maximum absorption wavelength of magenta. However, $D_B$ values of these samples are small, therefore, yellow color density lowers. On the other hand, Samples 127 to 131 in which the benzotriazole based ultraviolet absorbers of the present invention are used in addition to the high boiling point organic solvents of the present invention show high yellow color density. Further, Samples 141 to 143 in which the high boiling point organic solvents of the present invention, the benzotriazole based ultraviolet absorbers of the present invention and the compounds represented by formula (II) or (III) are used show higher $D_B$ values and higher yellow color density. In addition, it can be understood that dye stability against light is further improved. Therefore, a silver halide color photographic material which is excellent in dye stability of magenta color image against light, excellent in color reproducibility, and capable of providing sufficient yellow and magenta color densities can be obtained by using the coupler of the present invention, the high boiling point organic solvent, and the benzotriazole based ultraviolet absorber. The addition of the compounds represented by formulae (II) and (III) still further improves yellow colorability and dye stability of the magenta color image against light of the photographic material.

In addition to the above effects, the present invention brought about unexpected effect, that is, the emulsified dispersion containing the coupler of the present invention, the high boiling point organic solvent of the present invention, and the ultraviolet absorber of the present invention shows little fluctuation in grain size with the lapse of time and the formation of a big oil droplet is inhibited compared with the emulsified dispersion containing the coupler of the present invention and the high boiling point organic solvent of the present invention, but not containing the ultraviolet absorber of the present invention.

EXAMPLE 2

A surface of a paper support laminated on both sides with polyethylene was corona discharged. The support was provided with a gelatin subbing layer containing sodium dodecylbenzenesulfonate, and further, various photographic constitutional layers described below were coated to prepare a multilayer color photographic paper (Sample 200). The coating solutions were prepared in the following manner.

Preparation of Coating Solution for Third Layer 160.0 g of a magenta coupler (ExM-1) and 10.0 g of a color image stabilizer (Cpd-6) were dissolved in 10.0 g of a color image stabilizer (Cpd-17), 8.0 g of a color image stabilizer (Cpd-8), 650 g of a solvent (Solv-3), and 360 ml of ethyl acetate, and this solution was dispersed in an emulsified condition into 2,000 g of a 16% aqueous gelatin solution containing 60 ml of 10% sodium dodecylbenzenesulfonate and 10 g of citric acid to obtain an emulsified dispersion A. On the other hand, two kinds of silver chlorobromide emulsions B were prepared (cubic form, a mixture in a ratio of 1:3 (silver mol ratio) of a large grain size emulsion B having an average grain size of 0.55 μm, and a small grain size emulsion B having an average grain size of 0.39 μm; variation coefficients of the grain size distribution are 0.10 and 0.08, respectively, both of them contained 0.8 mol % of silver bromide localized at a part of the grain surface, and the remaining substrate being comprising silver chloride). The green-sensitive Sensitizing Dyes I and J shown below were added in an amount of $4.0\times10^{-4}$ mol, $7.0\times10^{-5}$ mol, respectively, per mol of silver, to the large grain size emulsion B, and $5.6\times10^{-4}$ mol, $1.0\times10^{-4}$ mol, respectively, per mol of silver, to the small grain size emulsion B. Chemical ripening was conducted by addition of a sulfur sensitizer and a gold sensitizer. The foregoing emulsified dispersion A was mixed with this silver chlorobromide emulsion B and dissolved to obtain a coating solution for the third layer having the composition described below.

The coating solutions for from the first to seventh layers other than the third layer were prepared in the same manner as the coating solution for the third layer. 1-Oxy-3,5-dichloro-s-triazine sodium salt was used as a gelatin hardening agent in each layer.

Further, Cpd-12 and Cpd-13 were added to each layer so that the total coating amount becomes 25.0 mg/m$^2$ and 50.0 mg/m$^2$, respectively.

The spectral sensitizing dyes described below were used in the silver chlorobromide emulsion of each light-sensitive emulsion layer.

Blue-Sensitive Emulsion Layer

The above described Sensitizing Dye A used in Example 1

The above described Sensitizing Dye B used in Example 1 (in an amount of $2.0\times10^{-4}$ mol/mol Ag, respectively, to the large grain size emulsion, and in an amount of $2.5\times10^{-4}$ mol/mol Ag, respectively, to the small grain size emulsion)

Green-Sensitive Emulsion Layer

Sensitizing Dye I

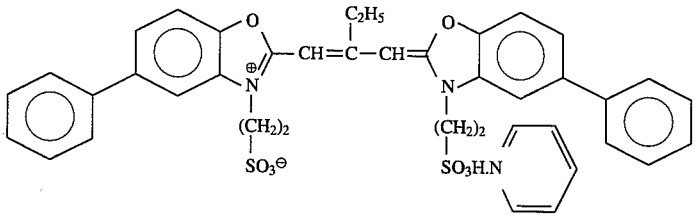

(in an amount of $4.0\times10^{-4}$ mol/mol Ag to the large grain size emulsion, and in an amount of $5.6\times10^{-4}$ mol/mol Ag to the small grain size emulsion)

Sensitizing Dye J

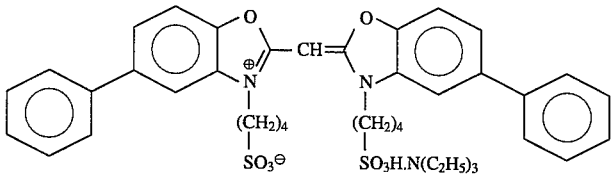

(in an amount of $7.0\times10^{-5}$ mol/mol Ag to the large grain size emulsion, and in an amount of $1.0\times10^{-4}$ mol/mol Ag to the small grain size emulsion)

Red-Sensitive Emulsion Layer

Sensitizing Dye K

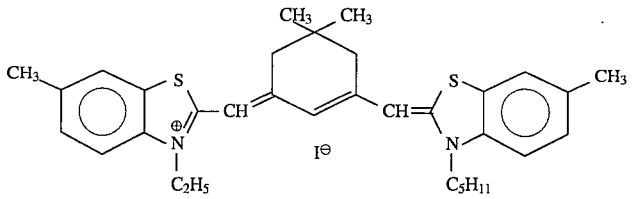

(in an amount of $0.9\times10^{-4}$ mol/mol Ag to the large grain size emulsion, and in an amount of $1.1\times10^{-4}$ mol/mol Ag to the small grain size emulsion)

The following compound was further added to the red-sensitive emulsion layer in an amount of $2.6\times10^{-3}$ mol per mol of silver halide.

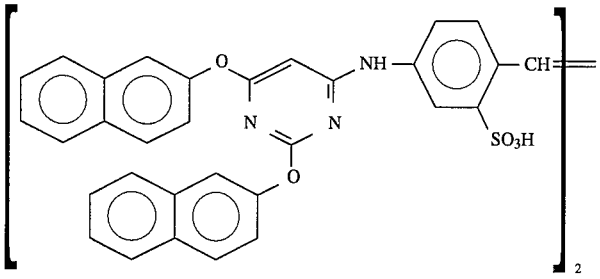

Further, 1-(5-methylureidophenyl)-5-mercaptotetrazole was added to the blue-sensitive emulsion layer, the green-sensitive emulsion layer and the red-sensitive emulsion layer in an amount of $8.5\times10^{-5}$ mol, $7.7\times10^{-4}$ mol and $2.5\times10^{-4}$ mol, respectively, per mol of silver halide.

In addition, 4-hydroxy-6-methyl-1,3,3a,7-tetraazaindene was added to the blue-sensitive emulsion layer and the green-sensitive emulsion layer in an amount of $1\times10^{-4}$ mol and $2\times10^{-4}$ mol, respectively, per mol of silver halide.

Moreover, the following dyes were added to the emulsion layer for preventing irradiation (the numerals in parentheses represent the coating amount).

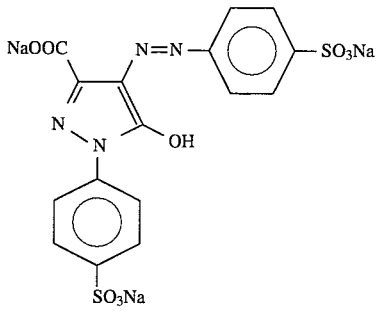

(10 mg/m²)

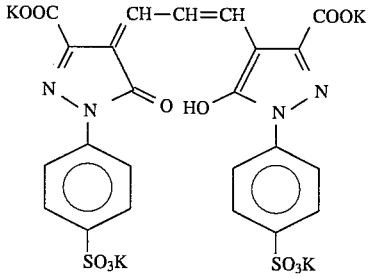

(10 mg/m²)

-continued

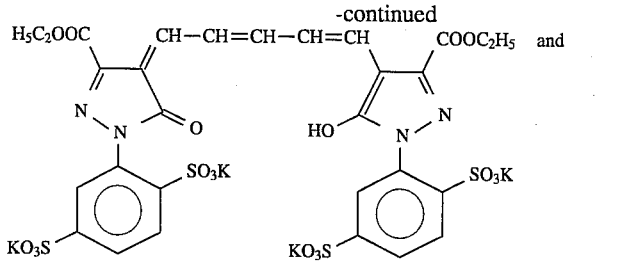

and (40 mg/m²)

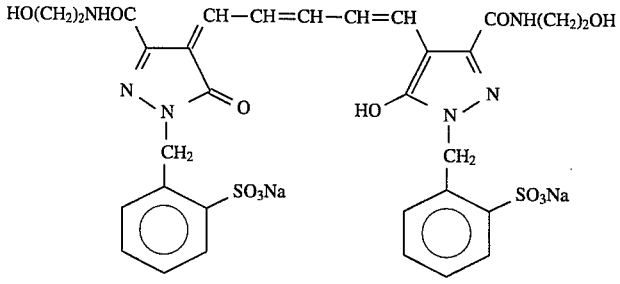

(20 mg/m²)

Layer Composition

The composition of each, layer is described below. The numeral represents the coating amount g/m². The numeral for the silver halide emulsion represents the coating amount in terms of silver.

Support

Polyethylene-laminated paper (a white pigment ($TiO_2$) and a blue dye (ultramarine) were added to the polyethylene of the first layer side).

| | |
|---|---|
| First Layer (blue-sensitive emulsion layer) | |
| Silver Chlorobromide Emulsion A described above | 0.27 |
| Gelatin | 1.36 |
| Yellow Coupler (ExY-2) | 0.79 |
| Color Image Stabilizer (Cpd-1) | 0.08 |
| Color Image Stabilizer (Cpd-2) | 0.04 |
| Color Image Stabilizer (Cpd-3) | 0.08 |
| Solvent (Solv-1) | 0.13 |
| Solvent (Solv-2) | 0.13 |
| Second Layer (color mixture inhibiting layer) | |
| Gelatin | 1.00 |
| Color Mixture Inhibitor (Cpd-16) | 0.06 |
| Solvent (Solv-2) | 0.25 |
| Solvent (Solv-3) | 0.25 |
| Solvent (Solv-7) | 0.03 |
| Third Layer (green-sensitive emulsion layer) | |
| Silver Chlorobromide Emulsion (cubic form, a mixture in a ratio of 1:3 (Ag mol ratio) of a large grain size emulsion B having an average grain size of 0.55 μm, and a small grain size emulsion B having an average grain size of 0.39 μm; variation coefficients of the grain size distribution are 0.10 and 0.08, respectively, both of them contained 0.8 mol % of AgBr localized at a part of the grain surface of substrate of silver chloride) | 0.13 |
| Gelatin | 1.45 |
| Magenta Coupler (ExM-l) | 0.16 |
| Color Image Stabilizer (Cpd-6) | 0.01 |
| Color Image Stabilizer (Cpd-17) | 0.01 |
| Color Image Stabilizer (Cpd-8) | 0.008 |
| Solvent (Solv-3) | 0.65 |
| Fourth Layer (color mixture inhibiting layer) | |
| Gelatin | 0.70 |
| Color Mixture Inhibitor (Cpd-16) | 0.04 |
| Solvent (Solv-2) | 0.18 |

-continued

| | |
|---|---|
| Solvent (Solv-3) | 0.18 |
| Solvent (Solv-7) | 0.02 |
| Fifth Layer (red-sensitive emulsion layer) | |
| Silver Chlorobromide Emulsion (cubic form, a mixture in a ratio of 1:4 (Ag mol ratio) of a large grain size emulsion C having an average grain size of 0.50 μm, and a small grain size emulsion C having an average grain size of 0.41 μm; variation coefficients of the grain size distribution are 0.09 and 0.11, respectively, both of them contained 0.8 mol % of AgBr localized at a part of the grain surface of substrate of silver chloride) | 0.20 |
| Gelatin | 0.85 |
| Cyan Coupler (ExC) | 0.33 |
| UV Absorbing Agent (UV-5) | 0.18 |
| Color Image Stabilizer (Cpd-1) | 0.33 |
| Color Image Stabilizer (Cpd-6) | 0.01 |
| Color Image Stabilizer (Cpd-8) | 0.01 |
| Color Image Stabilizer (Cpd-18) | 0.01 |
| Color Image Stabilizer (Cpd-9) | 0.01 |
| Color Image Stabilizer (Cpd-10) | 0.01 |
| Solvent (Solv-1) | 0.01 |
| Solvent (Solv-6) | 0.22 |
| Sixth Layer (UV absorbing layer) | |
| Gelatin | 0.55 |
| UV Absorbing Agent (UV-4) | 0.38 |
| Color Image Stabilizer (Cpd-5) | 0.02 |
| Color Image Stabilizer (Cpd-19) | 0.15 |
| Seventh Layer (protective layer) | |
| Gelatin | 1.13 |
| Acryl-Modified Copolymer of Polyvinyl Alcohol (modification degree: 17%) | 0.05 |
| Liquid Paraffin | 0.02 |
| Surfactant (Cpd-20) | 0.01 |
| (ExY-2) Yellow Coupler | |
| 1:1 mixture (by mol ratio) of | |

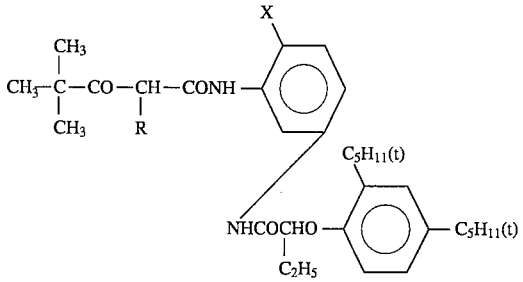
R = X = Cl
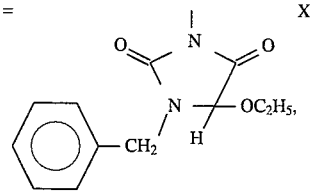
and
R = X = $OCH_3$
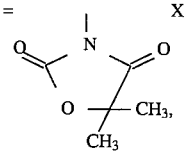
(ExC-2) Cyan Coupler
3:7 mixture (by mol ratio) of
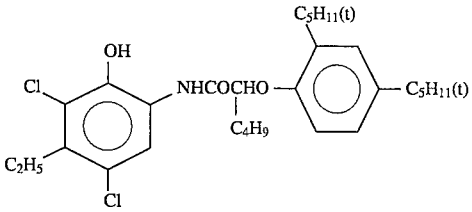
and
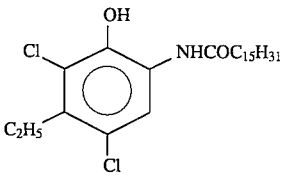
(Cpd-16) Color Mixture Inhibitor
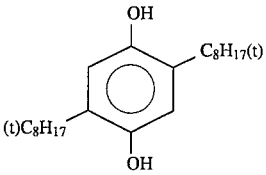
(Cpd-17) Color Image Stabilizer
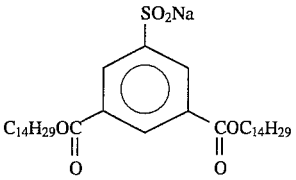
(Cpd-18) Color Image Stabilizer
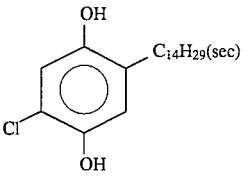
(Cpd-19)
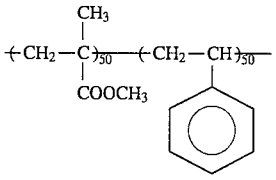
molecular weight: 60,000
(Cpd-20)
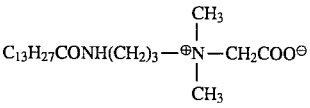
(UV-4) UV Absorbing Agent
1:5:10:5 mixture (by weight ratio) of (1):(2):(3):(4)
(1)
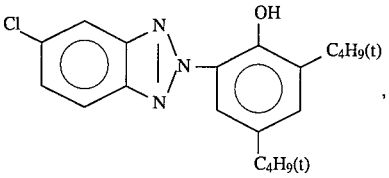
(2)
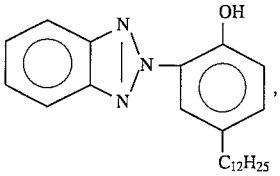
(3)
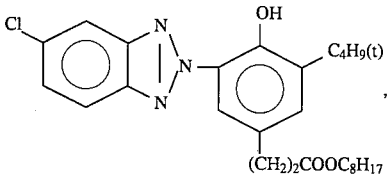

-continued (4)

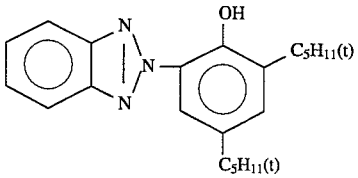

(UV-5) UV Absorbing Agent

1:2:2 mixture (by weight ratio) of (1):(2):(3)

(1)

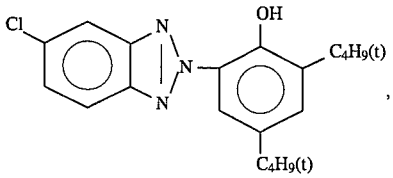

(2)

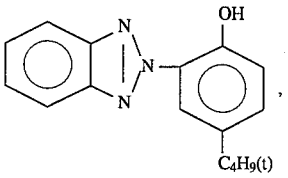

(3)

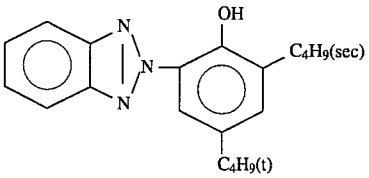

Samples 201 to 243 were prepared by replacing the magenta coupler in the third layer (green-sensitive layer) with the couplers used in Sample 101 to 143 in Example 1, and replacing the high boiling point organic solvent, the benzotriazole based ultraviolet absorber, the compound represented by formula (II), and the compound represented by formula (III) with, or by adding, the compounds using in Samples 101 to 143. At that time, the coating amount of the coupler was made equimolar with that of Sample 200. Also, the high boiling point organic solvent was replaced to be equal in weight with that of Sample 200. The benzotriazole based ultraviolet absorber, the compound represented by formula (II), and the compound represented by formula (III) were added to the coupler in amounts of 100 wt %, 10 wt %, and 10 wt %, respectively.

Samples 200 to 243 were evaluated in the same manner as in Example 1, the same results were obtained, that is, a silver halide color photographic material which is excellent in dye stability of magenta color image against light, excellent in color reproducibility, and capable of providing sufficient yellow and magenta color densities can be obtained by using the coupler of the present invention, the high boiling point organic solvent, and the benzotriazole based ultraviolet absorber. The addition of the compounds represented by formulae (II) and (III) still further improves yellow colorability and dye stability of the magenta color image against light of the photographic material.

The present invention can provide a silver halide color photographic material which has high colorability, high stability of the color image, preferred magenta hue, is excellent in color reproducibility, and has sufficient yellow color density, and a method of formation of color image.

While the invention has been described in detail and with reference to specific examples thereof, it will be apparent to one skilled in the art that various changes and modifications can be made therein without departing from the spirit and scope thereof.

What is claimed is:

1. A silver halide color photographic material comprising a support having thereon at least one yellow coloring light-sensitive silver halide emulsion layer, at least one magenta coloring light-sensitive silver halide emulsion layer, and at least one cyan coloring light-sensitive silver halide emulsion layer, wherein the magenta coloring light-sensitive silver halide emulsion layer contains at least one dye-forming coupler represented by the following formula (M-I), at least one high boiling point organic solvent having a dielectric constant of 6.0 or less and a refractive index of 1.50 or less, and at least one benzotriazole ultraviolet absorber:

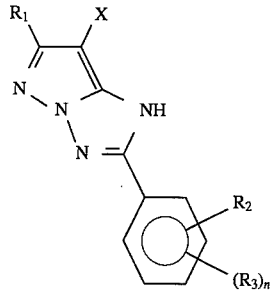

(M-I)

wherein $R_1$ represents a group represented by the following formula (Q-1), (Q-2) or (Q-3); $R_2$ and $R_3$ each represents a substituent; n represents an integer of from 0 to 4, and when n is 2 or more, the plurality of $R_3$ are the same or different; and X represents a hydrogen atom or a group capable of being eliminated upon coupling reaction with an oxidized product of a developing agent, $$—C(R_4)(R_5)—(R_6) \quad \text{(Q-1)}$$

wherein $R_4$ represents an alkyl group, a cycloalkyl group, an aryl group or a heterocyclic group; and $R_5$ and $R_6$ each represents a substituent; and, optionally, at least two of any of $R_4$, $R_5$ and $R_6$ are bonded to each other to form a 5- to 7-membered monocyclic or condensed ring;

$$—CH(R_7)—R_8 \quad \text{(Q-2)}$$

(Q-3)

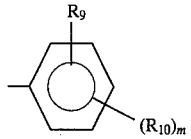

wherein $R_7$ represents an alkyl group, a cycloalkyl group, an aryl group or a heterocyclic group; and $R_8$ represents a substituent; and, optionally, $R_7$ and $R_8$ are bonded to each other to form a 5- to 7-membered monocyclic or condensed ring;

wherein $R_9$ and $R_{10}$ each represents a substituent; and m represents an integer of from 0 to 4; and when m is 2 or more, the plurality of $R_{10}$ are the same or different.

2. A silver halide color photographic material as claimed in claim 1, the substituent represented by $R_2$ and $R_3$ is an alkyl group, a cycloalkyl group, an alkenyl group, an aryl group, a heterocyclic group, cyano group, a halogen atom, hydroxyl group, nitro group, carboxyl group, an alkoxy group, a cycloalkoxy group, an aryloxy group, a heterocyclic oxy group, a silyloxy group, an acyloxy group, an alkoxycarbonyloxy group, a cycloalkoxycarbonyloxy group, an aryloxycarbonyloxy group, a carbamoyloxy group, a sulfamoyloxy group, an alkanesulfonyloxy group, an arenesulfonyloxy group, an acyl group, an alkoxycarbonyl group, a cycloalkoxycarbonyl group, an aryloxycarbonyl group, carbamoyl group, an amino group, an anilino group, a heterocyclic amino group, a carbonamido group, a ureido group, an imido group, an alkoxycarbonylamino group, an aryloxycarbonylamino group, a sulfonamido group, a sulfamoylamino group, an azo group, an alkylthio group, an arylthio group, a heterocyclicthio group, an alkylsulfinyl group, an arene sulfinyl group, an alkanesulfonyl group, an arene sulfonyl group, a sulfamoyl group, sulfo group or a phosphonyl group.

3. The silver halide color photographic material as claimed in claim 1, wherein $R_1$ in the dye forming coupler represented by formula (M-1) represents the group represented by formula (Q-1) or (Q-3):

$$—C(R_4)(R_5)—(R_6) \quad \text{(Q-1)}$$

wherin $R_4$ represents an alkyl group, a cycloalkyl group, an aryl group or a hetercyclic group; and $R_5$ and $R_6$ each represents a substituent; and at least two of anyl of $R_4$, $R_5$ and $R_6$ may be bonded each other to form a 5- to 7-membered monocyclic or condensed ring;

(Q-3)

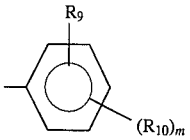

wherein $R_9$ and $R_{10}$ each represents a substituent; and m represents an integer of form 0 to 4: and when m is 2 or more, the plurality of $R_{10}$ are the same or different.

4. The silver halide color photographic material as claimed in claim 1, wherein the dye forming coupler represented by formula (M-I) is represented by formula (M-II):

(M-II)

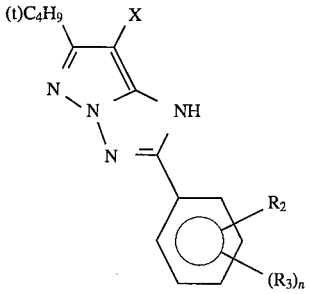

wherein $R_2$, $R_3$, n and X each has the same meaning as $R_2$, $R_3$, n and X in formula (M-I).

5. The silver halide color photographic material as claimed in claim 1 or 2, wherein said magenta coloring light-sensitive layer contains at least one compound represented by the following formula (II) or (III):

(II)

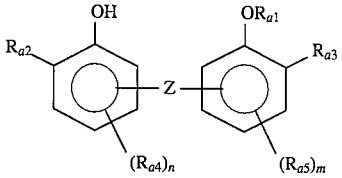

wherein $R_{a1}$ represents a hydrogen atom, an aliphatic group, an arylcarbonyl group, an aliphatic carbonyl group or a sulfonyl group; $R_{a2}$ and $R_{a3}$ are the same or different and each represents a hydrogen atom, an aliphatic group, an aliphatic oxy group, an acylamino group, an aliphatic oxycarbonyl group or a carbamoyl group; $R_{a4}$ and $R_{a5}$ are the same or different and each represents an aliphatic group or an acylamino group; Z represents a bond or a divalent linking group; n and m each represents 0, 1 or 2; and when n or m is 2, the plurality of $R_{a4}$ or $R_{a5}$ are the same or different, (III)

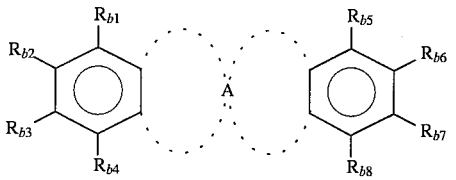

wherein $R_{b1}$, $R_{b2}$, $R_{b3}$, $R_{b4}$, $R_{b5}$, $R_{b6}$, $R_{b7}$ and $R_{b8}$ are the same or different, and each represents a hydrogen atom, an aliphatic group, an acyl group, an acylamino group, and aliphatic oxycarbonyl group, an aryloxycarbonyl group, a halogen atom, a sulfonyl group, a carbamoyl group, a sulfamoyl group, or $—X_b—R_{b9}$; A represents a non-metal atomic group necessary to form a spiro ring or a bicyclo ring; $X_b$ represents —O—, —S— or —N($R_{b10}$)—; $R_{b9}$ and $R_{b10}$ are the same or different and each represents an aliphatic group; of $R_{b1}$ to $R_{b8}$, those substituents at the ortho position to each other may be bonded together to form a 5- to 8-membered ring; optionally $R_{b9}$ and $R_{10}$ are bonded to each other to form a 5- to 7-membered ring; provided that at least one of $R_{b1}$ to $R_{b4}$, and at least one of $R_{b5}$ to $R_{b8}$ represent $—X_b—R_{b9}$, which are the same or different.

6. The silver halide color photogrphic material as claimed in claim 1, wherein the amount of the magenta coupler represented by formula (M-1) is from 0.01 to 10 mmol/$m^2$.

7. The silver halide color photographic material as claimed in claim 1, wherein the amount of the high boiling point organic solvent is from 0.2 to 10.0 in weight ratio to the magenta coupler.

8. The silver halide color photographic material as claimed in claim 1, wherein the amount of the ultraviolet absorber is from 0.05 to 5.0 in weight ratio to the magenta coupler contained in the photographic material.

9. The silver halide color photographic material as claimed in claim 1, wherein the benzotriazole ultraviolet absorber is 2-(2'-hydroxyphenyl) benzotriazole compound represented by the following formula (IV):

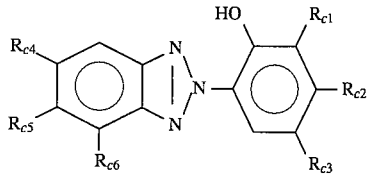

wherein $R_{c1}$, $R_{c2}$, $R_{c3}$, $R_{c4}$, $R_{c5}$ and $R_{c6}$, which are the same or different, each represents a hydrogen atom, a halogen atom, a nitro group, a hydroxyl group, an alkyl group, an alkoxy group, an aryl group, an aryloxy group, an acylamino group, a carbamoyl group, or sulfo group; and, optionally, $R_{c5}$ and $R_{c6}$ are linked to each other to form a 6-membered ring.

10. The silver halide color photographic material as claimed in claim 1, wherein said yellow coloring silver light-sensitive silver halide emulsion layer is closer to the support than said magenta coloring light-sensitive silver halide emulsion layer.

11. The silver halide color photographic material as claimed in claim 1, wherein said magenta coloring light-sensitive silver halide emulsion layer contains a mixture of at least two high boiling point organic solvents;

said mixture of solvents having a weighted mean average dielectric constant of 6.0 or less and a weighted mean average refractive index of 1.50 or less.

12. The silver halide color photographic material as claimed in claim 1, wherein said high boiling point organic solvent has a dielectric constant of 5.5 or less.

13. The silver halide color photographic material as claimed in claim 12, wherein said high boiling point organic solvent has a dielectric constant in the range of 3.0 to 5.0.

14. The silver halide color photographic material as claimed in claim 1, wherein said high boiling point organic solvent has a refractive index of 1.48 or less.

15. The silver halide color photographic material as claimed in claim 12, wherein said high boiling point organic solvent has a refractive index in the range of 1.40 to 1.48.

* * * * *